US009012112B2

(12) United States Patent
Tomono et al.

(10) Patent No.: US 9,012,112 B2
(45) Date of Patent: Apr. 21, 2015

(54) ELECTROPHOTOGRAPHIC PHOTOSENSITIVE MEMBER, PROCESS CARTRIDGE, AND ELECTROPHOTOGRAPHIC APPARATUS

(71) Applicant: Canon Kabushiki Kaisha, Tokyo (JP)

(72) Inventors: Hiroyuki Tomono, Numazu (JP); Kunihiko Sekido, Suntou-gun (JP); Michiyo Sekiya, Atami (JP); Atsushi Okuda, Yokohama (JP); Yuka Ishiduka, Suntou-gun (JP); Nobuhiro Nakamura, Mishima (JP); Yota Ito, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/930,334

(22) Filed: Jun. 28, 2013

(65) Prior Publication Data

US 2014/0004451 A1 Jan. 2, 2014

(30) Foreign Application Priority Data

Jun. 29, 2012 (JP) ..... 2012-147155
Apr. 25, 2013 (JP) ..... 2013-093091
Jun. 4, 2013 (JP) ..... 2013-118068

(51) Int. Cl.

| | |
|---|---|
| ***G03G 5/14*** | (2006.01) |
| ***G03G 15/00*** | (2006.01) |
| ***G03G 5/05*** | (2006.01) |
| ***G03G 5/06*** | (2006.01) |
| ***G03G 5/07*** | (2006.01) |

(52) U.S. Cl.

CPC ..... *G03G 15/751* (2013.01); *G03G 5/0592* (2013.01); *G03G 5/0612* (2013.01); *G03G 5/065* (2013.01); *G03G 5/0651* (2013.01); *G03G 5/07* (2013.01); *G03G 5/076* (2013.01); *G03G 5/14* (2013.01); *G03G 5/142* (2013.01); *G03G 15/00* (2013.01)

(58) Field of Classification Search

USPC ..... 430/60, 62

See application file for complete search history.

(56) References Cited

U.S. PATENT DOCUMENTS

| | | | | |
|---|---|---|---|---|
| 4,442,193 | A | 4/1984 | Chen | |
| 4,562,132 | A | 12/1985 | Ong et al. | |
| 4,992,349 | A | 2/1991 | Chen | |
| 5,468,583 | A | 11/1995 | Gruenbaum | |
| 5,747,206 | A * | 5/1998 | Agata et al. | 430/64 |
| 5,795,690 | A | 8/1998 | Takegawa | |

(Continued)

FOREIGN PATENT DOCUMENTS

| | | |
|---|---|---|
| EP | 1542082 A1 | 6/2005 |
| EP | 2033961 A1 | 3/2009 |

(Continued)

OTHER PUBLICATIONS

Brooks A. Jones et al., "Cyanonaphthalene Diimide Semiconductors for Air-Stable, Flexible, and Optically Transparent n-Channel Field-Effect Transistors", Chemistry of Materials,vol. 19,No. 11,2703-2705(2007).

(Continued)

*Primary Examiner* — Peter Vajda

(74) *Attorney, Agent, or Firm* — Canon U.S.A. Inc., IP Division

(57) ABSTRACT

An electrophotographic photosensitive member includes an undercoat layer having a structure represented by formula (1).

8 Claims, 4 Drawing Sheets

(56) References Cited

U.S. PATENT DOCUMENTS

| | | | |
|---|---|---|---|
| 7,670,740 | B2 | 3/2010 | Wu et al. |
| 7,781,132 | B2 | 8/2010 | Yanus et al. |
| 2004/0166427 | A1 | 8/2004 | Tong |
| 2006/0281020 | A1 | 12/2006 | Kim |
| 2007/0026332 | A1 | 2/2007 | Ferrar |
| 2007/0059619 | A1 | 3/2007 | Shimoyama |
| 2011/0318675 | A1 | 12/2011 | Yu |
| 2012/0064442 | A1 | 3/2012 | Kawabata |
| 2014/0011127 | A1 | 1/2014 | Nakamura et al. |

FOREIGN PATENT DOCUMENTS

| | | | |
|---|---|---|---|
| EP | 2107424 | A1 | 10/2009 |
| EP | 2180376 | A2 | 4/2010 |
| JP | 1-206349 | A | 8/1989 |
| JP | 5-279582 | A | 10/1993 |
| JP | 7-70038 | A | 3/1995 |
| JP | 09-127716 | A | 5/1997 |
| JP | 9-151157 | A | 6/1997 |
| JP | 2001-83726 | A | 3/2001 |
| JP | 2003-330209 | A | 11/2003 |
| JP | 2003-345044 | A | 12/2003 |
| JP | 2004093801 | A | 3/2004 |
| JP | 2006-178504 | A | 7/2006 |
| JP | 2007-148293 | A | 6/2007 |
| JP | 2008-65173 | A | 3/2008 |
| JP | 2008-250082 | A | 10/2008 |
| JP | 2008-299344 | A | 12/2008 |
| JP | 2009-505156 | A | 2/2009 |

OTHER PUBLICATIONS

Hiroyuki Miyamura et al., "Polymer Incarcerated Gold Catalyzed Aerobic Oxidation of Hydroquinones and their Derivatives", Chemistry Letters,37(3),360-361(2008).

Hideki Okada, et al., Synthesis and Properties of a Novel Electron Transporting Compound, 3,3'-dialkyl-4,4'-bisnaphthylquinone (DBNQ), PPCI Japan Hard Copy'98 p. 207, 1998.

Ronald Callahan, et al, "Syntheses of Phencyclone Analogues . . . ", Chem.Educator No. 6,227-234(2001).

Masaki Yamada, et al., "Synthesis and Properties of Diamino-Substituted Dipyrido [3,2-a: 2',3'-c]phenazine", Bull. Chem.Soc.Jpn. ,vol. 65,1006-1011(1992).

Brooks A. Jones, et al., "Tuning Orbital Energetics in Arylene Diinlide Semiconductors, Materials Design for Ambient Stability of n-Type Charge Transport", Journal of the American chemical society,vol. 129,No. 49,15259-78 (2007).

Tetrahedron Letters,43(16),2991-2994(2002).

Tetrahedron Letters,44(10),2087-2091(2003).

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

1. Field of the Invention

The present invention relates to an electrophotographic photosensitive member, a process cartridge that includes an electrophotographic photosensitive member, and an electrophotographic apparatus.

2. Description of the Related Art

Presently, the mainstream electrophotographic photosensitive member used in process cartridges and electrophotographic apparatuses are those that contain organic photoconductive substances. An electrophotographic photosensitive member typically includes a support and a photosensitive layer formed on the support.

An undercoat layer is often interposed between the support and the photosensitive layer to suppress charge injection from the support side toward the photosensitive layer side and to suppress occurrence of image defects such as black dots.

In recent years, electrophotographic photosensitive members have come to contain charge generating substances having high sensitivity. However, as the sensitivity of the charge generating substances increases, the amount of charges generated is increased and charges tend to remain in the photosensitive layers, resulting in a problem called ghosting. In particular, a phenomenon called positive ghosting in which only the density of the portion irradiated with light during the previous rotation is increased in an output image is likely to occur.

Such a ghosting phenomenon has been suppressed by, for example, adding an electron transporting substance to the undercoat layer. From the viewpoint of flexibility of the material design of a photosensitive layer on the undercoat layer, an undercoat layer containing an electron transporting substance desirably uses a curable material that is sparingly soluble in solvents contained in coating solutions for forming photosensitive layers. PCT Japanese Translation Patent Publication No. 2009-505156 discloses an undercoat layer that contains a polymer obtained from a crosslinking agent and a condensation polymer (electron transporting substance) that has an aromatic tetracarbonylbisimide skeleton and a crosslinking portion. Japanese Patent Laid-Open No. 2006-178504 discloses an undercoat layer containing a polymer of an electron transporting substance that has a non-hydrolyzable condensation-polymerizable functional group.

In recent years, the quality requirements for the electrophotographic images have become more and more stringent and the permissible range for the positive ghosting has also narrowed.

The inventors of the present invention have conducted extensive studies and found that the techniques disclosed in PCT Japanese Translation Patent Publication No. 2009-505156 and Japanese Patent Laid-Open No. 2006-178504 have room for improvements as to suppression of positive ghosting. In addition, when charges tend to remain in the undercoat layer and at the interface between the undercoat layer and the photosensitive layer, the potential easily fluctuates after repeated use. Thus, the potential fluctuation needs to be decreased.

SUMMARY OF THE INVENTION

The present invention provides an electrophotographic photosensitive member that suppresses positive ghosting and potential fluctuation despite long-term repeated use. A process cartridge and an electrophotographic apparatus that include the electrophotographic photosensitive member are also provided.

An aspect of the present invention provides an electrophotographic photosensitive member that comprises a support, an undercoat layer formed on the support, and a photosensitive layer formed on the undercoat layer. The undercoat layer comprises a structure represented by formula (1) below:

(1)

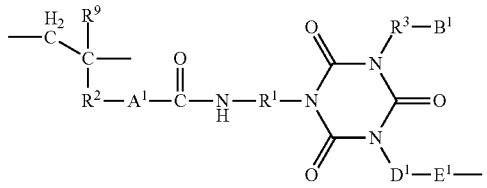

where, in formula (1), $R^1$ and $R^3$ each independently represent a substituted or unsubstituted alkylene group having 1 to 10 main-chain atoms or a substituted or unsubstituted phenylene group; $R^2$ represents a single bond, a substituted or unsubstituted alkylene group having 1 to 10 main-chain atoms, or a substituted or unsubstituted phenylene group; a substituent of the substituted alkylene group is an alkyl group, an aryl group, a hydroxy group, or a halogen atom; a substituent of the substituted phenylene group is a halogen atom, a nitro group, a cyano group, a hydroxy group, an alkyl group, or a halogenated alkyl group; $R^9$ represents a hydrogen atom or an alkyl group; $A^1$ represents a group represented by any one of formulae (A-1) to (A-6) below; $B^1$ represents a group represented by any one of formulae (B-1) to (B-3) below; $D^1$ represents a group having 5 to 15 main-chain atoms and being represented by formula (D) below; and $E^1$ represents a divalent group represented by any one of formulae (E-1) to (E-8) below:

(A-1)

(A-2)

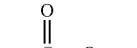

(A-3)

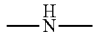

(A-4)

(A-5)

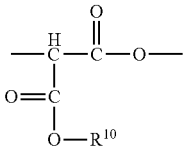

(A-6)

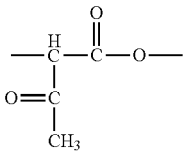

where, in formula (A-5), $R^{10}$ represents a hydrogen atom or an alkyl group;

(B-1)

$$-N=C=O$$

(B-2)

$$*-NH-\underset{\underset{O}{\|}}{C}-A^2-(R^6)_o-(Ar^2)_p-(R^7)_q-E^1-$$

(B-3)

$$*-NH-\underset{\underset{O}{\|}}{C}-A^1-\underset{\underset{R^{12}}{|}}{\overset{R^2}{C}}-\underset{\underset{H_2}{|}}{C}-$$

where, in formulae (B-1) to (B-3), $R^2$ represents a single bond, a substituted or unsubstituted alkylene group having 1 to 10 main-chain atoms or a substituted or unsubstituted phenylene group; $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group; one of the carbon atoms in the main chain of the alkylene group may be replaced with O, S, NH, or $NR^{15}$, $R^{15}$ representing an alkyl group; $Ar^2$ represents a substituted or unsubstituted phenylene group; a substituent of the substituted phenylene group is a halogen atom, a nitro group, a hydroxy group, a cyano group, an alkyl group, or a halogenated alkyl group; $R^{12}$ represents a hydrogen atom or an alkyl group; $A^1$ and $A^2$ each represent a group represented by any one of formulae (A-1) to (A-6) above; o, p and q each independently represent 0 or 1 and a sum of o, p and q is 1 to 3; and * represents a side in which $R^3$ of formula (1) is bonded;

(D)

$$-(R^4)_l-(Ar^1)_m-(R^5)_n-NH-\underset{\underset{O}{\|}}{C}-A^2-(R^6)_o-(Ar^2)_p-(R^7)_q-$$

where, in formula (D), $R^4$, $R^5$, $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group; one of the carbon atoms in the main chain of the alkylene group may be replaced with O, S, NH, or $NR^{15}$, $R^{15}$ representing an alkyl group; $Ar^1$ and $Ar^2$ each independently represent a substituted or unsubstituted phenylene group, a substituent of the substituted phenylene group is a halogen atom, a nitro group, a hydroxy group, a cyano group, an alkyl group, or a halogenated alkyl group; $A^2$ represents a group represented by any one of formulae (A-1) to (A-6) above; and l, m, n, o, p and q each independently represent 0 or 1, a sum of l, m and n is 1 to 3, and a sum of o, p and q is 1 to 3; and (E-1)

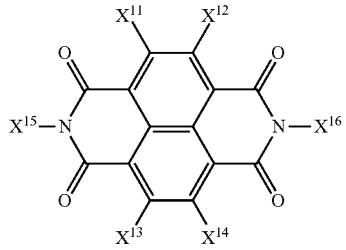

(E-2)

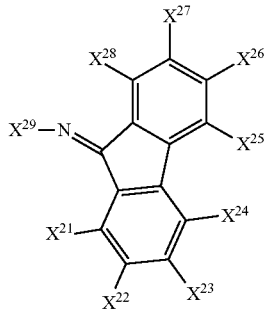

(E-3)

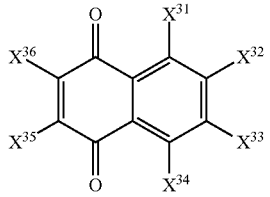

(E-4)

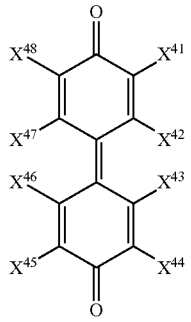

(E-5)

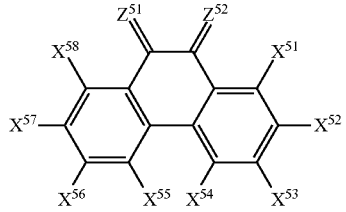

(E-6)

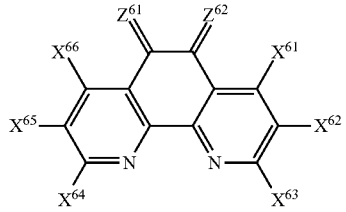

-continued (E-7)

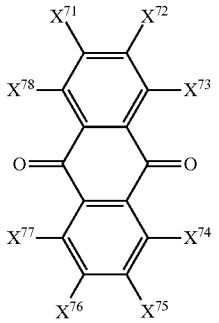

(E-8)

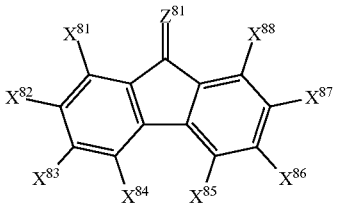

where, in formulae (E-1) to (E-8), two selected from $X^{11}$ to $X^{16}$, two selected from $X^{21}$ to $X^{29}$, two selected from $X^{31}$ to $X^{36}$, two selected from $X^{41}$ to $X^{48}$, two selected from $X^{51}$ to $X^{58}$, two selected from $X^{61}$ to $X^{66}$, two selected from $X^{71}$ to $X^{78}$, and two selected from $X^{81}$ to $X^{88}$ each represent a single bond, the rest of $X^{11}$ to $X^{16}$, $X^{21}$, to $X^{29}$, $X^{31}$ to $X_{36}$, $X^{41}$, to $X^{48}$, $X^{51}$ to $X^{58}$, $X^{61}$ to $X^{66}$, $X^{71}$ to $X^{78}$, and $X^{81}$ to $X^{88}$ each independently represent a hydrogen atom, a halogen atom, an alkoxycarbonyl group, a carboxyl group, a cyano group, a dialkylamino group, a hydroxy group, a heterocyclic group, a nitro group, a substituted or unsubstituted alkoxy group, or a substituted or unsubstituted alkyl group, and $Z^{51}$, $Z^{52}$, $Z^{61}$, $Z^{62}$, and $Z^{81}$ each independently represent an oxygen atom, a $C(CN)_2$ group, or N—$R^{11}$, with $R^{11}$ representing a substituted or unsubstituted aryl group or a substituted or unsubstituted alkyl group.

Another aspect of the present invention provides a process cartridge detachably attachable to a main body of an electrophotographic apparatus. The process cartridge integrally supports the electrophotographic photosensitive member described above and at least one device selected from the group consisting of a charging device, a developing device, a transferring device, and a cleaning device.

Yet another aspect of the present invention provides an electrophotographic apparatus that comprises the electrophotographic photosensitive member described above, a charging device, an exposure device, a developing device, and a transferring device.

Further features of the present invention will become apparent from the following description of exemplary embodiments with reference to the attached drawings.

DESCRIPTION OF THE EMBODIMENTS

An electrophotographic photosensitive member according to an embodiment of the present invention includes a support, an undercoat layer on the support, and a photosensitive layer on the undercoat layer. The photosensitive layer may be a layered (separated function) photosensitive layer constituted by a charge generating layer containing a charge generating substance and a charge transporting layer containing a charge transporting substance. From the viewpoint of electrophotographic properties, the layered photosensitive layer may be a normal-order layered photosensitive layer that includes a charge generating layer and a charge transporting layer stacked in that order from the support side.

Figure 4A:
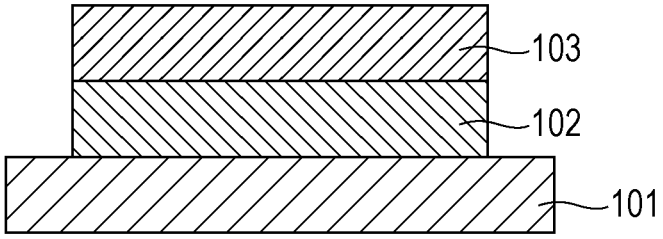
FIGS. 4A and 4B illustrate examples of the layer configuration of an electrophotographic photosensitive member.
Figure 4B:
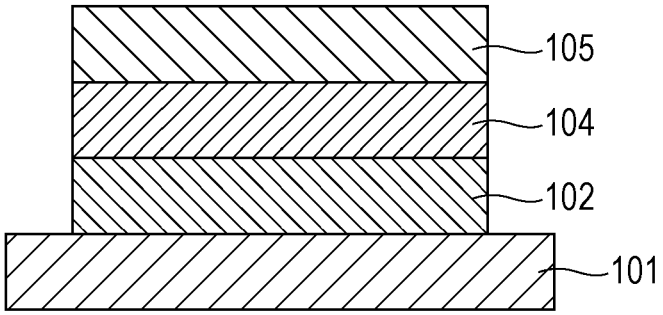

FIGS. 4A and 4B are diagrams showing examples of the layer configuration of the electrophotographic photosensitive member. An electrophotographic photosensitive member in FIG. 4A includes a support 101, an undercoat layer 102, and a photosensitive layer 103. An electrophotographic photosensitive member shown in FIG. 4B includes a support 101, an undercoat layer 102, a charge generating layer 104, and a charge transporting layer 105.

The undercoat layer (cured layer) is a layer that has a structure represented by formula (1) below. In other words, the undercoat layer comprises a cured product (polymer) having a structure represented by formula (1) below. The undercoat layer may be constituted by one or more layers. When the undercoat layer is constituted by two or more layers, at least one of the layers has the structure represented by formula (1) below:

(1)

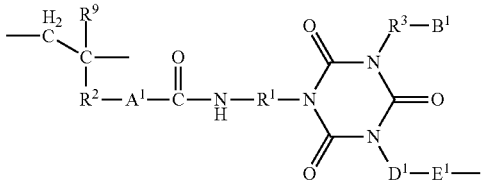

where $R^1$ and $R^3$ each independently represents a substituted or unsubstituted alkylene group having 1 to 10 carbon atoms or a substituted or unsubstituted phenylene group; $R^2$ represents a single bond, a substituted or unsubstituted alkylene group having 1 to 10 carbon atoms, or a substituted or unsubstituted phenylene group; $R^9$ represents a hydrogen atom or an alkyl group; $A^1$ represents a group represented by one of formulae (A-1) to (A-6) below; $B^1$ represents a group represented by one of formulae (B-1) to (B-3) below; $D^1$ represents a group having 5 to 15 main-chain atoms and being represented by formula (D); and $E^1$ represents a divalent group represented by one of formulae (E-1) to (E-8) below.

The substituent of the substituted alkylene group is an alkyl group, an aryl group, a hydroxy group, or a halogen atom. Examples of the substituent of the substituted phenylene group include a halogen atom, a nitro group, a cyano group, a hydroxy group, an alkyl group, and a halogen-substituted alkyl group.

(A-1)

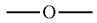

(A-2)

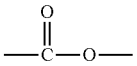

-continued (A-3)

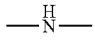

(A-4)

(A-5)

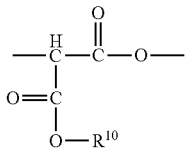

(A-6)

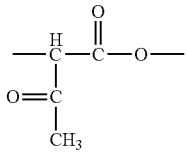

In formula (A-5), $R^{10}$ represents a hydrogen atom or an alkyl group.

(B-1)

(B-2)

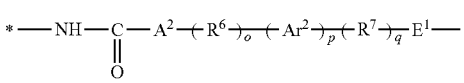

(B-3)

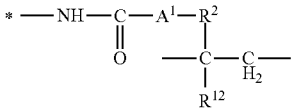

In formulae (B-1) to (B-3), $R^2$ represents a single bond, a substituted or unsubstituted alkylene group having 1 to 10 main-chain atoms, or a substituted or unsubstituted phenylene group. $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group. One of the carbon atoms in the main chain of the alkylene group may be replaced with O, S, NH, or $NR^{15}$, where $R^{15}$ represents an alkyl group. $Ar^2$ represents a substituted or unsubstituted phenylene group. $R^{12}$ represents a hydrogen atom or an alkyl group. $A^1$ and $A^2$ each represent a group represented by any one of formulae (A-1) to (A-6). In formulae (B-1) to (B-3), o, p, and q each independently represent an integer of 0 or 1 and the sum thereof is 1 or more and 3 or less. The substituent of the substituted alkyl group is an alkyl group, an aryl group, or a halogen atom. The substituent of the substituted phenylene group is a halogen atom, a nitro group, a cyano group, a hydroxy group, an alkyl group, a halogenated alkyl group, or the like. The asterisk indicates the side that bonds to $R^3$ in formula (1).

(D)

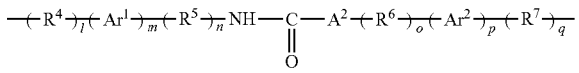

In formula (D), $R^4$, $R^5$, $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group. One of the carbon atoms in the main chain of the alkylene group may be replaced with O, S, NH, or $NR^{15}$, where $R^{15}$ represents an alkyl group. $Ar^1$ and $Ar^2$ each represent a substituted or unsubstituted phenylene group. Examples of the substituent of the substituted alkylene group include an alkyl group, an aryl group, and a halogen atom. Examples of the substituent of the substituted phenylene group include a halogen atom, a nitro group, a hydroxy group, a cyano group, an alkyl group, and a halogenated alkyl group. $A^2$ represents a group represented by one of formulae (A-1) to (A-6); l, m, n, o, p, and q each independently represent 0 or 1, and the sum of l, m, and n and the sum of o, p, and q are each 1 or more and 3 or less.

$R^4$, $R^5$, $R^6$ and $R^7$ each preferably represent an alkylene group having 1 to 5 main-chain atoms and being substituted with a methyl group or an ethyl group, or an alkylene group having 1 to 5 main-chain atoms. More preferably, $Ar^1$ and $Ar^2$ each represent a phenylene group.

From the viewpoint of suppressing positive ghosting, $D^1$ is more preferably a group having 10 to 15 main-chain atoms represented by the formula (D).

(E-1)

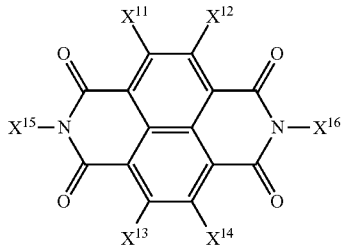

(E-2)

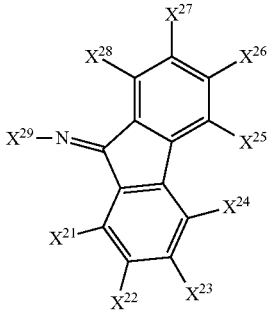

-continued (E-3)

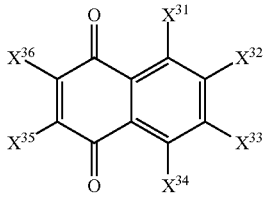

(E-4)

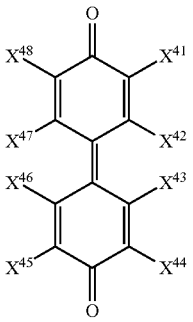

(E-5)

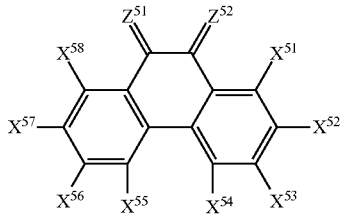

(E-6)

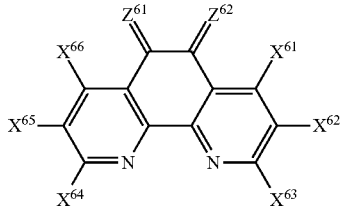

(E-7)

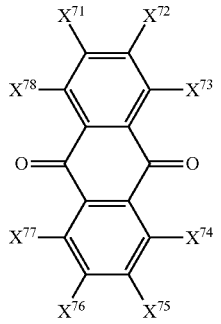

(E-8)

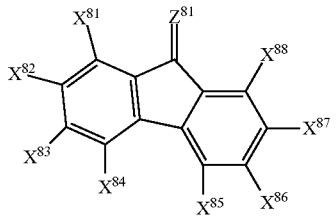

In formulae (E-1) to (E-8), two selected from $X^{11}$ to $X^{16}$, two selected from $X^{21}$ to $X^{29}$, two selected from $X^{31}$ to $X^{36}$, two selected from $X^{41}$ to $X^{48}$, two selected from $X^{51}$ to $X^{58}$, two selected from $X^{61}$ to $X^{66}$, two selected from $X^{71}$ to $X^{78}$, and two selected from $X^{81}$ to $X^{88}$ are each a single bond. The rest of $X^{11}$ to $X^{16}$, $X^{21}$ to $X^{29}$, $X^{31}$ to $X^{36}$, $X^{41}$ to $X^{48}$, $X^{51}$ to $X^{58}$, $X^{61}$ to $X^{66}$, $X^{71}$ to $X^{78}$, and $X^{81}$ to $X^{88}$ each independently represent a hydrogen atom, a halogen atom, an alkoxycarbonyl group, a carboxyl group, a cyano group, a dialkylamino group, a hydroxy group, a heterocyclic group, a nitro group, a substituted or unsubstituted alkoxy group, or a substituted or unsubstituted alkyl group. The substituent of the substituted alkoxy group is a carboxyl group, a cyano group, a dialkylamino group, a hydroxy group, an alkyl group, an alkoxy-substituted alkyl group, a halogenated alkyl group, an alkoxy group, an alkoxy-substituted alkoxyl group, a halogen-substituted alkoxy group, a nitro group, or a halogen atom. The substituent of the substituted alkyl group is a carboxyl group, a cyano group, a dialkylamino group, a hydroxy group, an alkyl group, an alkoxy-substituted alkyl group, a halogenated alkyl group, an alkoxy group, an alkoxy-substituted alkoxy group, a halogen substituted alkoxy group, a nitro group, or a halogen atom. $Z^{51}$ to $Z^{52}$, $Z^{61}$ to $Z^{62}$, and $Z^{81}$ each independently represent an oxygen atom, a $C(CN)_2$ group, or N—$R^{11}$, with $R^{11}$ representing a substituted or unsubstituted aryl group or a substituted or unsubstituted alkyl group. The substituent of the substituted aryl group is a carboxyl group, a cyano group, a dialkylamino group, a hydroxy group, an alkyl group, an alkoxy-substituted alkyl group, a halogenated alkyl group, an alkoxy group, an alkoxy-substituted alkoxy group, a halogen-substituted alkoxy group, a nitro group, or a halogen atom. The substituent of the substituted alkyl group is a carboxyl group, a cyano group, a dialkylamino group, a hydroxy group, an alkyl group, an alkoxy-substituted alkyl group, a halogenated alkyl group, an alkoxy group, an alkoxy-substituted alkoxy group, a halogen-substituted alkoxy group, a nitro group, or a halogen atom.

In the structure represented by formula (1), $R^2$ bonds to a structure X marked by a broken line in formula (1-A) below. This structure X is presumably the part that corresponds to a resin chain.

In $D^1$, the number of main-chain atoms means the number of atoms that are present in the shortest segment between the right-end-side and left-end-side bonds in formula (D) above. For example, a p-phenylene group has 4 main-chain atoms. An m-phenylene group has 3 main-chain atoms. An o-phenylene group has 2 main-chain atoms.

The inventors consider the following to be the reason why an undercoat layer having a structure represented by formula (1) has an effect of reducing positive ghosting despite long-term repeated use.

The polymer disclosed in PCT Japanese Translation Patent Publication No. 2009-505156 has a large distance (intermolecular distance) between an electron transporting compound and a crosslinking agent and thus it tends to form an electron trap. When an electron trap is formed in the undercoat layer, the electron transporting property tends to be degraded and residual charges readily occur. As a result, residual charges easily accumulate by long-term repeated use, thereby causing positive ghosting.

The inventors believe that positive ghosting by long-term use is suppressed because the electron transporting structure ($E^1$) is bonded the isocyanurate structure (the portion surrounded by a broken line in formula (1-A)) via a group having 5 to 15 main-chain atoms. The electron transporting structure ($E^1$) and the isocyanurate structure both have an electron transporting property and when these two structures bond to each other, a conduction level, which is considered to be the cause of the electron transporting property, is formed.

(1-A)

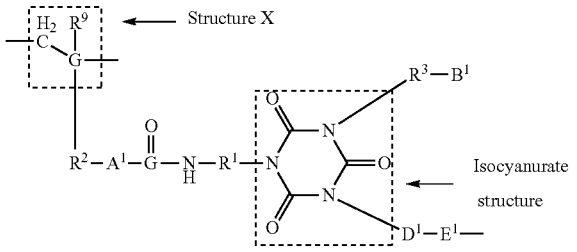

Moreover, since a group having 5 to 15 main-chain atoms represented by formula (D) is present between the electron transporting structure and the isocyanurate structure, a more even conduction level is formed. As a result, charges are rarely trapped and generation of residual charges are suppressed in the undercoat layer. Moreover, positive ghosting caused by long-term repeated use is suppressed. If the number of main-chain atoms in $D^1$ is less than 5 or more than 15, residual charges easily accumulate in the undercoat layer by long-term repeated use and positive ghosting easily occurs.

If the number of main-chain atoms in $D^1$ is less than 5, the isocyanurate structure or the electron transporting structure directly bonds to the urethane bond portion (—NHCO—). In such a case, the urethane bond portion becomes susceptible to hydrolysis and cleavage of the urethane bond easily occurs. As the conduction level in the undercoat layer locally changes, charge traps are generated and the residual charges easily accumulate in the undercoat layer during long-term repeated use. If the number of main-chain atoms in $D^1$ is larger than 15, interaction between the electron transporting structure and the isocyanurate structure is inhibited, the electron transport structures tend to be localized, and the isocyanurate structures tend to be localized. Thus, conduction levels are formed among the electron transporting structures and among the isocyanurate structures, thereby making the conduction level in the undercoat layer uneven. Because the conduction level is uneven, charge traps are generated and residual charges readily accumulate in the undercoat layer during long-term repeated use.

As described above, it is believed that the positive ghosting resulting from long-term repeated use can be suppressed when the electron transporting structure is bonded to the isocyanurate structure via a group having 5 to 15 main-chain atoms represented by formula (D).

The undercoat layer may contain 30 mass % or more and 70 mass % or less of the structure represented by (1) relative to the total mass of the undercoat layer.

The content of the structure represented by formula (1) in the undercoat layer can be analyzed through a common analytical technique. An example of the analytical technique is as follows. The content of the structure represented by formula (1) in the undercoat layer is determined by a KBr tablet method by using a Fourier transform infrared (FT-IR) spectroscope. Samples that contain various amounts of tris(2-hydroxyethyl) cyanurate relative to KBr powder are used to form calibration lines based on the absorptions attributable to the isocyanurate structure and then the content of the structure represented by formula (1) in the undercoat layer can be calculated based on the calibration lines.

The structure represented by formula (1) can be confirmed by conducting measurement on the undercoat layer. Examples of the measurement method include solid-state $^{13}$C-NMR spectroscopy, mass spectrometry, pyrolysis-gas chromatography (GS)-mass spectrometry(MS), and infrared absorption spectrometry. For example, solid-state $^{13}$C-NMR spectroscopy may be conducted by using CMX-300 Infinity produced by Chemagnetics under the following conditions: nucleus observed: $^{13}$C, reference substance: polydimethylsiloxane, number of transients: 8192, pulse sequence: cross polarization (CP)/magic angle spinning (MAS) and dipolar decoupled (DD)/MAS, pulse width: 2.1 μsec (DD/MAS) and 4.2 μsec (CP/MAS), contact time: 2.0 msec, sample rotation rate: 10 kHz. Mass spectrometry may be conducted by using a mass spectrometer (MALDI-TOF MS, ultraflex produced by Bruker Daltonics) at an acceleration voltage of 20 kV on a reflector mode by using fullerene $C_{60}$ as the molecular weight standard to determine the molecular weight. The molecular weight was confirmed based on the peak top values observed.

The undercoat layer may contain, in addition to the structure represented by formula (1) above, various resins, a crosslinking agent, a leveling agent, metal oxide particles, etc., to improve the film forming property and the electrophotographic properties. However, the contents of such additives are preferably less than 50 mass % and more preferably less than 20 mass % relative to the total mass of the undercoat layer. The thickness of the undercoat layer may be 0.1 μm or more and 5.0 μm or less.

Specific examples of the structure represented by formula (1) are given below. These examples do not limit the scope of the present invention.

The right side of $E^1$ in formula (1) represents a hydrogen atom, a substituted or unsubstituted aryl group, an alkyl group, or a bonding portion. One of the carbon atoms in the main chain of the substituted or unsubstituted alkyl group may be replaced with O, S, NH, or $NR^{15}$ with $R^{15}$ representing an alkyl group. Examples of the substituent of the substituted aryl group include an alkyl group, a halogen atom, a nitro group, and a cyano group. Examples of the substituent of the substituted alkyl group include an alkyl group, an aryl group, a halogen atom, a nitro group, and a cyano group. In the case of the bonding portion, the portion is bonded to $D^1$ of the structure represented by formula (1) but excluding $E^1$ via a substituted or unsubstituted arylene group or an alkylene group. Examples of the substituent of the substituted arylene group include an alkyl group, a halogen atom, and a nitro group. Moreover, l, m, n, o, p, and q are each 0 or 1.

In the tables, $B^1$ represents a group represented by any one of formulae (B-1) to (B-3) below:

(B-1)

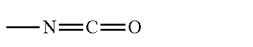

(B-2)

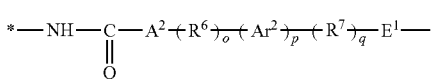

(B-3)

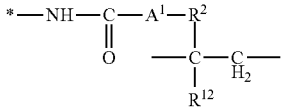

The right side of $E^1$ in formula (B-2) represents a hydrogen atom, a substituted or unsubstituted aryl group, an alkyl group, a heterocyclic group, or a bonding portion. Examples of the substituent of the substituted aryl group include an alkyl group, a halogen atom, and a nitro group. In the case of the bonding portion, the portion is bonded to $D^1$ of the structure represented by the above formula (1) but excluding $E^1$ via a substituted or unsubstituted arylene group or an alkylene group. In formula (B-3), the lower side of $R^2$ indicates that it is bonded to a side chain of a resin in the undercoat layer.

In Tables 1 to 14 below, a bonding portion is indicated by a broken line. When a single bond is represented, "Sng" is indicated in the cell of the tables. The left-right arrangement of formula (1) is the same as that of the structures shown in Tables 1 to 14. In Example Compounds described in Tables 1 to 14, $R^9$ in formula (1) is a hydrogen atom in all cases.

TABLE 1

| | $D^1$ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 101 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 102 | $—C_6H_{12}—$ | 1 | Sng | 0 | Sng | 0 | $—C(=O)—O—$ | $—C(H_2)—CH(C_2H_5)—$ | 1 | Sng | 0 | Sng | 0 | $—C_6H_{12}—$ | (B-2) | —O— | Sng | $—C_6H_{12}—$ |
| 103 | $—C_6H_{12}—$ | 1 | Sng | 0 | Sng | 0 | —N(H)— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 104 | $—C_6H_{12}—$ | 1 | Sng | 0 | Sng | 0 | —S— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 105 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 106 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 107 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 108 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 109 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 110 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-2) | —O— | Sng | $—C_6H_{12}—$ |
| 111 | $—C_6H_{12}—$ | 1 | Sng | 0 | Sng | 0 | —O— | $—CH(CH_3)—$ | 1 | 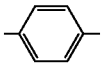 | 1 | Sng | 0 | $—C_6H_{12}—$ | (B-2) | —O— | Sng | $—C_6H_{12}—$ |
| 112 | $—C_6H_{12}—$ | 1 | Sng | 0 | Sng | 0 | —O— | $—CH(CH_3)—$ | 1 | 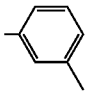 | 1 | Sng | 0 | $—C_6H_{12}—$ | (B-2) | —O— | Sng | $—C_6H_{12}—$ |
| 113 | $—C_6H_{12}—$ | 1 | Sng | 0 | Sng | 0 | —O— | $—C(H_2)—C(H_2)—$ | 1 | 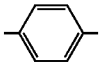 | 1 | Sng | 0 | $—C_6H_{12}—$ | (B-2) | —O— | Sng | $—C_6H_{12}—$ |
| 114 | $—CH_2—$ | 1 | Sng | 0 | Sng | 0 | —O— | $—CH(CH_3)—$ | 1 | 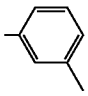 | 1 | Sng | 0 | $—CH_2—$ | (B-2) | —O— | Sng | $—CH_2—$ |
| 115 | $—CH_2—$ | 1 | Sng | 0 | Sng | 0 | —O— | $—C(H_2)—CH(C_2H_5)—$ | 1 | Sng | 0 | Sng | 0 | $—CH_2—$ | (B-2) | —O— | Sng | $—CH_2—$ |

*: Example Structure

TABLE 2

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 116 | —$CH_2$— | 1 | Sng | 0 | Sng | 0 | —O— | —$CH_2$— | 1 | Sng | 0 | Sng | 0 | —$CH_2$— | (B-2) | —O— | Sng | —$CH_2$— |
| 117 | —$C_6H_{12}$— | 1 | Sng | 0 | Sng | 0 | —O— | —CH($CH_3$)— | 1 | 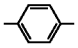 | 1 | Sng | 0 | —$C_6H_{12}$— | (B-1) | —O— | Sng | —$C_6H_{12}$— |
| 118 | —$C_6H_{12}$— | 1 | Sng | 0 | Sng | 0 | —O— | —CH($CH_3$)— | 1 | 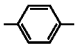 | 1 | Sng | 0 | —$C_6H_{12}$— | (B-3) | —O— | Sng | —$C_6H_{12}$— |
| 119 | —$C_6H_{12}$— | 1 | Sng | 0 | Sng | 0 | —O— | —CH($CH_3$)— | 1 | 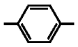 | 1 | Sng | 0 | —$C_6H_{12}$— | (B-3) | —O— | 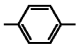 | —$C_6H_{12}$— |
| 120 | —$C_6H_{12}$— | 1 | Sng | 0 | Sng | 0 | —O— | —CH($CH_3$)— | 1 | 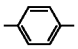 | 1 | Sng | 0 | —$C_6H_{12}$— | (B-3) | —N(H)— | Sng | —$C_6H_{12}$— |
| 121 | —$C_6H_{12}$— | 1 | Sng | 0 | Sng | 0 | —O— | —$CH_2$—CH($C_2H_5$)— | 1 | Sng | 0 | Sng | 0 | —$C_6H_{12}$— | (B-1) | —O— | Sng | —$C_6H_{12}$— |
| 122 | —$C_6H_{12}$— | 1 | Sng | 0 | Sng | 0 | —O— | —$CH_2$—CH($C_2H_5$)— | 1 | Sng | 0 | Sng | 0 | —$C_6H_{12}$— | (B-2) | —O— | Sng | —$C_6H_{12}$— |
| 123 | —$C_6H_{12}$— | 1 | Sng | 0 | Sng | 0 | —O— | —$CH_2$—CH($C_2H_5$)— | 1 | Sng | 0 | Sng | 0 | —$C_6H_{12}$— | (B-3) | —O— | Sng | —$C_6H_{12}$— |
| 124 | —$C_6H_{12}$— | 1 | Sng | 0 | Sng | 0 | —O— | —$CH_2$—CH($C_2H_5$)— | 1 | Sng | 0 | Sng | 0 | —$C_6H_{12}$— | (B-2) | —O— | Sng | —$C_6H_{12}$— |
| 125 | —$C_6H_{12}$— | 1 | Sng | 0 | Sng | 0 | —O— | —CH($CH_3$)— | 1 | 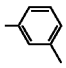 | 1 | Sng | 0 | —$C_6H_{12}$— | (B-2) | —O— | Sng | —$C_6H_{12}$— |
| 126 | —$C_6H_{12}$— | 1 | Sng | 0 | Sng | 0 | —O— | Sng | 0 | 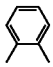 | 1 | Sng | 0 | —$C_6H_{12}$— | (B-2) | —O— | Sng | —$C_6H_{12}$— |
| 127 | —$C_6H_{12}$— | 1 | Sng | 0 | Sng | 0 | —O— | Sng | 0 | 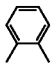 | 1 | Sng | 0 | —$C_6H_{12}$— | (B-2) | —O— | Sng | —$C_6H_{12}$— |
| 128 | Sng | 0 | 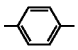 | 1 | Sng | 0 | —O— | —CH($CH_3$)— | 1 | 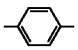 | 1 | Sng | 0 | —$C_6H_{12}$— | (B-2) | —O— | Sng | —$C_6H_{12}$— |
| 129 | Sng | 0 | 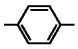 | 1 | Sng | 0 | —O— | —$CH_2$—CH($C_2H_5$)— | 1 | Sng | 0 | Sng | 0 | —$C_6H_{12}$— | (B-2) | —O— | Sng | —$C_6H_{12}$— |
| 130 | Sng | 0 | 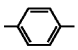 | 1 | Sng | 0 | —O— | —$CH_2$—CH($C_2H_5$)— | 1 | Sng | 0 | Sng | 0 | —$C_6H_{12}$— | (B-1) | —N(H)— | Sng | —$C_6H_{12}$— |
| 131 | Sng | 0 | 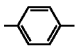 | 1 | Sng | 0 | —O— | —$CH_2$—C(H)($C_2H_5$)— | 1 | Sng | 0 | Sng | 0 | —$C_6H_{12}$— | (B-2) | —N(H)— | Sng | —$C_6H_{12}$— |
| 132 | Sng | 0 | 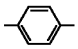 | 1 | Sng | 0 | —O— | —C(H)($CH_3$)—$CH_2$—N(H)—$C_2H_5$— | 1 | Sng | 0 | Sng | 0 | —$C_6H_{12}$— | (B-2) | —N(H)— | Sng | —$C_6H_{12}$— |
| 133 | Sng | 0 | 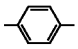 | 1 | Sng | 0 | —O— | —$CH_2$—C(H)— 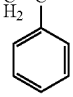 | 1 | Sng | 0 | Sng | 0 | —$C_6H_{12}$— | (B-2) | —N(H)— | Sng | —$C_6H_{12}$— |

*: Example Structure

TABLE 3

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 151 | $—C_6H_{12}—$ | 1 | Sng | 0 | Sng | 0 | 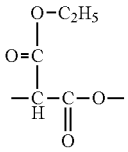 | 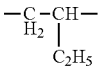 | 1 | Sng | 0 | Sng | 0 | $—C_6H_{12}—$ | (B-2) | —O— | Sng | $—C_6H_{12}—$ |
| 152 | $—C_6H_{12}—$ | 1 | Sng | 0 | Sng | 0 | 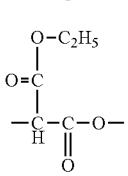 | 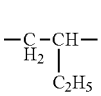 | 1 | Sng | 0 | Sng | 0 | $—C_6H_{12}—$ | (B-2) | —O— | Sng | $—C_6H_{12}—$ |
| 153 | $—C_6H_{12}—$ | 1 | Sng | 0 | Sng | 0 | 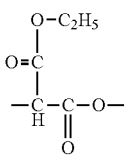 | $—CH_2—$ | 1 | 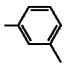 | 1 | Sng | 0 | $—C_6H_{12}—$ | (B-2) | —O— | Sng | $—C_6H_{12}—$ |
| 154 | $—C_6H_{12}—$ | 1 | Sng | 0 | Sng | 0 | 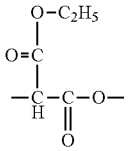 | $—CH_2—$ | 1 | Sng | 0 | Sng | 0 | $—C_6H_{12}—$ | (B-2) | —O— | Sng | $—C_6H_{12}—$ |
| 155 | $—C_6H_{12}—$ | 1 | Sng | 0 | Sng | 0 | 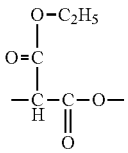 | Sng | 0 | 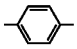 | 1 | Sng | 0 | $—C_6H_{12}—$ | (B-2) | —O— | Sng | $—C_6H_{12}—$ |
| 156 | $—C_6H_{12}—$ | 1 | Sng | 0 | Sng | 0 | 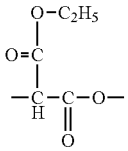 | $—CH_2—$ | 1 | 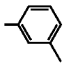 | 1 | Sng | 0 | $—C_6H_{12}—$ | (B-2) | —O— | Sng | $—C_6H_{12}—$ |
| 1107 | $—C_6H_{12}—$ | 1 | Sng | 0 | Sng | 0 | —O— | $—CH_2—CH_2—$ | 1 | Sng | 0 | Sng | 0 | $—C_6H_{12}—$ | (B-2) | —O— | Sng | $—C_6H_{12}—$ |
| 1108 | $—C_6H_{12}—$ | 1 | Sng | 0 | Sng | 0 | —O— | Sng | 0 | 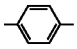 | 1 | Sng | 0 | $—C_6H_{12}—$ | (B-2) | —O— | Sng | $—C_6H_{12}—$ |
| 1109 | $—C_6H_{12}—$ | 1 | Sng | 0 | Sng | 0 | —O— | $—CH_2—$ | 1 | 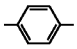 | 1 | Sng | 0 | $—C_6H_{12}—$ | (B-2) | —O— | Sng | $—C_6H_{12}—$ |
| 1110 | $—C_6H_{12}—$ | 1 | Sng | 0 | Sng | 0 | —NH— | Sng | 0 | 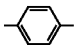 | 1 | Sng | 0 | $—C_6H_{12}—$ | (B-2) | —O— | Sng | $—C_6H_{12}—$ |

*: Example Structure

TABLE 4

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 201 | $—C_6H_{12}—$ | 1 | Sng | 0 | Sng | 0 | —O— | $—CH_2—CH_2—$ | 1 | 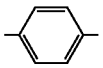 | 1 | Sng | 0 | $—C_6H_{12}—$ | (B-2) | —O— | Sng | $—C_6H_{12}—$ |

TABLE 4-continued

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 202 | —$C_6H_{12}$— | 1 | Sng | 0 | Sng | 0 | —O— | —C($H_2$)—C($H_2$)— | 1 | 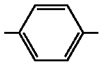 | 1 | Sng | 0 | —$C_6H_{12}$— | (B-2) | —O— | Sng | —$C_6H_{12}$— |
| 203 | —$C_6H_{12}$— | 1 | Sng | 0 | Sng | 0 | —O— | —C($H_2$)—C($H_2$)— | 1 | 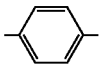 | 1 | Sng | 0 | —$C_6H_{12}$— | (B-2) | —O— | Sng | —$C_6H_{12}$— |
| 204 | —$C_6H_{12}$— | 1 | Sng | 0 | Sng | 0 | —O— | —C($H_2$)—C($H_2$)— | 1 | 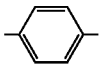 | 1 | Sng | 0 | —$C_6H_{12}$— | (B-2) | —O— | Sng | —$C_6H_{12}$— |
| 205 | —$C_6H_{12}$— | 1 | Sng | 0 | Sng | 0 | —O— | —C($H_2$)—C($H_2$)— | 1 | 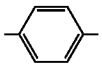 | 1 | Sng | 0 | —$C_6H_{12}$— | (B-2) | —O— | Sng | —$C_6H_{12}$— |
| 206 | —$C_6H_{12}$— | 1 | Sng | 0 | Sng | 0 | —O— | —C($H_2$)—C($H_2$)— | 1 | 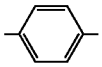 | 1 | Sng | 0 | —$C_6H_{12}$— | (B-2) | —O— | Sng | —$C_6H_{12}$— |
| 207 | —$C_6H_{12}$— | 1 | Sng | 0 | Sng | 0 | —N(H)— | —C($H_2$)—C($H_2$)— | 1 | 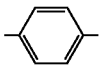 | 1 | Sng | 0 | —$C_6H_{12}$— | (B-2) | —O— | Sng | —$C_6H_{12}$— |
| 208 | —$C_6H_{12}$— | 1 | Sng | 0 | Sng | 0 | —S— | —C($H_2$)—C($H_2$)— | 1 | 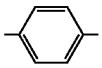 | 1 | Sng | 0 | —$C_6H_{12}$— | (B-2) | —O— | Sng | —$C_6H_{12}$— |
| 209 | —$C_6H_{12}$— | 1 | Sng | 0 | Sng | 0 | —O— | —C($H_2$)—CH($C_2H_5$)— | 1 | Sng | 0 | Sng | 0 | —$C_6H_{12}$— | (B-2) | —O— | Sng | —$C_6H_{12}$— |
| 210 | —$C_6H_{12}$— | 1 | Sng | 0 | Sng | 0 | —O— | Sng | 0 | 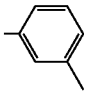 | 1 | Sng | 0 | —$C_6H_{12}$— | (B-2) | —O— | Sng | —$C_6H_{12}$— |
| 211 | —$C_6H_{12}$— | 1 | Sng | 0 | Sng | 0 | —O— | —$C_2H_5$—O—$C_2H_5$— | 1 | Sng | 0 | Sng | 0 | —$C_6H_{12}$— | (B-2) | —O— | Sng | —$C_6H_{12}$— |
| 212 | —$C_6H_{12}$— | 1 | Sng | 0 | Sng | 0 | —O— | —$CH_2$— | 1 | 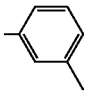 | 1 | Sng | 0 | —$C_6H_{12}$— | (B-2) | —O— | Sng | —$C_6H_{12}$— |
| 301 | —$C_6H_{12}$— | 1 | Sng | 0 | Sng | 0 | —O— | Sng | 0 | 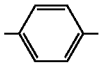 | 1 | Sng | 0 | —$C_6H_{12}$— | (B-2) | —O— | Sng | —$C_6H_{12}$— |
| 302 | —$C_6H_{12}$— | 1 | Sng | 0 | Sng | 0 | —O— | Sng | 0 | 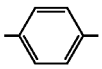 | 1 | Sng | 0 | —$C_6H_{12}$— | (B-2) | —O— | Sng | —$C_6H_{12}$— |
| 303 | —$C_6H_{12}$— | 1 | Sng | 0 | Sng | 0 | —O— | Sng | 0 | 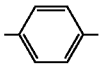 | 1 | Sng | 0 | —$C_6H_{12}$— | (B-2) | —O— | Sng | —$C_6H_{12}$— |
| 401 | —$C_6H_{12}$— | 1 | Sng | 0 | Sng | 0 | —O— | Sng | 0 | 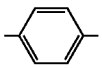 | 1 | Sng | 0 | —$C_6H_{12}$— | (B-2) | —O— | Sng | —$C_6H_{12}$— |
| 501 | —$C_6H_{12}$— | 1 | Sng | 0 | Sng | 0 | —O— | Sng | 0 | 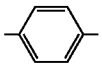 | 1 | Sng | 0 | —$C_6H_{12}$— | (B-2) | —O— | Sng | —$C_6H_{12}$— |
| 601 | —$C_6H_{12}$— | 1 | Sng | 0 | Sng | 0 | —O— | Sng | 0 | 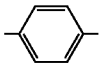 | 1 | Sng | 0 | —$C_6H_{12}$— | (B-2) | —O— | Sng | —$C_6H_{12}$— |
| 701 | —$C_6H_{12}$— | 1 | Sng | 0 | Sng | 0 | —O— | Sng | 0 | 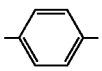 | 1 | Sng | 0 | —$C_6H_{12}$— | (B-2) | —O— | Sng | —$C_6H_{12}$— |

TABLE 4-continued

| | D1 | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 702 | —$C_6H_{12}$— | 1 | Sng | 0 | Sng | 0 | —O— | Sng | 0 | 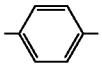 | 1 | Sng | 0 | —$C_6H_{12}$— | (B-2) | —O— | Sng | —$C_6H_{12}$— |
| 703 | —$C_6H_{12}$— | 1 | Sng | 0 | Sng | 0 | —O— | Sng | 0 | 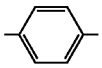 | 1 | Sng | 0 | —$C_6H_{12}$— | (B-2) | —O— | Sng | —$C_6H_{12}$— |
| 704 | —$C_6H_{12}$— | 1 | Sng | 0 | Sng | 0 | —O— | Sng | 0 | 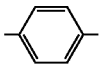 | 1 | Sng | 0 | —$C_6H_{12}$— | (B-2) | —O— | Sng | —$C_6H_{12}$— |

*: Example Structure

TABLE 5

| | D1 | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 801 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 802 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 803 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 804 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 805 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 901 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 902 | —$C_6H_{12}$— | 1 | Sng | 0 | Sng | 0 | —O— | —$C_{H_2}$—$C_{H_2}$— | 1 | 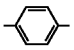 | 1 | Sng | 0 | —$C_6H_{12}$— | (B-2) | —O— | Sng | —$C_6H_{12}$— |
| 1001 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 1002 | —$C_6H_{12}$— | 1 | Sng | 0 | Sng | 0 | —O— | —$C_{H_2}$—$C_{H_2}$— | 1 | 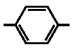 | 1 | Sng | 0 | —$C_6H_{12}$— | (B-2) | —O— | Sng | —$C_6H_{12}$— |
| 1101 | —$C_6H_{12}$— | 1 | Sng | 0 | Sng | 0 | —O— | —$CH_2$— | 1 | Sng | 0 | Sng | 0 | —$C_6H_{12}$— | (B-2) | —O— | Sng | —$C_6H_{12}$— |
| 1102 | —$CH_2$— | 1 | Sng | 0 | Sng | 0 | —O— | —$CH_2$— | 1 | Sng | 0 | Sng | 0 | —$C_6H_{12}$— | (B-2) | —O— | Sng | —$C_6H_{12}$— |
| 1103 | Sng | 0 | 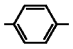 | 1 | Sng | 0 | —O— | —$CH_2$— | 1 | Sng | 0 | Sng | 0 | —$C_6H_{12}$— | (B-2) | —O— | Sng | 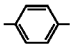 |
| 1104 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 1105 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 1106 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |

*: Example Structure

TABLE 6

| | D1 | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 1201 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |
| 1301 | —$C_6H_{12}$— | 1 | Sng | 0 | Sng | 0 | —O— | —$C_{H_2}$—$C_{H_2}$— | 1 | Sng | 0 | Sng | 0 | —$C_6H_{12}$— | (B-2) | —O— | Sng | —$C_6H_{12}$— |

TABLE 6-continued

| | D¹ | | | | | | | | | | | | | | | | |
|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 1401 | —$C_6H_{12}$— | 1 | Sng | 0 | Sng | 0 | —O— | Sng | 0 | 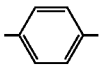 | 1 | Sng | 0 | —$C_6H_{12}$— | (B-2) | —O— | Sng | —$C_6H_{12}$— |
| 1402 | —$C_6H_{12}$— | 1 | Sng | 0 | Sng | 0 | —O— | Sng | 0 | 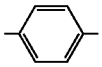 | 1 | Sng | 0 | —$C_6H_{12}$— | (B-2) | —O— | Sng | —$C_6H_{12}$— |
| 1403 | —$C_6H_{12}$— | 1 | Sng | 0 | Sng | 0 | —O— | Sng | 0 | 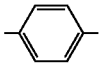 | 1 | Sng | 0 | —$C_6H_{12}$— | (B-2) | —O— | Sng | —$C_6H_{12}$— |
| 1501 | —$C_6H_{12}$— | 1 | Sng | 0 | Sng | 0 | —O— | Sng | 0 | 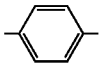 | 1 | Sng | 0 | —$C_6H_{12}$— | (B-2) | —O— | Sng | —$C_6H_{12}$— |
| 1502 | —$C_6H_{12}$— | 1 | Sng | 0 | Sng | 0 | —O— | Sng | 0 | 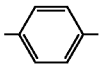 | 1 | Sng | 0 | —$C_6H_{12}$— | (B-2) | —O— | Sng | —$C_6H_{12}$— |
| 1503 | —$C_6H_{12}$— | 1 | Sng | 0 | Sng | 0 | —O— | Sng | 0 | 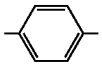 | 1 | Sng | 0 | —$C_6H_{12}$— | (B-2) | —O— | Sng | —$C_6H_{12}$— |
| 1601 | —$C_6H_{12}$— | 1 | Sng | 0 | Sng | 0 | —O— | Sng | 0 | 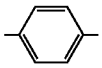 | 1 | Sng | 0 | —$C_6H_{12}$— | (B-2) | —O— | Sng | —$C_6H_{12}$— |
| 1602 | —$C_6H_{12}$— | 1 | Sng | 0 | Sng | 0 | —O— | Sng | 0 | 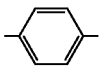 | 1 | Sng | 0 | —$C_6H_{12}$— | (B-2) | —O— | Sng | —$C_6H_{12}$— |
| 1603 | —$C_6H_{12}$— | 1 | Sng | 0 | Sng | 0 | —O— | Sng | 0 | 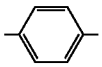 | 1 | Sng | 0 | —$C_6H_{12}$— | (B-2) | —O— | Sng | —$C_6H_{12}$— |
| 1701 | —$C_6H_{12}$— | 1 | Sng | 0 | Sng | 0 | —O— | Sng | 0 | 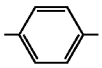 | 1 | Sng | 0 | —$C_6H_{12}$— | (B-2) | —O— | Sng | —$C_6H_{12}$— |
| 1702 | —$C_6H_{12}$— | 1 | Sng | 0 | Sng | 0 | —O— | Sng | 0 | 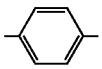 | 1 | Sng | 0 | —$C_6H_{12}$— | (B-2) | —O— | Sng | —$C_6H_{12}$— |
| 1703 | —$C_6H_{12}$— | 1 | Sng | 0 | Sng | 0 | —O— | Sng | 0 | 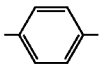 | 1 | Sng | 0 | —$C_6H_{12}$— | (B-2) | —O— | Sng | —$C_6H_{12}$— |
| 1901 | —$C_6H_{12}$— | 1 | Sng | 0 | Sng | 0 | —O— | —$CH_2$— | 1 | 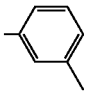 | 1 | Sng | 0 | —$C_6H_{12}$— | (B-2) | —O— | Sng | —$C_6H_{12}$— |

*: Example Structure

TABLE 7

| | D¹ | | | | | | | | | | | | | | | | |
|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 2001 | —$C_6H_{12}$— | 1 | Sng | 0 | Sng | 0 | —O— | 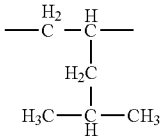 | 1 | Sng | 0 | Sng | 0 | —$C_6H_{12}$— | (B-3) | —O— | Sng | —$C_6H_{12}$— |
| 2002 | —$C_6H_{12}$— | 1 | Sng | 0 | Sng | 0 | —O— | —$C_2H_4$—S—$C_2H_4$— | 1 | Sng | 0 | Sng | 0 | —$C_6H_{12}$— | (B-3) | —O— | Sng | —$C_6H_{12}$— |
| 2003 | —$C_6H_{12}$— | 1 | Sng | 0 | Sng | 0 | —O— | —$C_2H_4$—O—$C_2H_4$— | 1 | Sng | 0 | Sng | 0 | —$C_6H_{12}$— | (B-3) | —O— | Sng | —$C_6H_{12}$— |
| 2004 | —$C_6H_{12}$— | 1 | Sng | 0 | Sng | 0 | —O— | —$C_2H_4$—S—$C_2H_4$— | 1 | Sng | 0 | Sng | 0 | —$C_6H_{12}$— | (B-3) | —O— | Sng | —$C_6H_{12}$— |

TABLE 7-continued

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 2005 | $—C_6H_{12}—$ | 1 | Sng | 0 | Sng | 0 | —O— | $—C_2H_4—C(H_2)—C_2H_4—$ | 1 | Sng | 0 | Sng | 0 | $—C_6H_{12}—$ | (B-3) | —O— | Sng | $—C_6H_{12}—$ |
| 2006 | $—C_6H_{12}—$ | 1 | Sng | 0 | Sng | 0 | —O— | $—C(H_2)—CH(C_2H_5)—$ | 1 | Sng | 0 | Sng | 0 | $—C_6H_{12}—$ | (B-3) | —O— | Sng | $—C_6H_{12}—$ |
| 2007 | $—C_6H_{12}—$ | 1 | Sng | 0 | Sng | 0 | —O— | $—C(H_2)—C(H)(H_2C—C(H)(CH_3)—CH_3)—$ | 1 | Sng | 0 | Sng | 0 | $—C_6H_{12}—$ | (B-3) | —O— | Sng | $—C_6H_{12}—$ |

*: Example Structure

TABLE 8

| | D¹ | | | | | | | | | | | | | | | | | |
|---|---|---|---|---|---|---|---|---|---|---|---|---|---|---|---|---|---|---|
| * | $R^4$ | l | $Ar^1$ | m | $R^5$ | n | $A^2$ | $R^6$ | o | $Ar^2$ | p | $R^7$ | q | $R^3$ | $B^1$ | $A^1$ | $R^2$ | $R^1$ |
| 2008 | $—C_6H_{12}—$ | 1 | Sng | 0 | Sng | 0 | —O— | $—C(H_2)—C(H)(C_2H_5—C(H)(CH_3)—CH_3)—$ | 1 | Sng | 0 | Sng | 0 | $—C_6H_{12}—$ | (B-3) | —O— | Sng | $—C_6H_{12}—$ |
| 2009 | $—C_6H_{12}—$ | 1 | Sng | 0 | Sng | 0 | —O— | $—C(H_2)—C(H)(H_3C—O—C(=O)—)—$ | 1 | Sng | 0 | Sng | 0 | $—C_6H_{12}—$ | (B-3) | —O— | Sng | $—C_6H_{12}—$ |
| 2010 | $—C_6H_{12}—$ | 1 | Sng | 0 | Sng | 0 | —O— | $—C(H_2)—C(H)(H_3C—C(H)(CH_3)—)—$ | 1 | Sng | 0 | Sng | 0 | $—C_6H_{12}—$ | (B-3) | —O— | Sng | $—C_6H_{12}—$ |
| 2011 | $—C_6H_{12}—$ | 1 | Sng | 0 | Sng | 0 | —O— | $—C_2H_4—N(H)—C(H_2)—C_2H_4—$ | 1 | Sng | 0 | Sng | 0 | $—C_6H_{12}—$ | (B-3) | —O— | Sng | $—C_6H_{12}—$ |
| 2012 | $—C_6H_{12}—$ | 1 | Sng | 0 | Sng | 0 | —O— | $—C_2H_4—S—C_2H_4—$ | 1 | Sng | 0 | Sng | 0 | $—C_6H_{12}—$ | (B-3) | —O— | Sng | $—C_6H_{12}—$ |
| 2013 | $—C_6H_{12}—$ | 1 | Sng | 0 | Sng | 0 | —C(=O)—O— | $—C(H_2)—C(H)(H_2C—C(H)(CH_3)—)—$ | 1 | Sng | 0 | Sng | 0 | $—C_6H_{12}—$ | (B-3) | —O— | Sng | $—C_6H_{12}—$ |
| 2014 | $—C_6H_{12}—$ | 1 | Sng | 0 | Sng | 0 | —O— | $—C(H_2)—C(H)(H_2C—C(H)(CH_3)—)—$ | 1 | Sng | 0 | Sng | 0 | $—C_6H_{12}—$ | (B-3) | —O— | Sng | $—C_6H_{12}—$ |
| 2015 | $—C_6H_{12}—$ | 1 | Sng | 0 | Sng | 0 | —O— | $—C(H_2)—C(H)(H_2C—C(H)(CH_3)—)—$ | 1 | Sng | 0 | Sng | 0 | $—C_6H_{12}—$ | (B-3) | —O— | Sng | $—C_6H_{12}—$ |

*: Example Structure

TABLE 9
| Example Structure | $E^1$ |
|---|---|
| 101 | 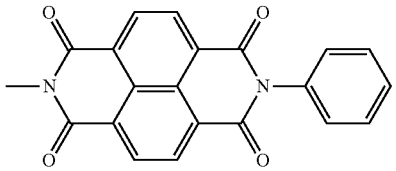 |
| 102 | 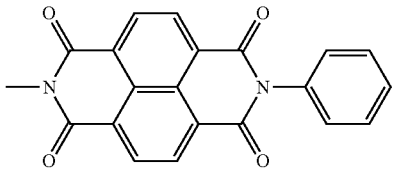 |
| 103 | 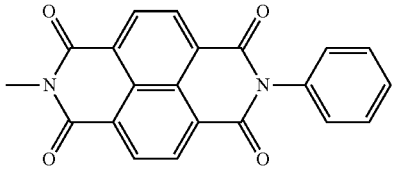 |
| 104 | 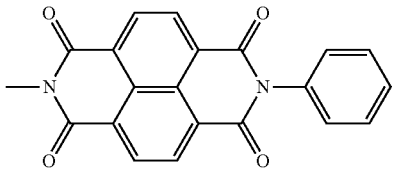 |
| 105 | 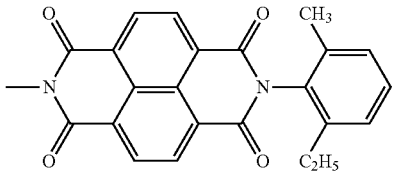 |
| 106 | 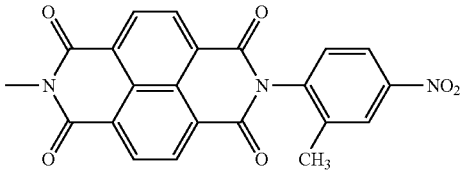 |
| 107 | 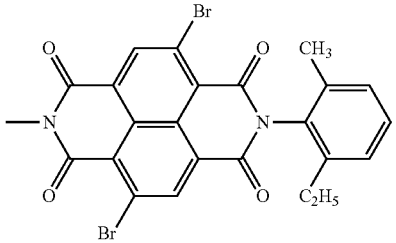 |
TABLE 9-continued
| Example Structure | $E^1$ |
|---|---|
| 108 | 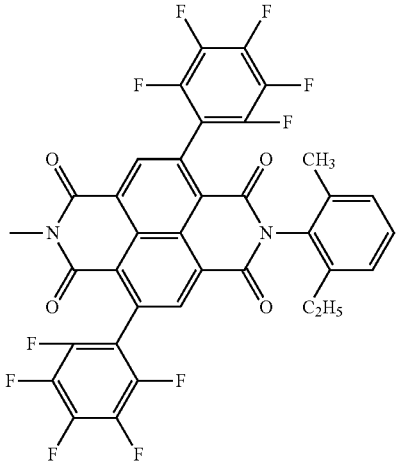 |
| 109 | 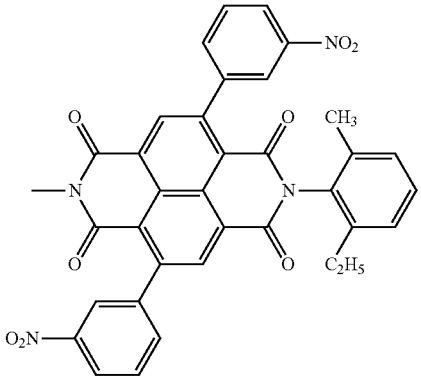 |
| 110 | 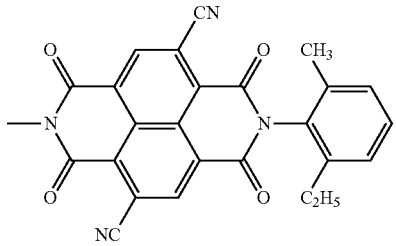 |
| 111 | 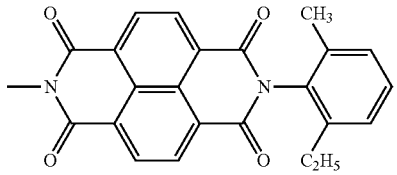 |
| 112 | 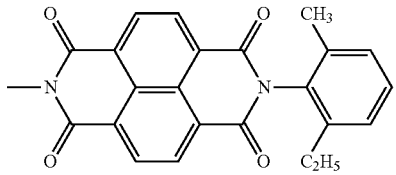 |

TABLE 9-continued
| Example Structure | $E^1$ |
|---|---|
| 113 | 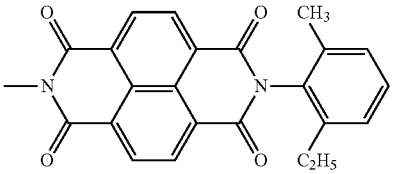 |
| 114 | 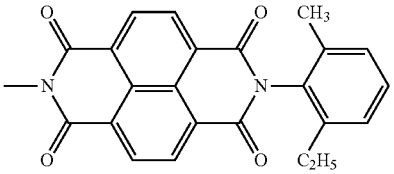 |
| 115 | 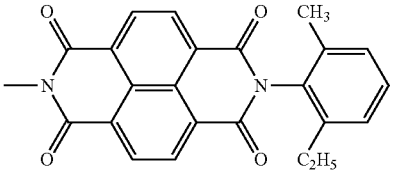 |
| 116 | 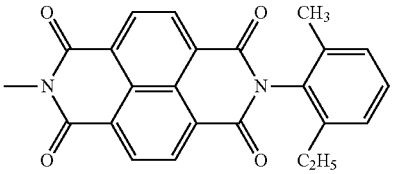 |
| 117 | 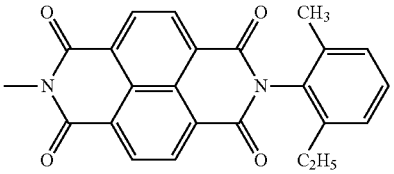 |
| 118 | 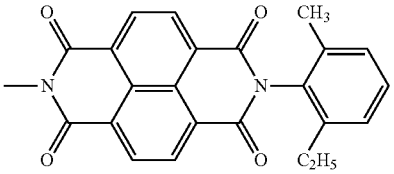 |
| 119 | 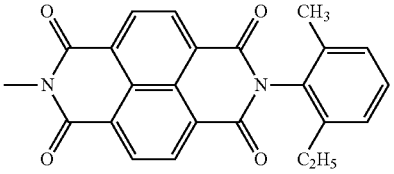 |
| 120 | 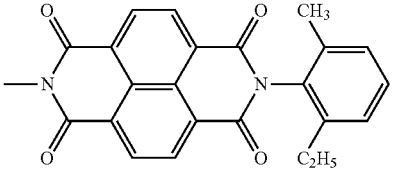 |
TABLE 9-continued
| Example Structure | $E^1$ |
|---|---|
| 121 | 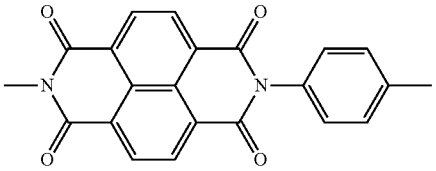 |
| 122 | 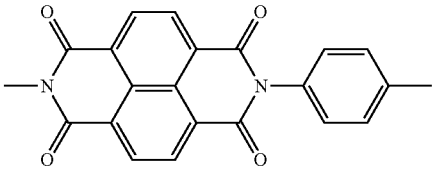 |
| 123 | 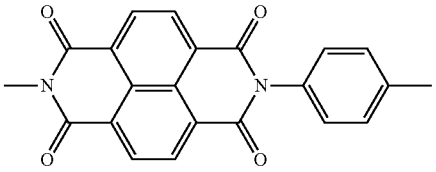 |
| 124 | 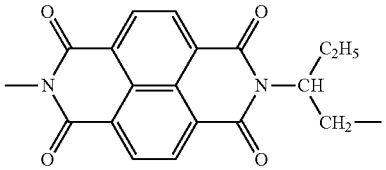 |
| 125 | 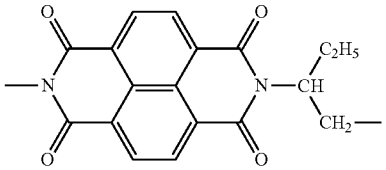 |
| 126 | 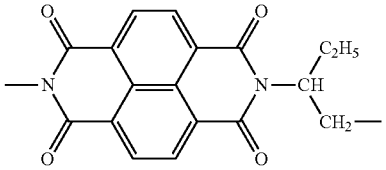 |
| 127 | 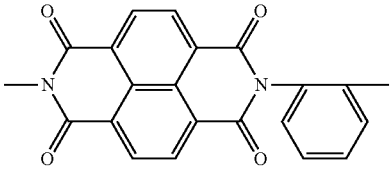 |
| 128 | 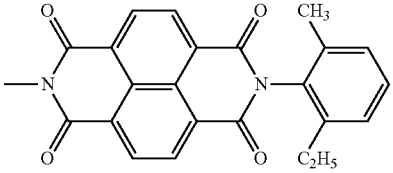 |

TABLE 9-continued
| Example Structure | $E^1$ |
|---|---|
| 129 | 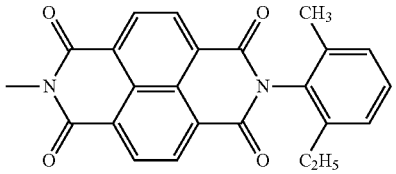 |
| 130 | 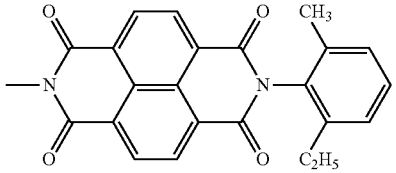 |
| 131 | 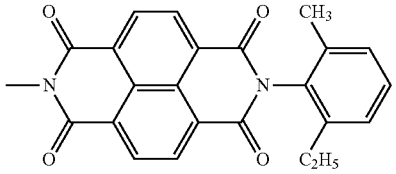 |
| 132 | 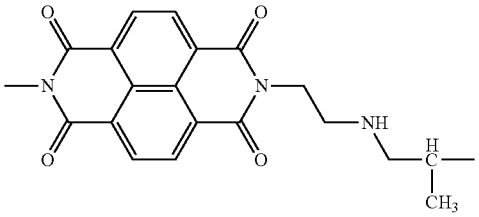 |
| 133 | 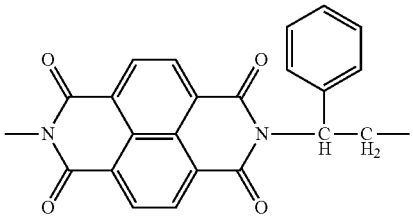 |
TABLE 10
| Example Structure | $E^1$ |
|---|---|
| 151 | 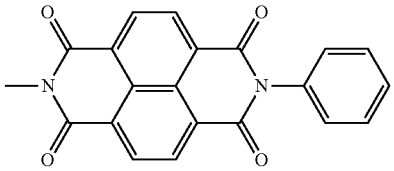 |
| 152 | 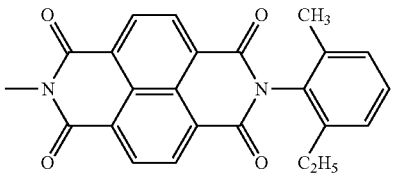 |
TABLE 10-continued
| Example Structure | $E^1$ |
|---|---|
| 153 | 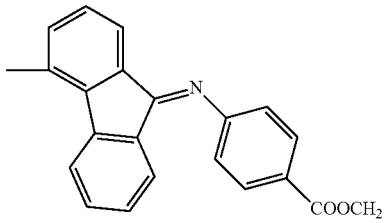 |
| 154 | 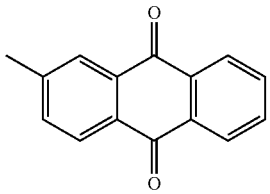 |
| 155 | 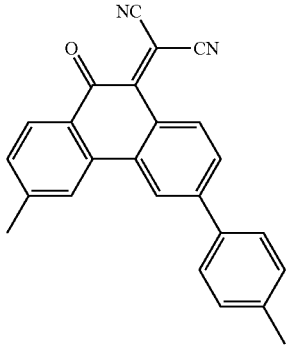 |
| 156 | 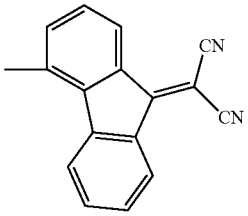 |
| 1107 | 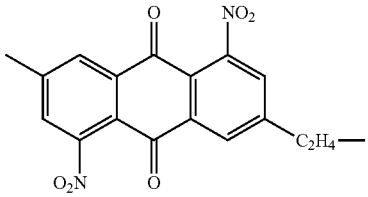 |
| 1108 | 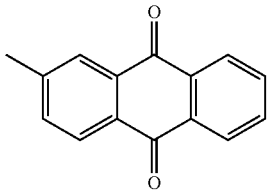 |

TABLE 10-continued
| Example Structure | $E^1$ |
|---|---|
| 1109 | 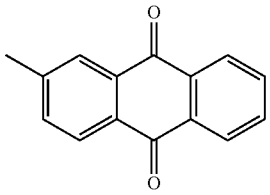 |
| 1110 | 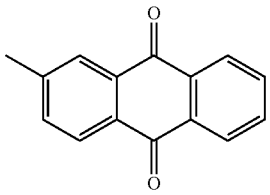 |
TABLE 11
| Example Structure | $E^1$ |
|---|---|
| 201 | 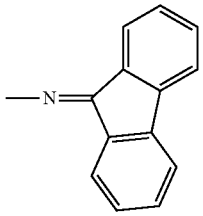 |
| 202 | 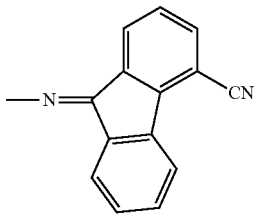 |
| 203 | 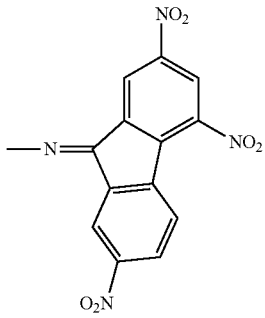 |
TABLE 11-continued
| Example Structure | $E^1$ |
|---|---|
| 204 | 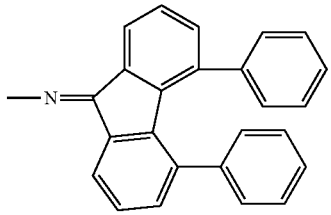 |
| 205 | 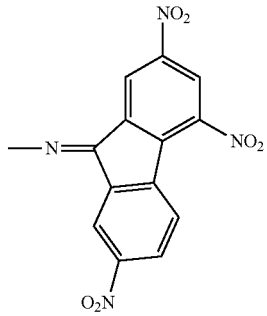 |
| 206 | 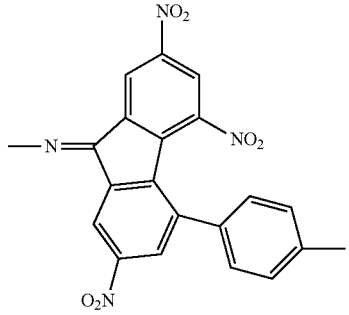 |
| 207 | 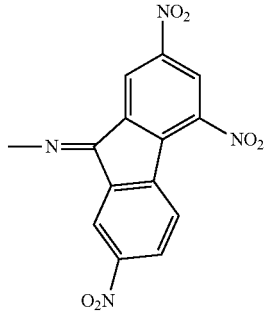 |
| 208 | 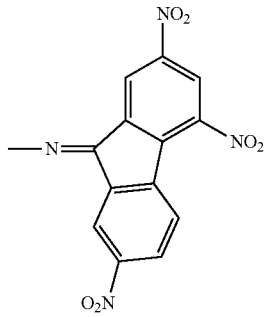 |

TABLE 11-continued
| Example Structure | $E^1$ |
|---|---|
| 209 | 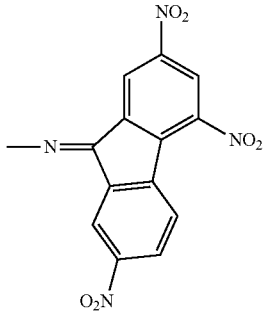 |
| 210 | 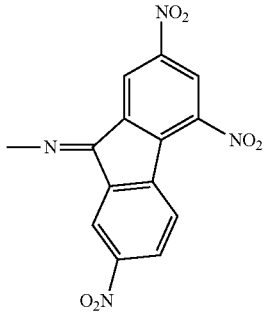 |
| 211 | 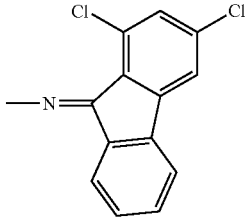 |
| 212 | 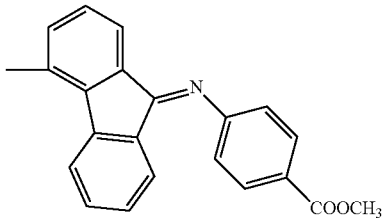 |
| 301 | 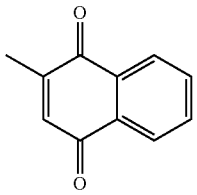 |
| 302 | 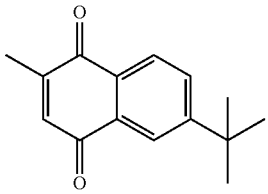 |
TABLE 11-continued
| Example Structure | $E^1$ |
|---|---|
| 303 | 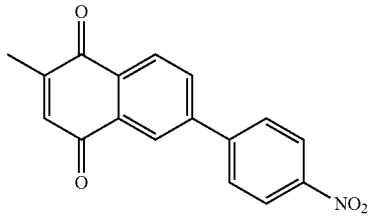 |
| 401 | 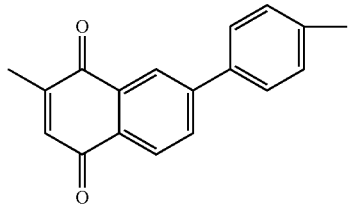 |
| 501 | 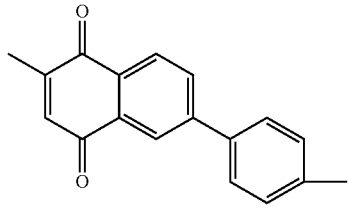 |
| 601 | 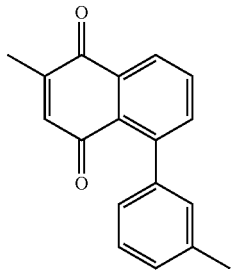 |
| 701 | 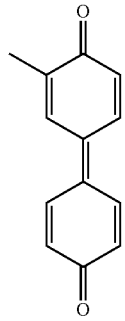 |

TABLE 11-continued
| Example Structure | $E^1$ |
|---|---|
| 702 | 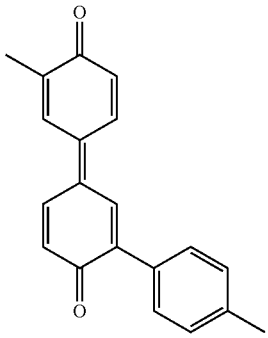 |
| 703 | 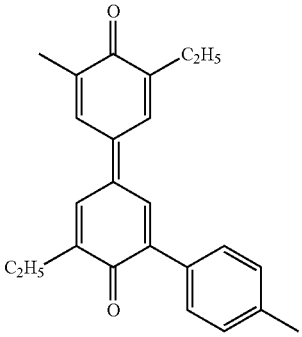 |
| 704 | 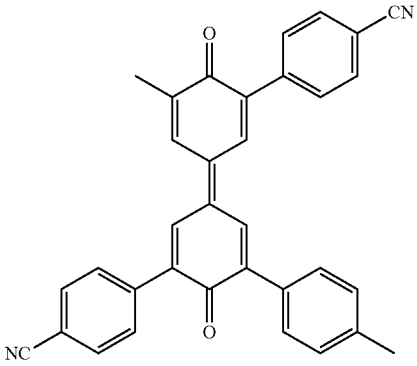 |
TABLE 12
| Example Structure | $E^1$ |
|---|---|
| 801 | 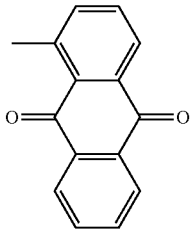 |
TABLE 12-continued
| Example Structure | $E^1$ |
|---|---|
| 802 | 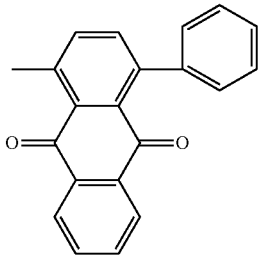 |
| 803 | 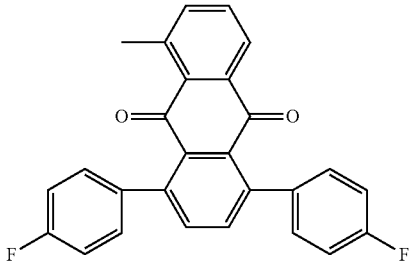 |
| 804 | 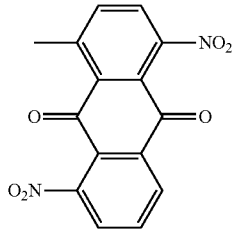 |
| 805 | 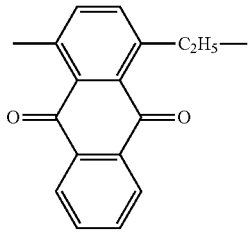 |
| 901 | 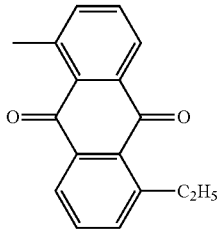 |
| 902 | 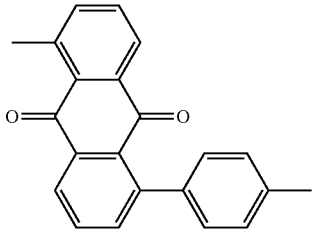 |

TABLE 12-continued
| Example Structure | $E^1$ |
|---|---|
| 1001 | 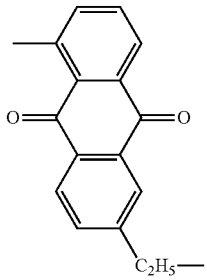 |
| 1002 | 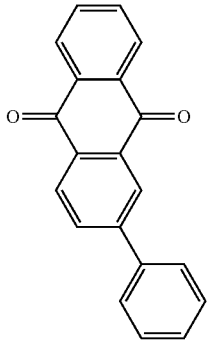 |
| 1101 | 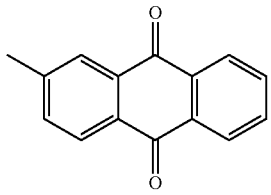 |
| 1102 | 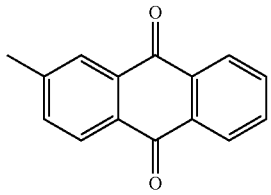 |
| 1103 | 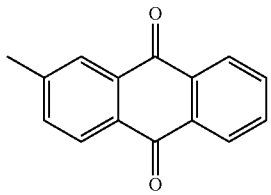 |
| 1104 | 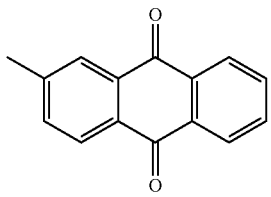 |
TABLE 12-continued
| Example Structure | $E^1$ |
|---|---|
| 1105 | 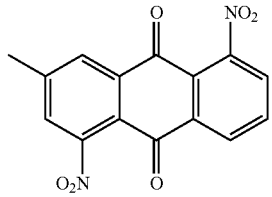 |
| 1106 | 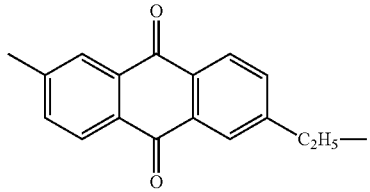 |
| 1201 | 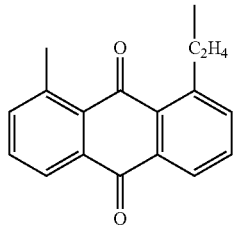 |
| 1301 | 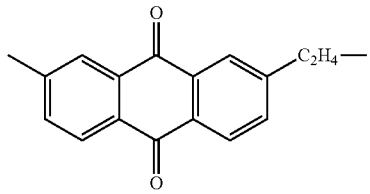 |
| 1401 | 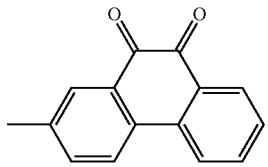 |
| 1402 | 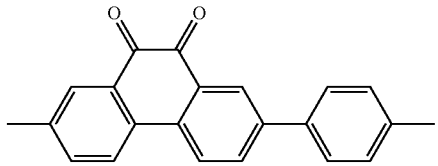 |
| 1403 | 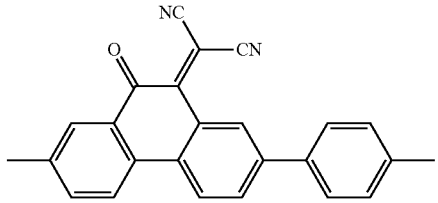 |

TABLE 12-continued
| Example Structure | $E^1$ |
|---|---|
| 1501 | 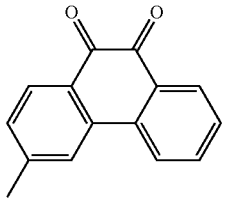 |
| 1502 | 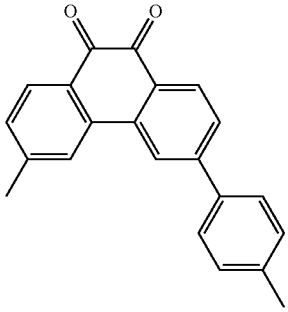 |
| 1503 | 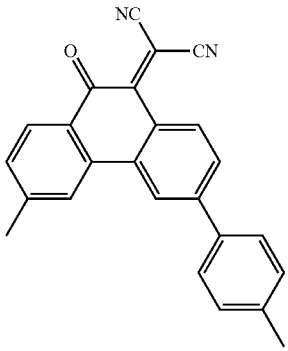 |
TABLE 13
| Example Structure | $E^1$ |
|---|---|
| 1601 | 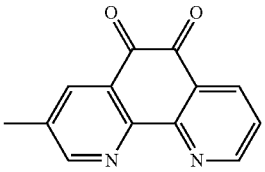 |
| 1602 | 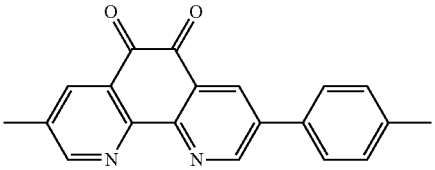 |
TABLE 13-continued
| Example Structure | $E^1$ |
|---|---|
| 1603 | 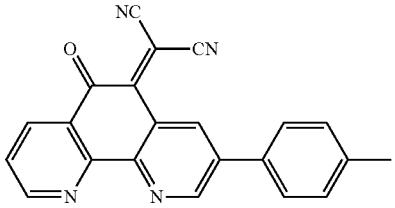 |
| 1701 | 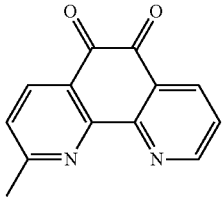 |
| 1702 | 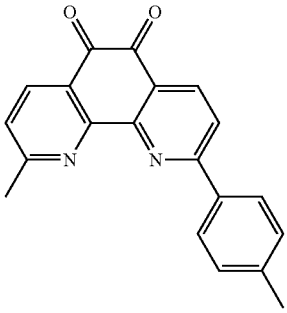 |
| 1703 | 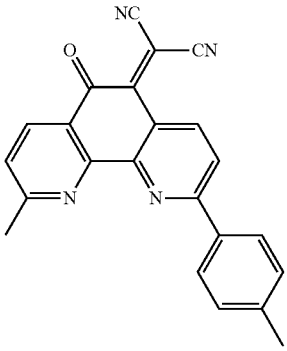 |
| 1901 | 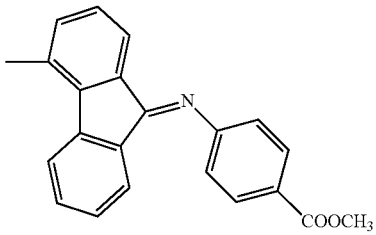 |

TABLE 14

| Example Structure | $E^1$ |
|---|---|
| 2001 | 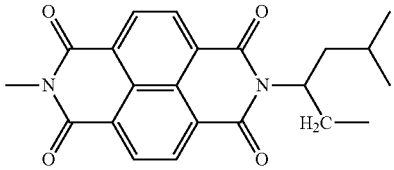 |
| 2002 | 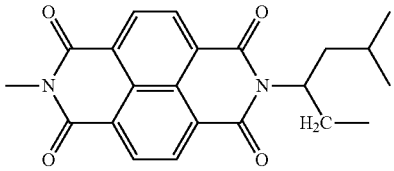 |
| 2003 | 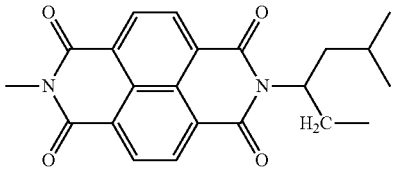 |
| 2004 | 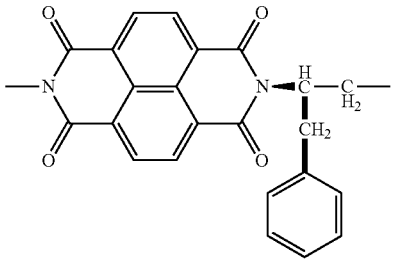 |
| 2005 | 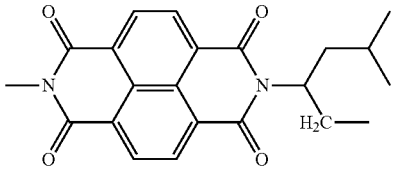 |
| 2006 | 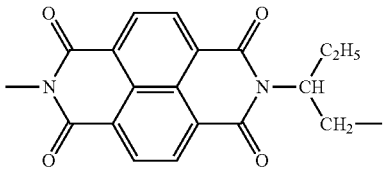 |
| 2007 | 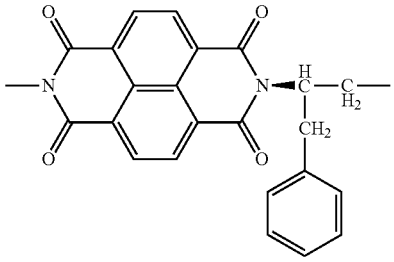 |

TABLE 14-continued

| Example Structure | $E^1$ |
|---|---|
| 2008 | 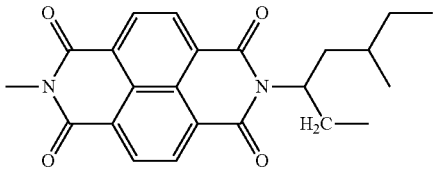 |
| 2009 | 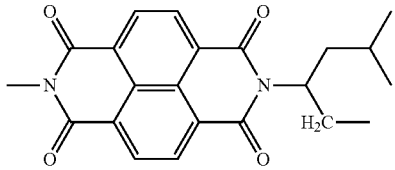 |
| 2010 | 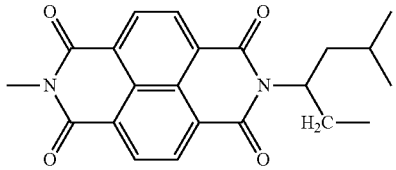 |
| 2011 | 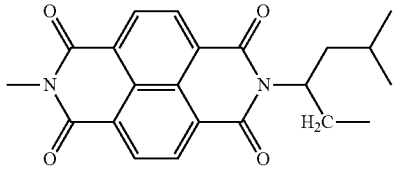 |
| 2012 | 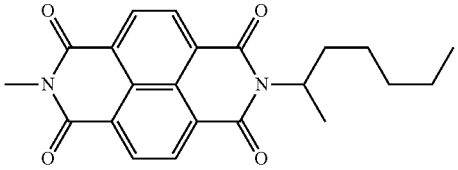 |
| 2013 | 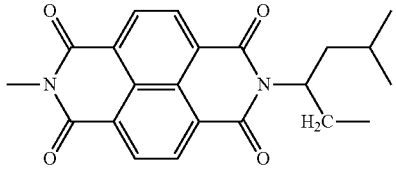 |
| 2014 | 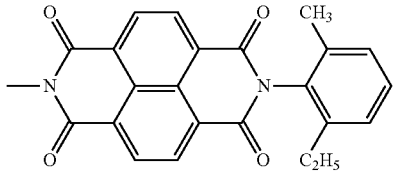 |
| 2015 | 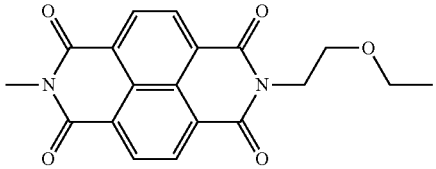 |

In order to form an undercoat layer having the structure represented by formula (1), a coating solution for an undercoat layer is prepared by dissolving, in a solvent, an isocyanate compound (crosslinking agent), a resin having a polymerizable functional group reactive with the isocyanate group in the isocyanate compound, and an electron transporting substance having a polymerizable functional group reactive to the isocyanate group in the isocyanate compound, and is applied to form a film, and the film is thermally cured. Thermal curing may be conducted during drying of the film since homogeneous reaction can be achieved.

The isocyanate compound has an isocyanurate structure. The isocyanate group of the isocyanate compound may be blocked with a blocking agent such as an oxime (blocked isocyanate compound). A blocked isocyanate compound starts addition reaction when heated together with the resin and the electron transporting substance and the blocking agent detaches to promote crosslinking reactions. As a result, an undercoat layer composed of a cured product having a structure represented by formula (1) is obtained.

Examples of the blocking agent include active methylene-based compounds such as ethyl acetate and acetylacetone, mercaptan-based compounds such as butyl mercaptan and dodecyl mercaptan, acid amide-based compounds such as acetanilide and acetamide, lactam-based compounds such as ϵ-caprolactam, δ-valerolactam, and γ-butyrolactam, acid imide-based compounds such as succinimide and maleimide, imidazole-based compounds such as imidazole and 2-methylimidazole, urea-based compound such as urea, thiourea, and ethylene urea, oxime-based compounds such as formamide oxime, acetaldoxime, acetone oxime, methyl ethyl ketoxime, methyl isobutyl ketoxime, and cyclohexanone oxime, and amine-based compounds such as diphenylaniline, aniline, carbazole, ethylene imine, and polyethylene imine. These blocking agents can be used alone or in combination.

Among these blocking agents, oxime-based compounds such as methyl ethyl ketoxime, lactam-based compounds such as ϵ-caprolactam, and imidazole-based compounds such as 2-methylimidazole are preferred from the viewpoints of wide applicability, production ease, workability, and thermal cure temperature.

Examples of the isocyanate compound are as follows:

(I-1)

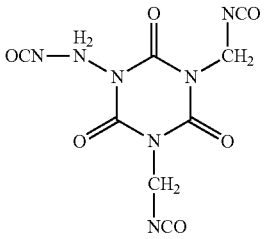

(I-2)

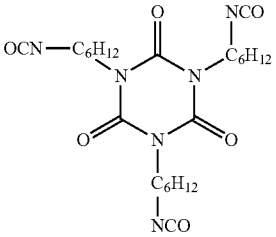

-continued (I-3)

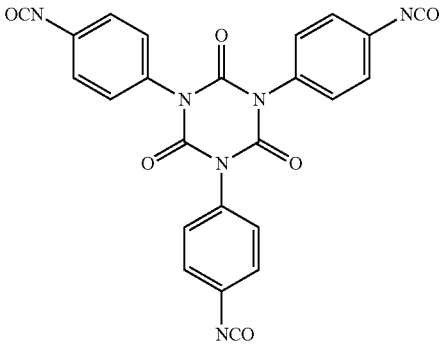

(I-4)

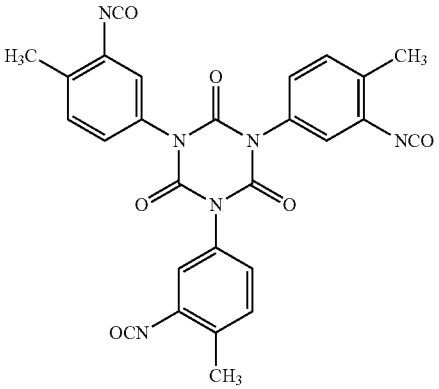

(I-5)

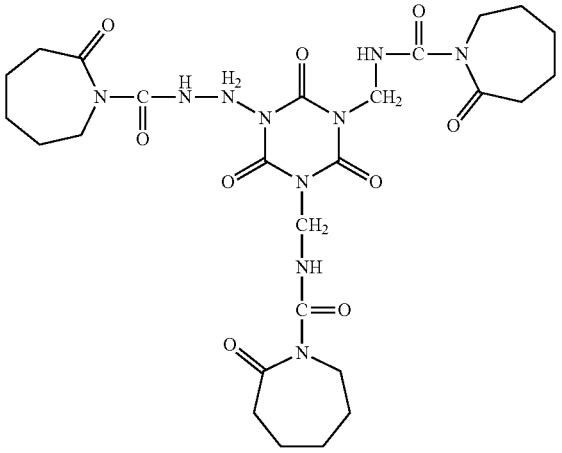

(I-6)

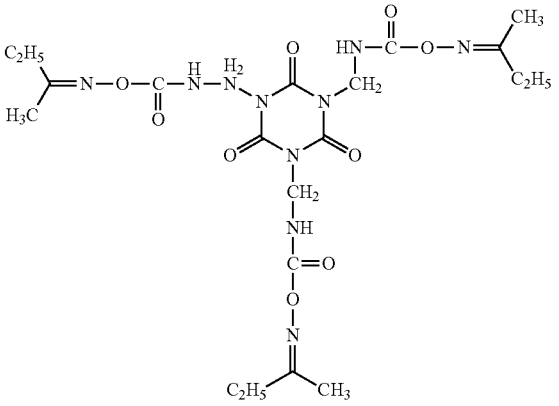

-continued
(I-7)
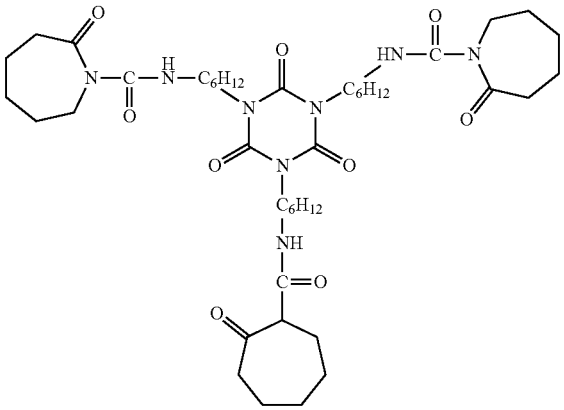
(I-8)
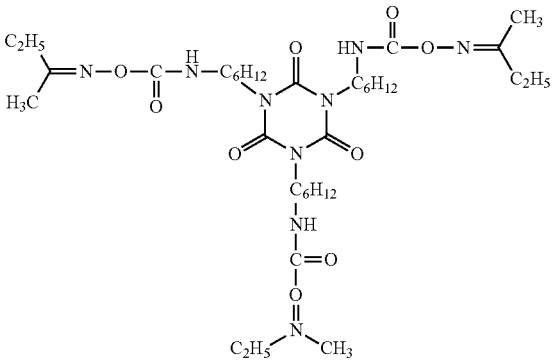
(I-9)
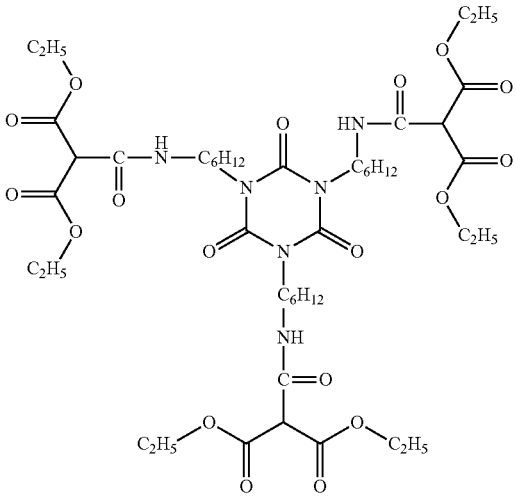
-continued
(I-10)
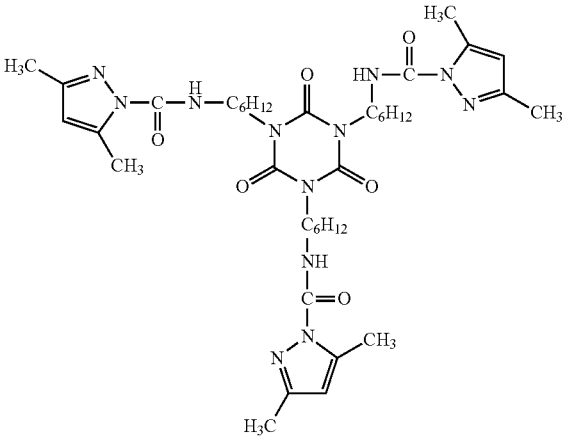
(I-11)
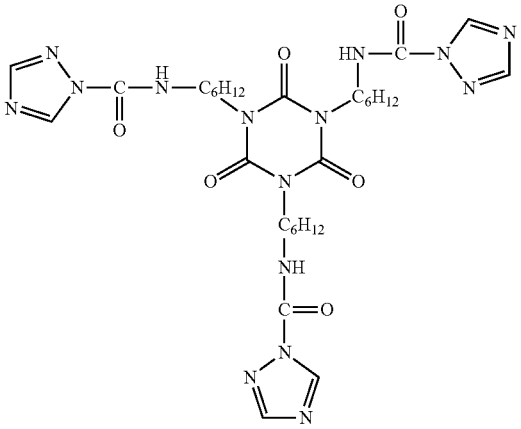
(I-12)
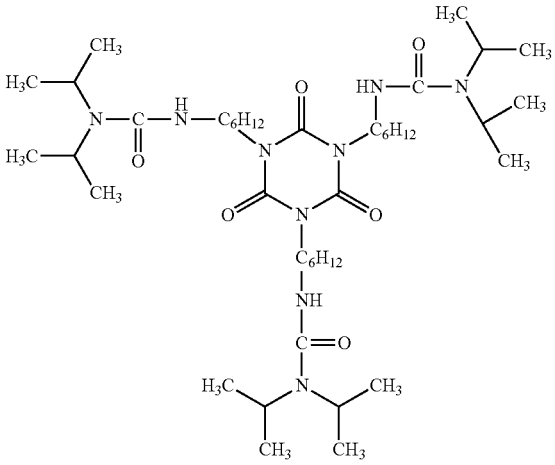

-continued (I-13)

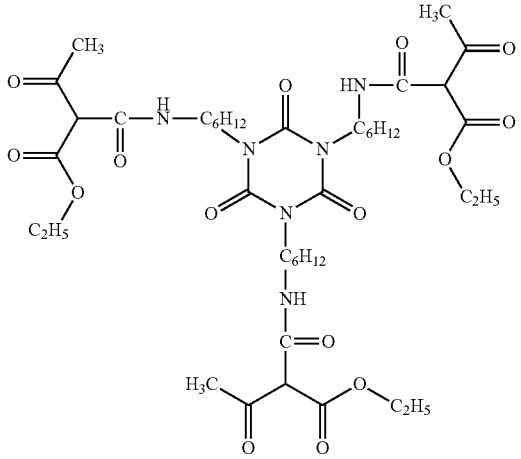

The number of isocyanate groups in the isocyanate compound may be such that the ratio (I/H) of the number (number of moles=I) of the isocyanate groups to the sum (number of moles=H) of the numbers of the polymerizable functional groups in the resin and the polymerizable functional groups in the electron transporting substance is 0.5 or more and 2.5 or less. When the molar ratio I/H is 0.5 or more and 2.5 or less, the reaction efficiency of the isocyanate groups and the polymerizable functional groups is high and the crosslinking density is increased.

The polymerizable functional groups of the resin are preferably any one or combination of a hydroxy group, a carboxyl group, an amide group, and a thiol group. More preferably, the polymerizable groups are hydroxy groups or amide groups that efficiently react with isocyanate groups. In other words, the resin may be a polyol, polyvinyl phenol, or polyamide resin having two or more hydroxy groups or amide groups. The weight-average molecular weight (Mw) of the resin used in an embodiment of the present invention may be in the range of 5,000 to 1,500,000.

The cured product having a structure represented by formula (1) above may further include a structure represented by formula (2) below. In other words, the resin preferably has a structure represented by formula (2) below. When a structure represented by formula (2) is included, adhesion between the undercoat layer and an upper layer or a lower layer adjacent thereto is improved and the thickness of the undercoat layer becomes more even. Thus, positive ghosting and potential fluctuation are suppressed despite long-term repeated use.

(2)

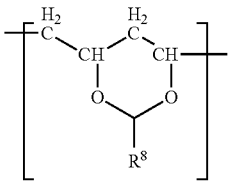

In formula (2), $R^8$ represents substituted or unsubstituted alkyl group having 1 to 5 carbon atoms. The substituent of the substituted alkyl is an alkyl group, an aryl group, or a halogen atom.

In the polymer having a structure represented by formula (1), $R^4$, $R^5$, $R^6$, and $R^2$ in $D^2$ may each independently represent an alkylene group having 1 to 5 main-chain atoms and being substituted with a methyl group or an ethyl group or an alkylene group having 1 to 5 main-chain atoms from the viewpoint of reducing initial positive ghosting.

In the polymer having a structure represented by formula (1), $Ar^1$ and $Ar^2$ in $D^1$ may each independently represent an unsubstituted phenylene group from the viewpoint of suppressing initial positive ghosting.

Examples of the electron transporting substance that has the polymerizable functional groups are as follows:

(E-1-1)

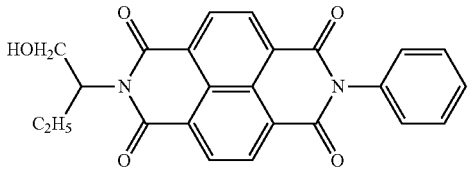

(E-1-2)

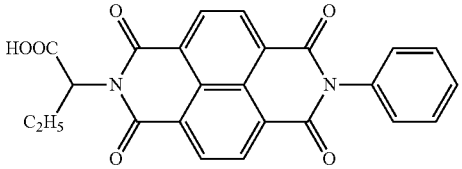

(E-1-3)

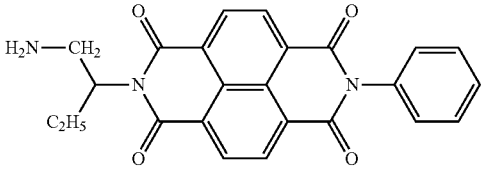

(E-1-4)

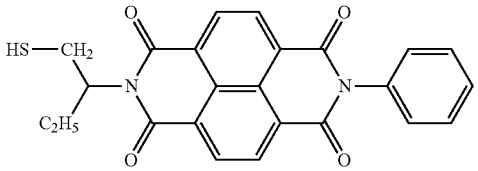

(E-1-5)

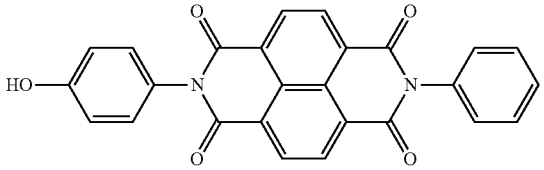

(E-1-6)

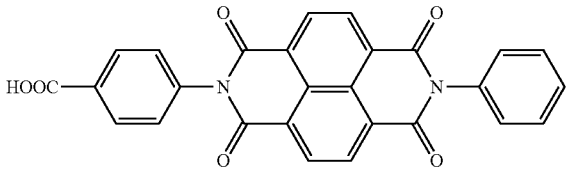

(E-1-7)

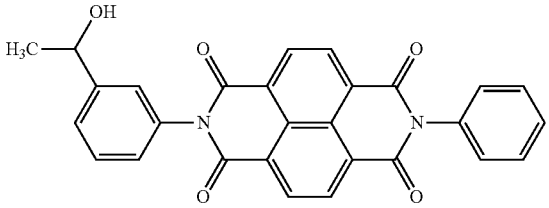

-continued
(E-1-8)
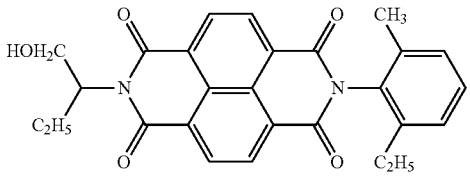
(E-1-9)
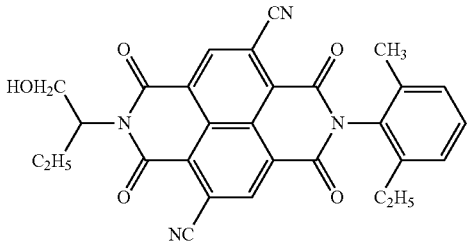
(E-1-10)
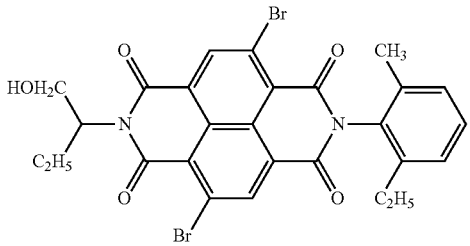
(E-1-11)
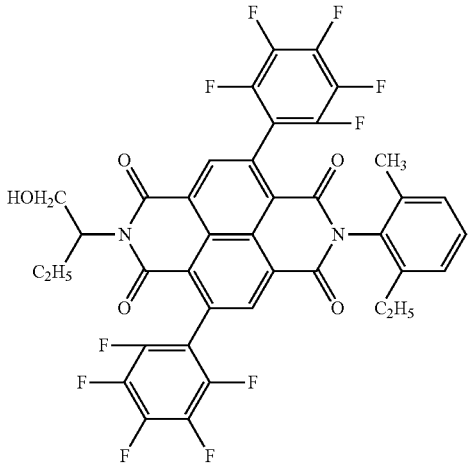
(E-1-12)
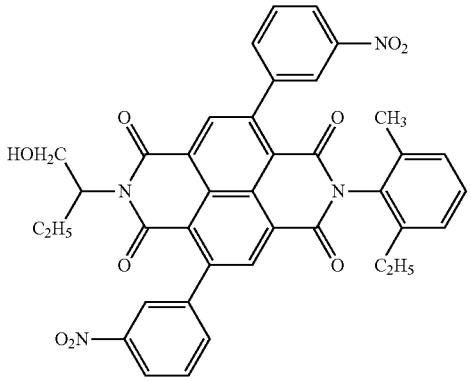
-continued
(E-1-13)
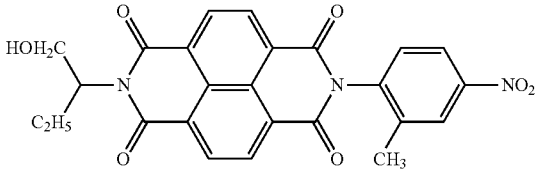
(E-1-14)
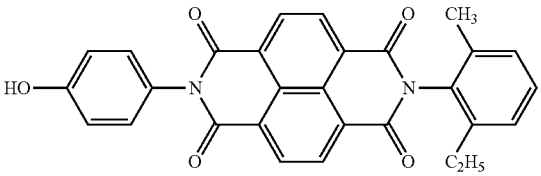
(E-1-15)
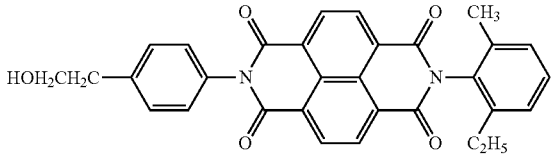
(E-1-16)
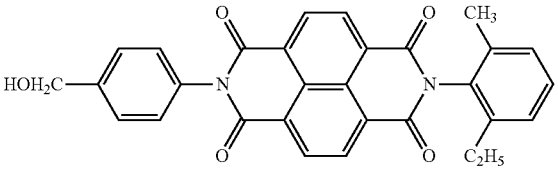
(E-1-17)
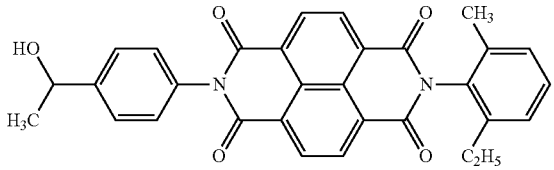
(E-1-18)
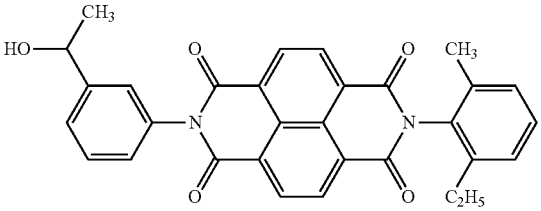
(E-1-19)
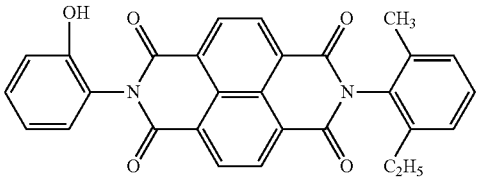
(E-1-20)
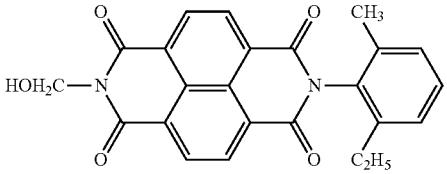

-continued
(E-1-21)
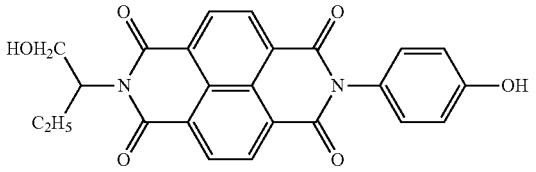
(E-1-22)
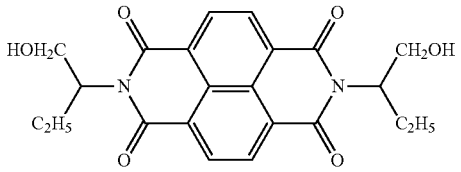
(E-1-23)
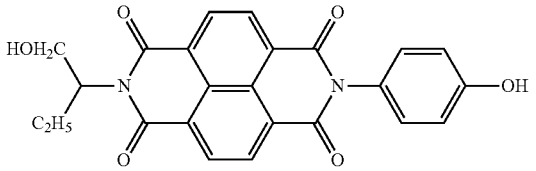
(E-1-24)
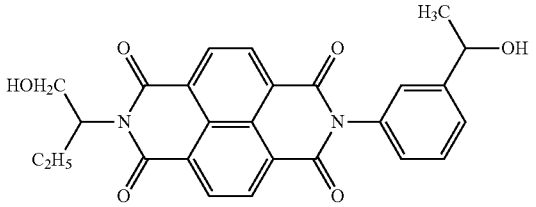
(E-1-25)
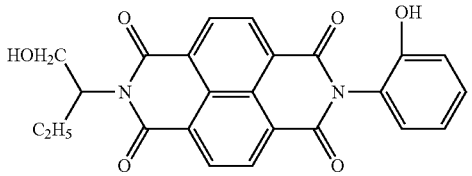
(E-1-26)
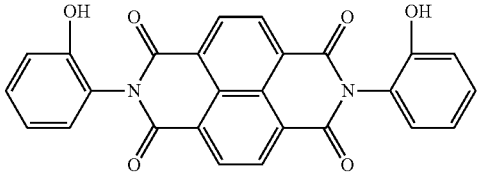
(E-1-27)
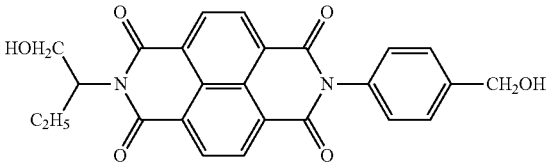
(E-1-28)
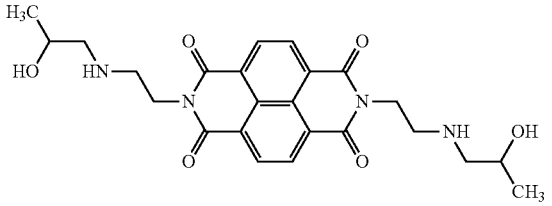
-continued
(E-1-29)
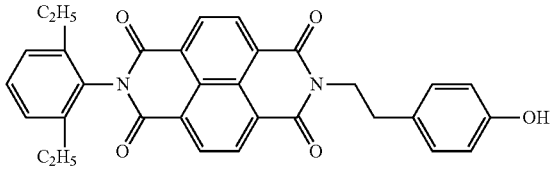
(E-1-30)
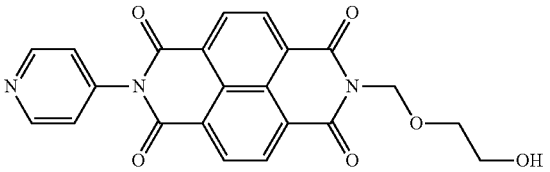
(E-1-31)
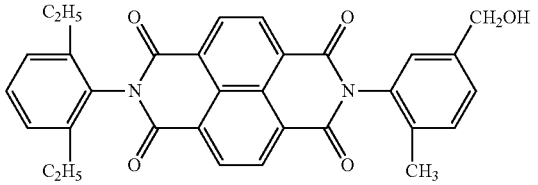
(E-1-32)
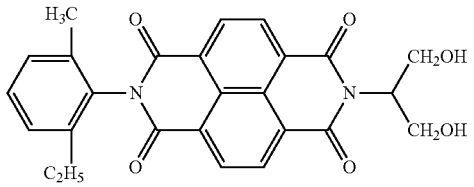
(E-1-33)
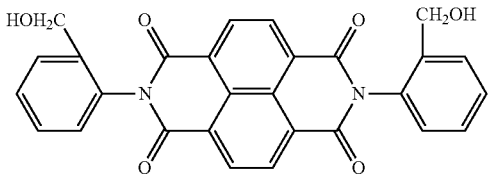
(E-1-34)
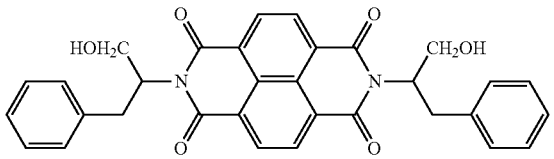
(E-1-35)
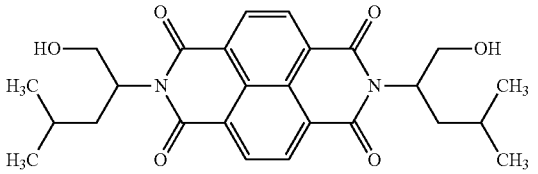
(E-1-36)
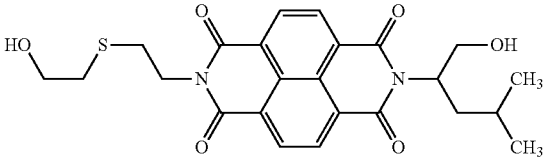

-continued
(E-1-37)
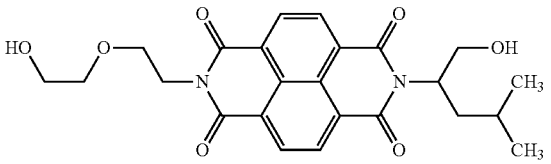
(E-1-38)
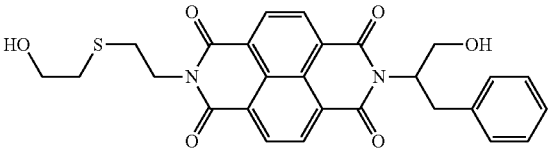
(E-1-39)
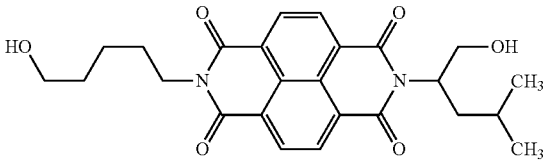
(E-1-40)
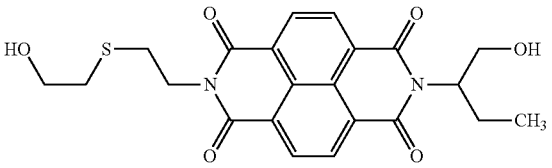
(E-1-41)
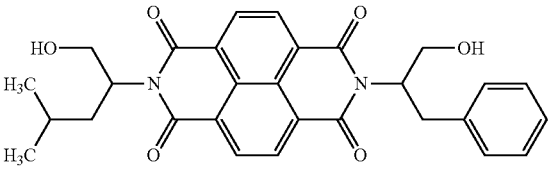
(E-1-42)
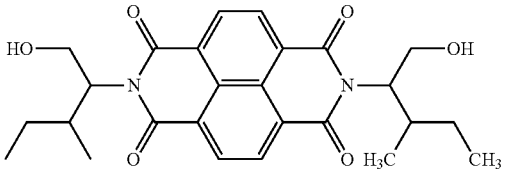
(E-1-43)
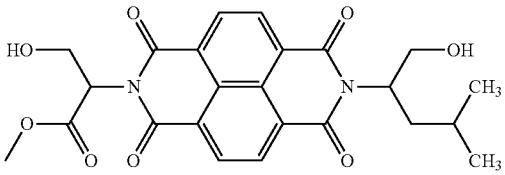
(E-1-44)
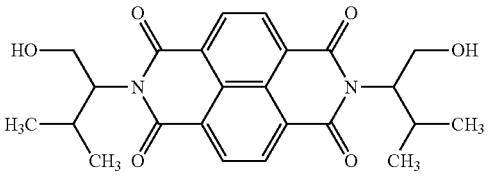
-continued
(E-1-45)
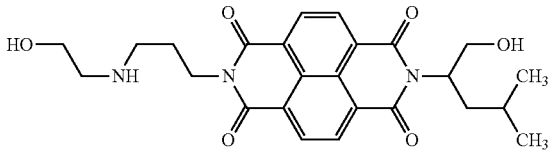
(E-1-46)
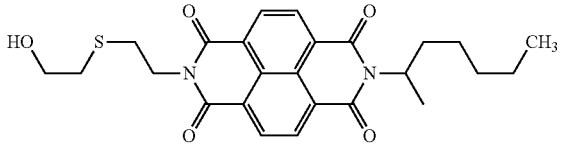
(E-1-47)
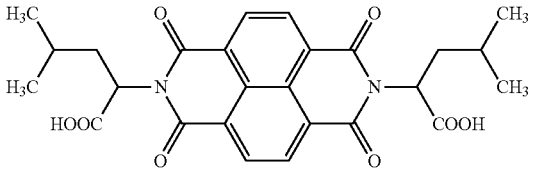
(E-1-48)
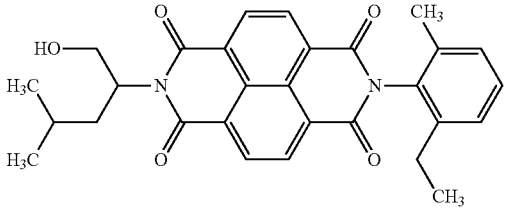
(E-1-49)
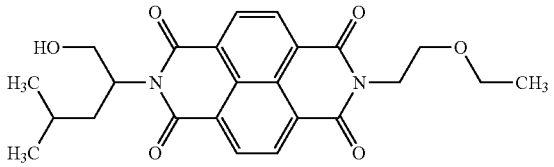
(E-2-1)
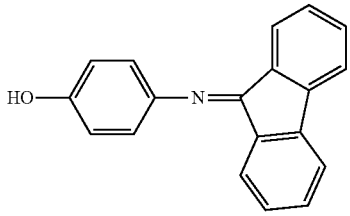
(E-2-2)
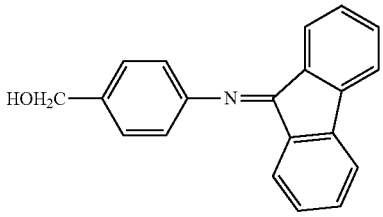

-continued
(E-2-3)
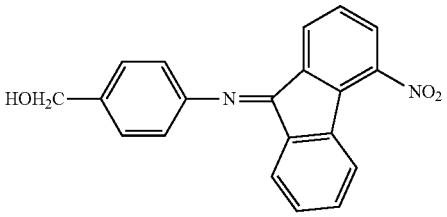
(E-2-4)
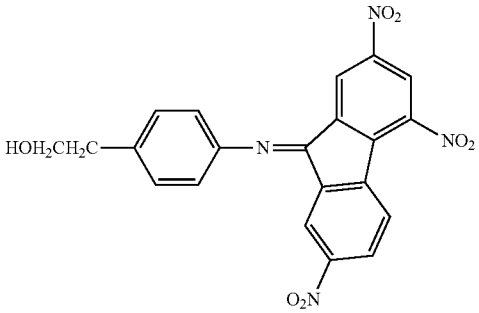
(E-2-5)
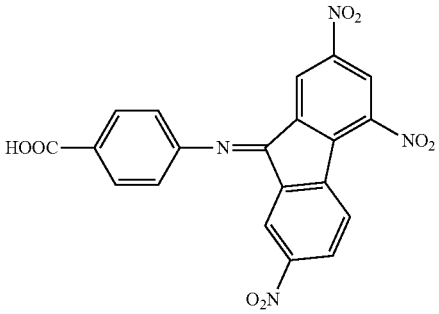
(E-2-6)
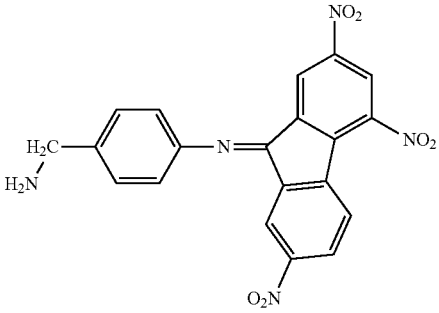
(E-2-7)
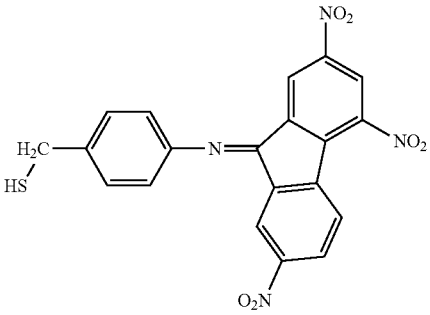
-continued
(E-2-8)
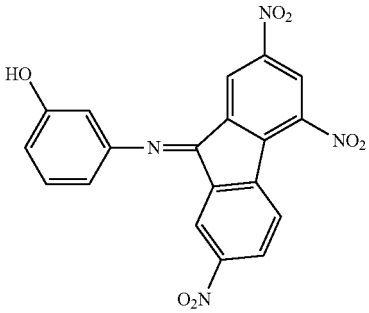
(E-2-9)
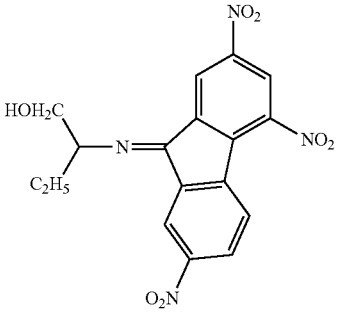
(E-2-10)
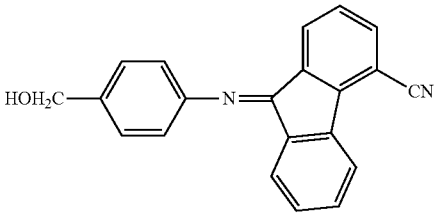
(E-2-11)
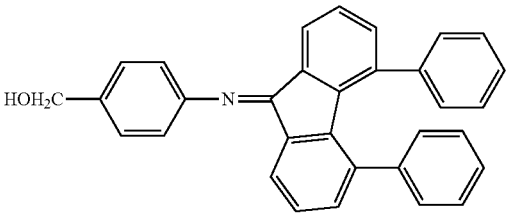
(E-2-12)
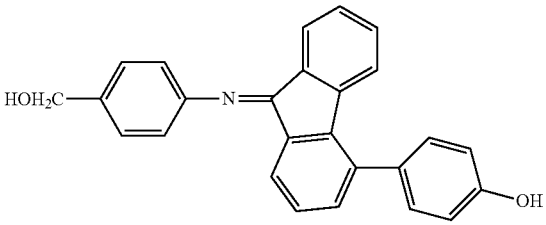

-continued
(E-2-13)
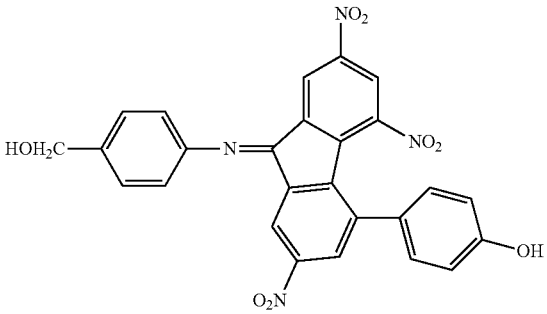
(E-2-14)
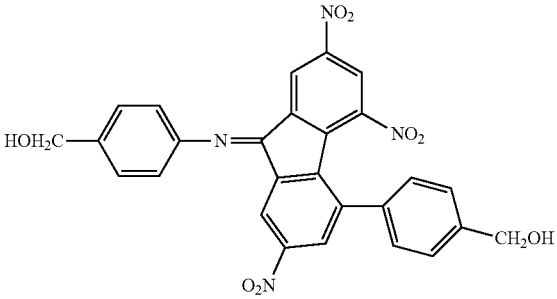
(E-2-15)
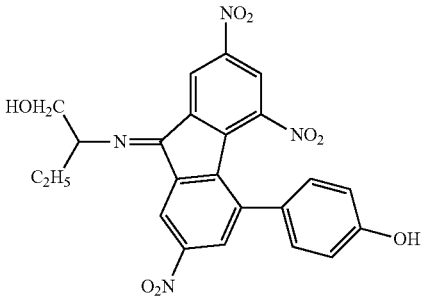
(E-2-16)
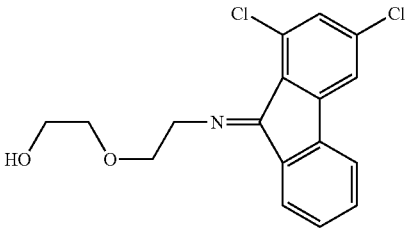
(E-2-17)
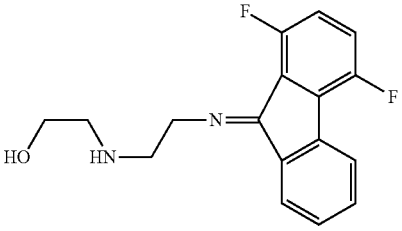
-continued
(E-2-18)
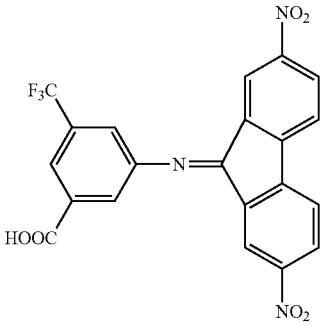
(E-2-19)
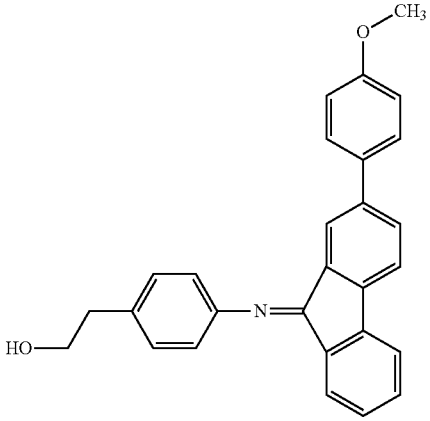
(E-2-20)
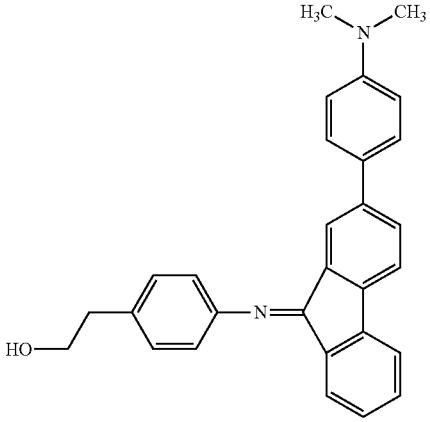
(E-2-21)
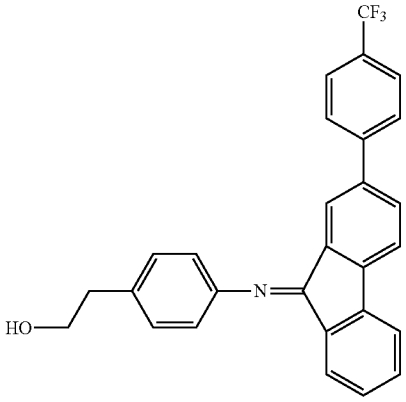

-continued
(E-2-22)
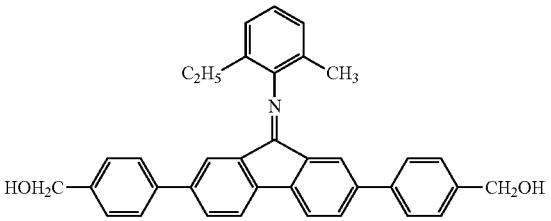
(E-2-23)
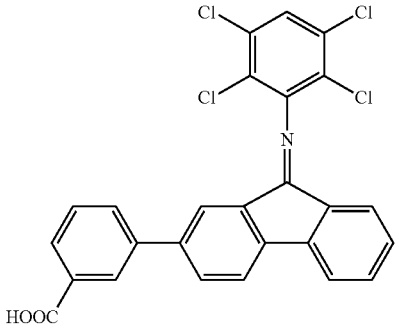
(E-2-23)
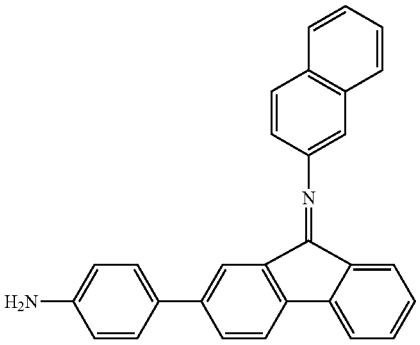
(E-2-24)
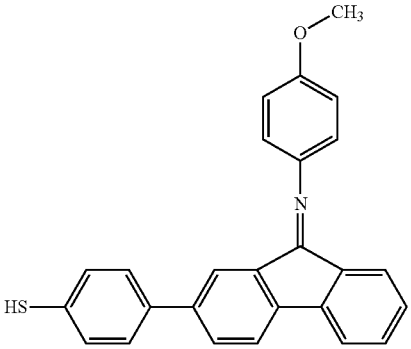
-continued
(E-2-25)
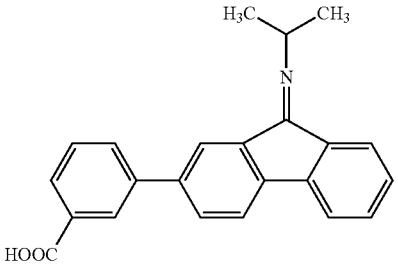
(E-2-26)
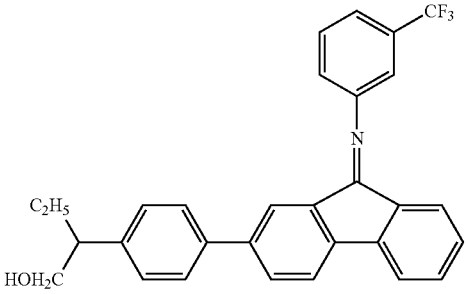
(E-2-27)
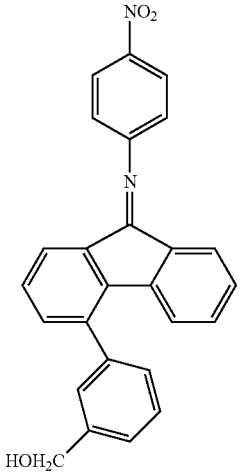
(E-2-28)
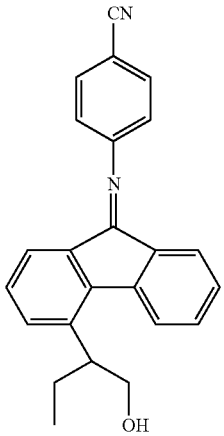

-continued
(E-2-29)
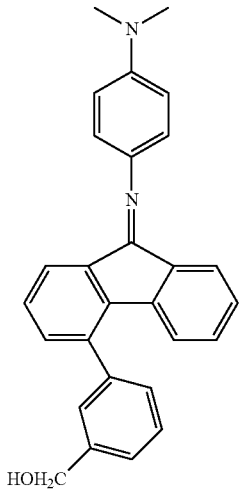
(E-2-30)
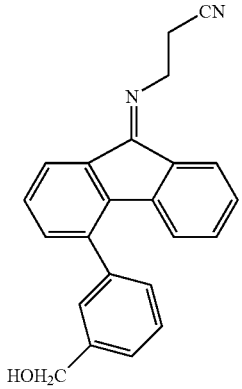
(E-2-31)
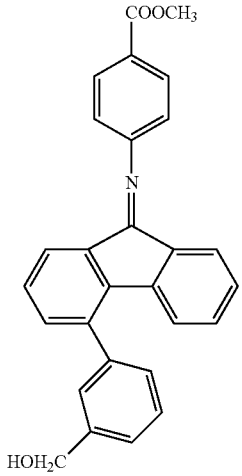
(E-3-1)
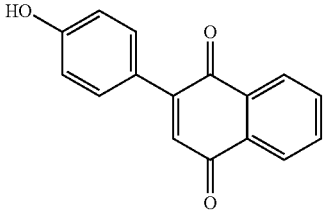
-continued
(E-3-2)
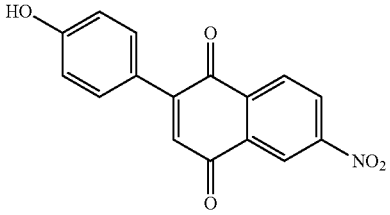
(E-3-3)
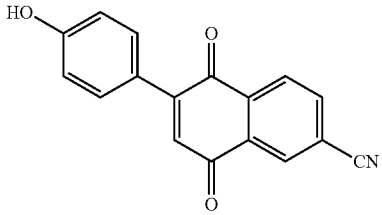
(E-3-4)
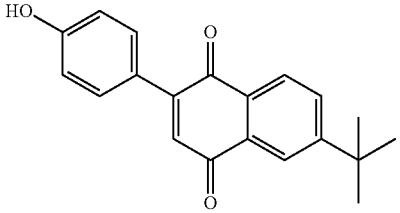
(E-3-5)
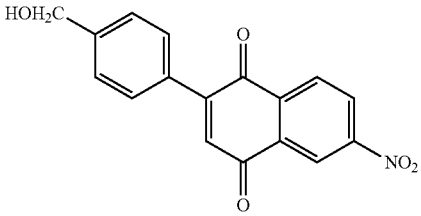
(E-3-6)
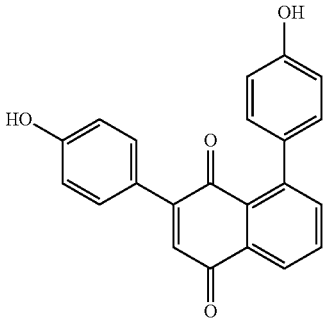
(E-4-1)
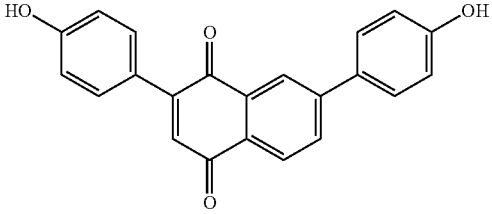

-continued
(E-5-1)
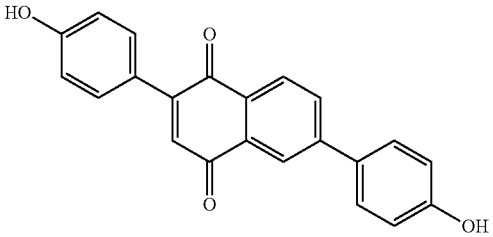
(E-6-1)
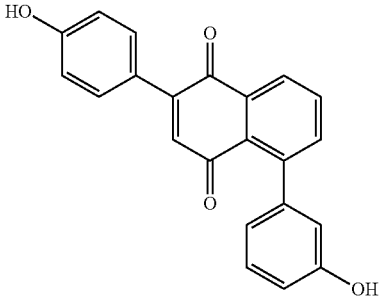
(E-7-1)
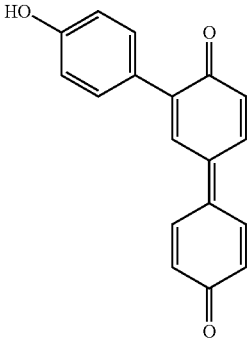
(E-7-2)
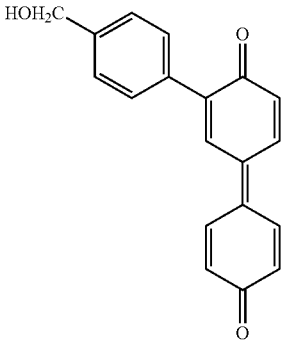
(E-7-3)
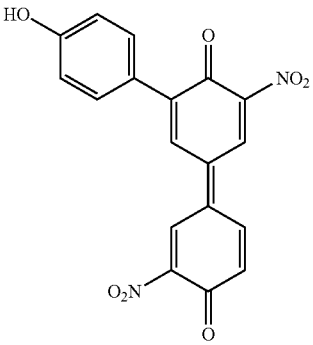
-continued
(E-7-4)
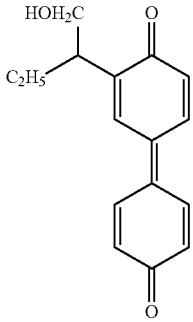
(E-7-5)
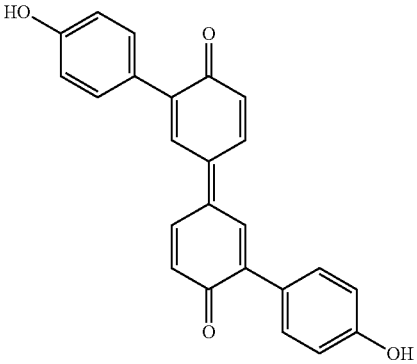
(E-7-6)
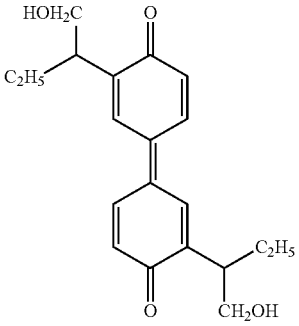
(E-7-7)
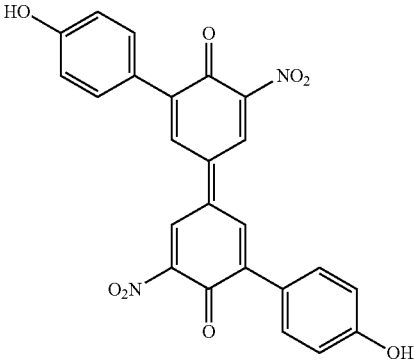

-continued
(E-7-8)
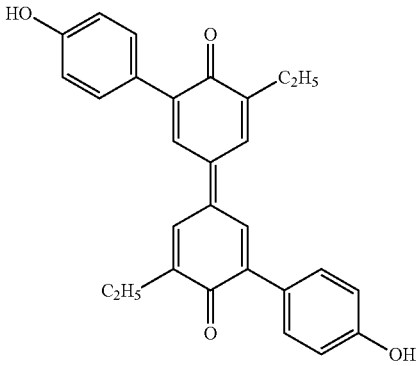
(E-7-9)
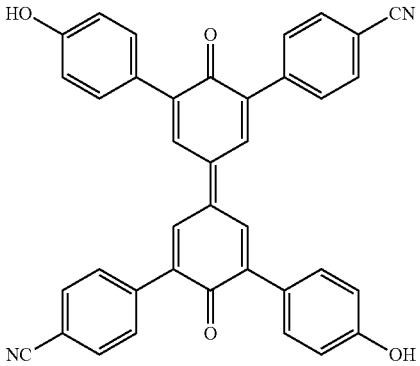
(E-8-1)
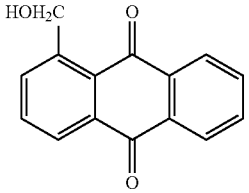
(E-8-2)
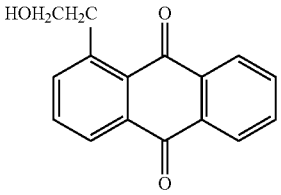
(E-8-3)
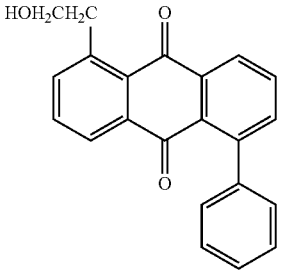
-continued
(E-8-4)
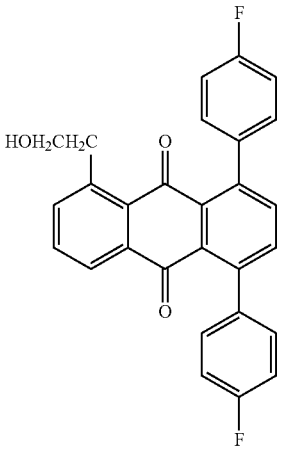
(E-8-5)
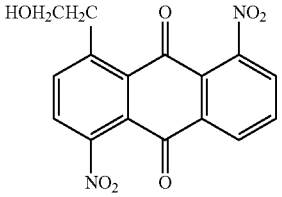
(E-8-6)
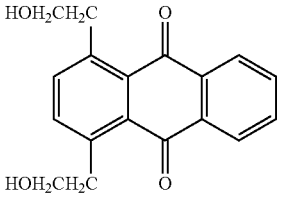
(E-9-1)
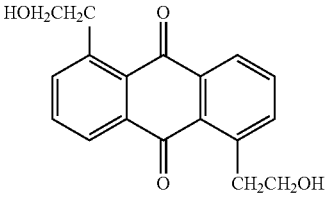
(E-9-2)
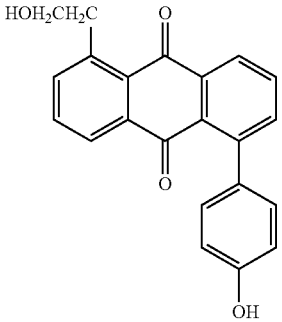

-continued
(E-9-3)
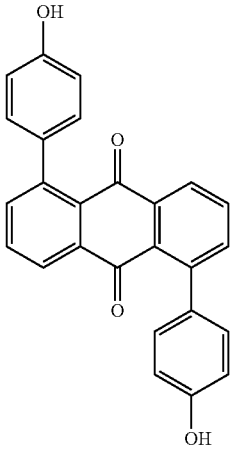
(E-10-1)
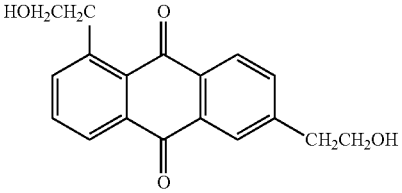
(E-10-2)
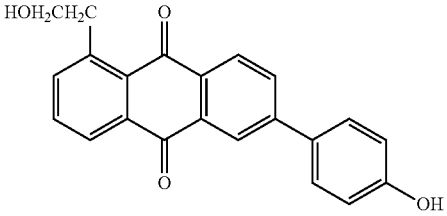
(E-10-3)
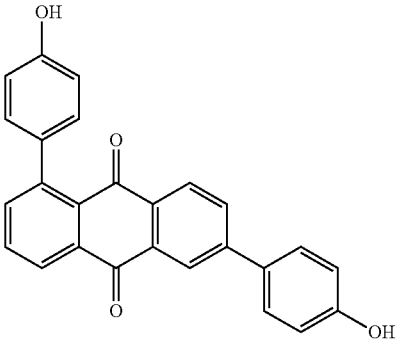
(E-11-1)
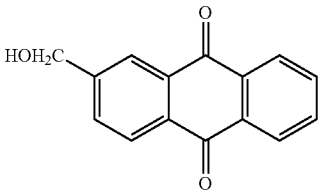
-continued
(E-11-2)
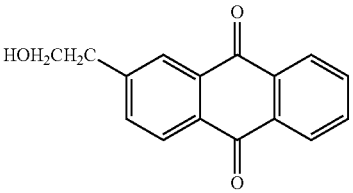
(E-11-3)
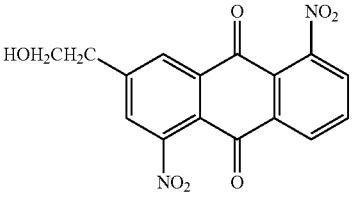
(E-11-4)
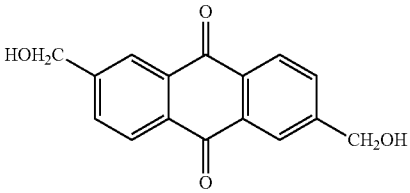
(E-11-5)
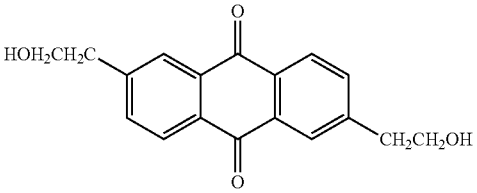
(E-11-6)
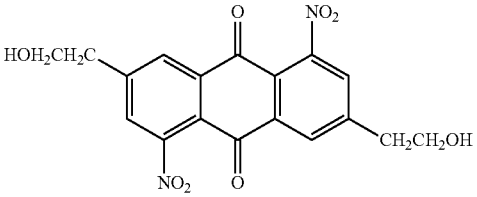
(E-11-7)
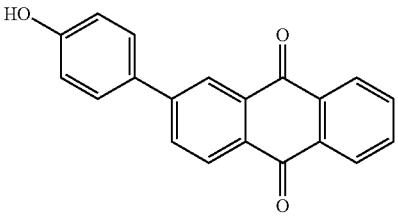
(E-11-8)
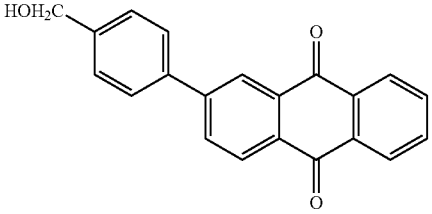

-continued
(E-11-9)
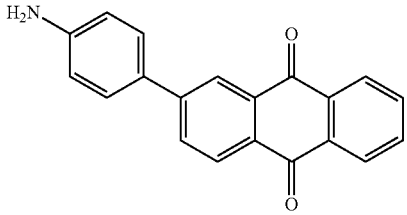
(E-11-10)
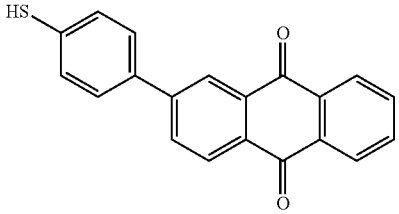
(E-12-1)
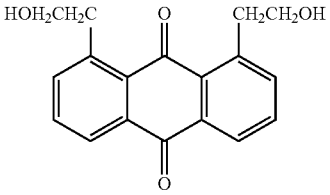
(E-12-2)
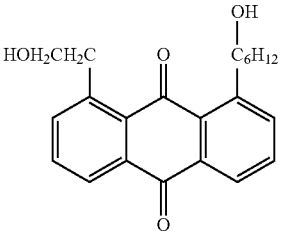
(E-12-3)
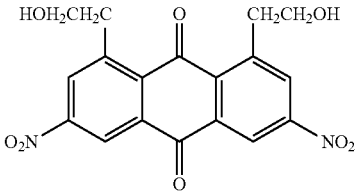
(E-13-1)
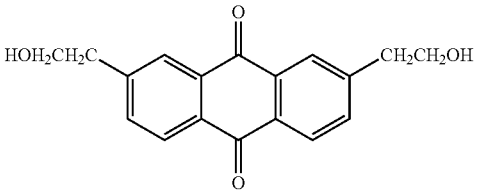
(E-13-2)
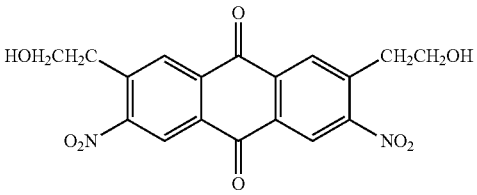
-continued
(E-14-1)
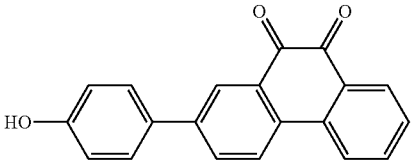
(E-14-2)
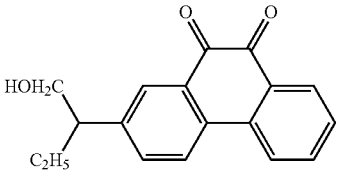
(E-14-3)
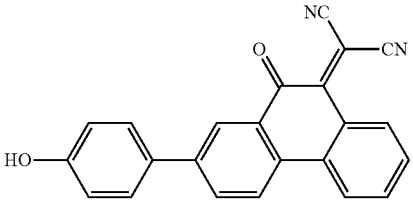
(E-14-4)
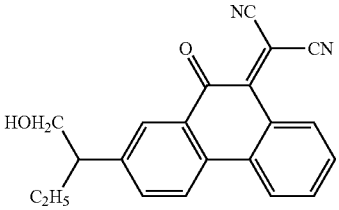
(E-14-5)
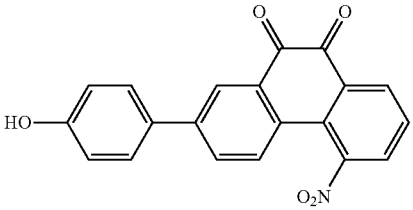
(E-14-6)
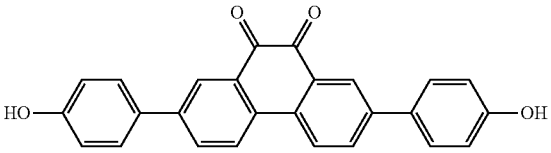
(E-15-1)
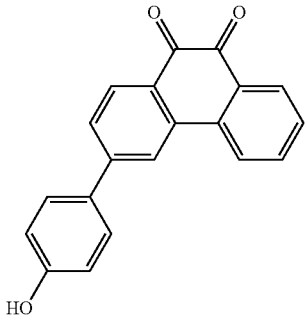

-continued
(E-15-2)
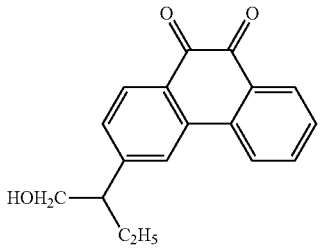
(E-15-3)
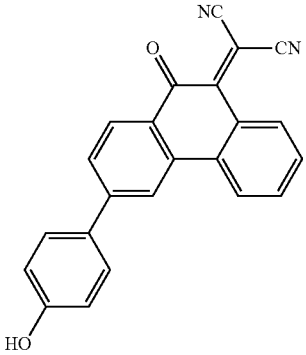
(E-15-4)
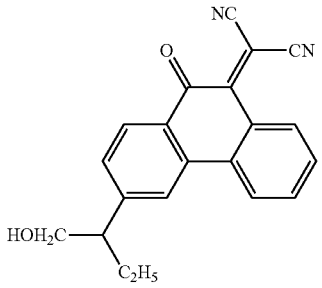
(E-15-5)
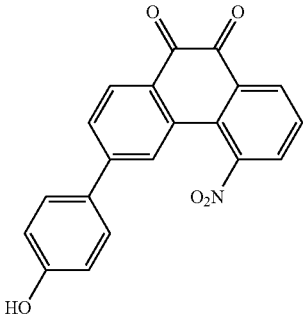
(E-15-6)
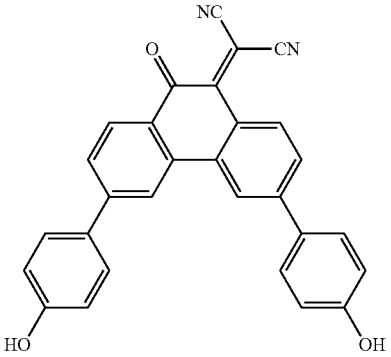
-continued
(E-16-1)
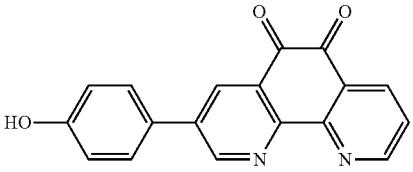
(E-16-2)
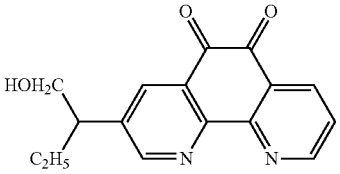
(E-16-3)
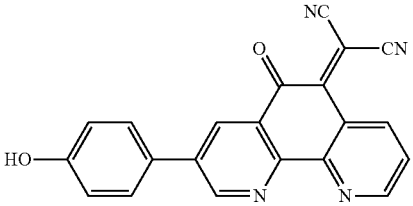
(E-16-4)
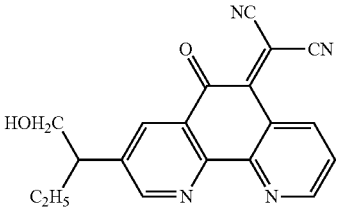
(E-16-5)
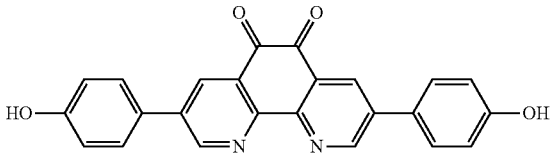
(E-16-6)
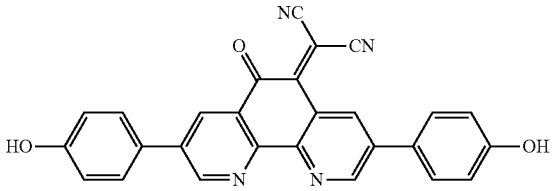
(E-17-1)
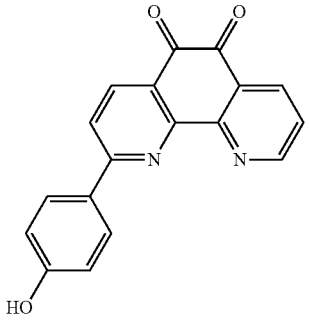

-continued
(E-17-2)
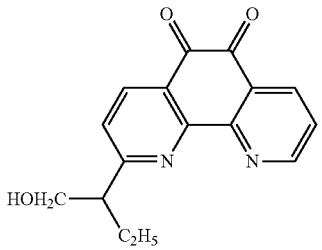
(E-17-3)
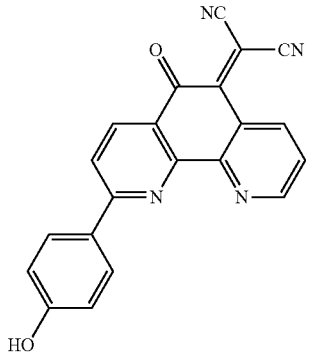
(E-17-4)
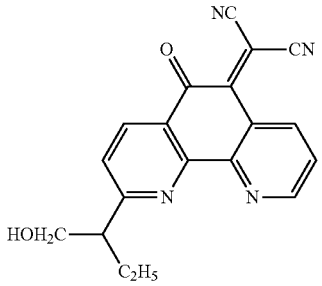
(E-17-5)
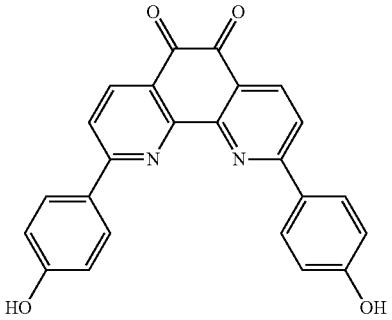
(E-17-6)
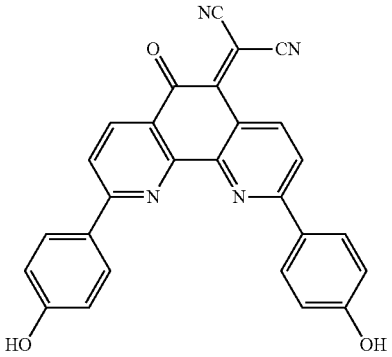
-continued
(E-19-1)
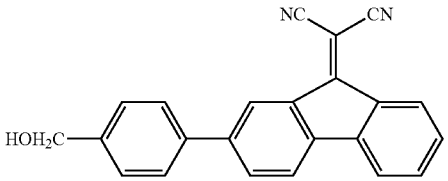
(E-19-2)
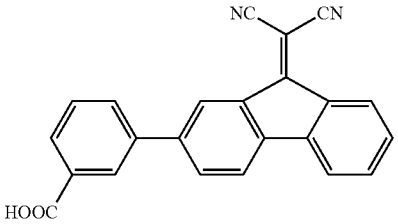
(E-19-3)
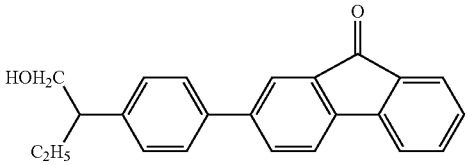
(E-19-4)
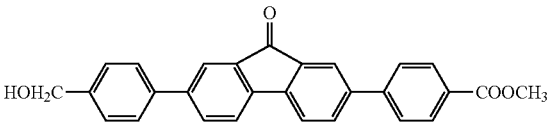
(E-19-5)
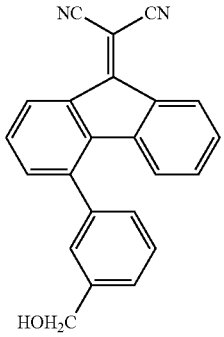
(E-19-6)
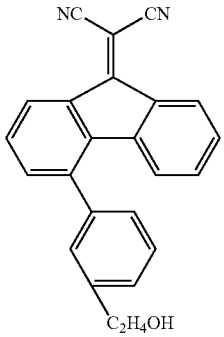

-continued (E-19-7)

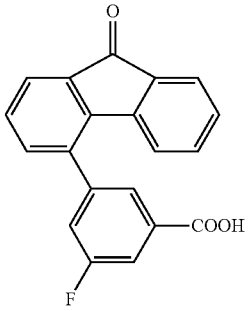

Among these electron transporting substances, Examples Compounds (E-1-1) to (E-1-34) are particularly preferable. An electron transporting substance that has two or more polymerizable functional groups are particularly preferable since it helps increase the polymerization (crosslinking) density.

Derivatives having a structure (E-1) (derivatives of the electron transporting substance) can be synthesized through known synthetic methods such as those disclosed in U.S. Pat. Nos. 4,442,193, 4,992,349 and 5,468,583 and Chemistry of materials, Vol. 19, No. 11, 2703-2705 (2007), for example. It is also possible to conduct synthesis by reacting a naphthalene tetracarboxylic dianhydride and a monoamine derivative commercially available from Tokyo Chemical Industry Co., Ltd., Sigma-Aldrich Japan K.K., and Johnson Matthey Japan Incorporated.

The functional groups (a hydroxyl group, a thiol group, an amino group, and a carboxyl group) polymerizable with the crosslinking agent may be introduced by a method of directly introducing the polymerizable functional groups to a derivative having a structure (E-1) or by a method of introducing structures that have the polymerizable functional groups or functional groups that can serve as precursors of the polymerizable functional groups. Examples of the latter method include a method for introducing a functional group-containing aryl group by conducting a cross coupling reaction on a halide of a naphthylimide derivative and a base in the presence of a palladium catalyst, a method for introducing a functional group-containing alkyl group by conducting a cross coupling reaction on the halide and a base in the presence of an $FeCl_3$ catalyst, and a method for introducing a hydroxyalkyl group or a carboxyl group by allowing an epoxy compound or $CO_2$ to act on a lithiated halide. There is also a method in which a naphthalene tetracarboxylic dianhydride derivative or a monoamine derivative that has the polymerizable functional groups or functional groups that can serve as precursors of the polymerizable functional groups is used as a raw material for synthesizing a naphthylimide derivative.

Derivatives having a structure (E-2) or (E-8) are commercially available from Tokyo Chemical Industry Co., Ltd., Sigma-Aldrich Japan K.K., and Johnson Matthey Japan Incorporated, for example. They can also be synthesized by a synthetic method disclosed in U.S. Pat. No. 4,562,132 by using a fluorenone derivative and malononitrile. They can also be synthesized by a synthetic method disclosed in Japanese Patent Laid-Open Nos. 5-279582 and 7-70038 by using a fluorenone derivative and an aniline derivative.

The functional groups (a hydroxyl group, a thiol group, an amino group, and a carboxyl group) polymerizable with the crosslinking agent may be introduced by a method of directly introducing the polymerizable functional groups to a derivative having a structure (E-2) or (E-8) or by a method of introducing structures that have the polymerizable functional groups or functional groups that can serve as precursors of the polymerizable functional groups. Examples of the latter method include a method for introducing a functional group-containing aryl group by conducting a cross coupling reaction on a halide of a fluorenone derivative and a base in the presence of a palladium catalyst, a method for introducing a functional group-containing alkyl group by conducting a cross coupling reaction on the halide and a base in the presence of an $FeCl_3$ catalyst, and a method for introducing a hydroxyalkyl group or a carboxyl group by allowing an epoxy compound or $CO_2$ to act on a lithiated halide. There is also a method in which a naphthalene tetracarboxylic dianhydride derivative or a monoamine derivative that has the polymerizable functional groups or functional groups that can serve as precursors of the polymerizable functional groups is used as a raw material for synthesizing a naphthylimide derivative.

Derivatives having a structure (E-3) can be synthesized by synthetic methods described in Chemistry Letters, 37(3), 360-361 (2008) and Japanese Patent Laid-Open No. 9-151157, for example. The derivatives are also commercially available from Tokyo Chemical Industry Co., Ltd., Sigma-Aldrich Japan K.K., and Johnson Matthey Japan Incorporated.

The functional groups (a hydroxyl group, a thiol group, an amino group, and a carboxyl group) polymerizable with the crosslinking agent may be introduced by a method of introducing structures that have the polymerizable functional groups or functional groups that can serve as precursors of the polymerizable functional groups to a naphthoquinone derivative. Examples of this method include a method for introducing a functional group-containing aryl group by conducting a cross coupling reaction of a halide of naphthoquinone and a base in the presence of a palladium catalyst, a method for introducing a functional group-containing alkyl group by conducting a cross coupling reaction of the halide and a base in the presence of an $FeCl_3$ catalyst, and a method for introducing a hydroxyalkyl group or a carboxyl group by allowing an epoxy compound or $CO_2$ to act on a lithiated halide.

Derivatives having a structure (E-4) can be synthesized by synthetic methods disclosed in Japanese Patent Laid-Open No. 1-206349 and PPCl/Japan Hard Copy '98 proceedings, p. 207 (1998), for example. Derivatives can also be synthesized by using, as raw materials, phenol derivatives commercially available from Tokyo Chemical Industry Co. Ltd., and Sigma-Aldrich Japan K.K., for example.

The functional groups (a hydroxyl group, a thiol group, an amino group, and a carboxyl group) polymerizable with the crosslinking agent may be introduced by a method of introducing structures that have the polymerizable functional groups or functional groups that can serve as precursors of the polymerizable functional groups. Examples of this method include a method for introducing a functional group-containing aryl group by conducting a cross coupling reaction of a halide of diphenoquinone and a base in the presence of a palladium catalyst, a method for introducing a functional group-containing alkyl group by conducting a cross coupling reaction of the halide and a base in the presence of an $FeCl_3$ catalyst, and a method for introducing a hydroxyalkyl group or a carboxyl group by allowing an epoxy compound or $CO_2$ to act on a lithiated halide.

Derivatives having a structure (E-5) are commercially available from Tokyo Chemical Industry Co., Ltd., Sigma-Aldrich Japan K.K., and Johnson Matthey Japan Incorporated, for example. They can also be synthesized from phenanthrene derivatives or phenanthroline derivatives by synthetic methods disclosed in Chem. Educator No. 6, 227-234 (2001), Journal of Synthetic Organic Chemistry, Japan, vol. 15, 29-32 (1957), and Journal of Synthetic Organic Chemistry, Japan, vol. 15, 32-34 (1957). A dicyanomethylene group can be introduced by a reaction with malononitrile.

The functional groups (a hydroxyl group, a thiol group, an amino group, and a carboxyl group) polymerizable with the crosslinking agent may be introduced by a method of directly introducing the polymerizable functional groups to a derivative having a structure (E-5) prepared in advance or by a method of introducing structures that have the polymerizable functional groups or functional groups that can serve as precursors of the polymerizable functional groups. Examples of the latter method include a method for introducing a functional group-containing aryl group by conducting a cross coupling reaction of a halide of phenanthrenequinone and a base in the presence of a palladium catalyst, a method for introducing a functional group-containing alkyl group by conducting a cross coupling reaction of the halide and a base in the presence of an $FeCl_3$ catalyst, and a method for introducing a hydroxyalkyl group or a carboxyl group by allowing an epoxy compound or $CO_2$ to act on a lithiated halide.

Derivatives having a structure (E-6) are commercially available from Tokyo Chemical Industry Co., Ltd., Sigma-Aldrich Japan K.K., and Johnson Matthey Japan Incorporated, for example. They can also be synthesized from phenanthrene derivatives or phenanthroline derivatives by a synthetic method disclosed in Bull. Chem. Soc. Jpn., Vol. 65, 1006-1011 (1992). A dicyanomethylene group can also be introduced by a reaction with malononitrile.

The functional groups (a hydroxyl group, a thiol group, an amino group, and a carboxyl group) polymerizable with the crosslinking agent may be introduced by a method of directly introducing the polymerizable functional groups to a derivative having a structure (E-6) prepared in advance or by a method of introducing structures that have the polymerizable functional groups or functional groups that can serve as precursors of the polymerizable functional groups. Examples of the latter method include a method for introducing a functional group-containing aryl group by conducting a cross coupling reaction of a halide of phenanthroline quinone and a base in the presence of a palladium catalyst, a method for introducing a functional group-containing alkyl group by conducting a cross coupling reaction of the halide and a base in the presence of an $FeCl_3$ catalyst, and a method for introducing a hydroxyalkyl group or a carboxyl group by allowing an epoxy compound or $CO_2$ to act on a lithiated halide.

Derivatives having a structure (E-7) are commercially available from Tokyo Chemical Industry Co., Ltd., Sigma-Aldrich Japan K.K., and Johnson Matthey Japan Incorporated, for example.

The polymerizable groups (a hydroxyl group, a thiol group, an amino group, and a carboxyl group) polymerizable with a crosslinking agent can be introduced by a method of introducing structures that have the polymerizable functional groups or functional groups that can serve as precursors of the polymerizable functional groups to a commercially available anthraquinone derivative. Examples of this method include a method for introducing a functional group-containing aryl group by conducting a cross coupling reaction of a halide of anthraquinone and a base in the presence of a palladium catalyst, a method for introducing a functional group-containing alkyl group by conducting a cross coupling reaction of the halide and a base in the presence of an $FeCl_3$ catalyst, and a method for introducing a hydroxyalkyl group or a carboxyl group by allowing an epoxy compound or $CO_2$ to act on a lithiated halide.

Examples of the solvent used in the coating solution for an undercoat layer include alcohol-based solvents, aromatic hydrocarbon-based solvents, halogenated hydrocarbon-based solvents, ketone-based solvents, ketone alcohol-based solvents, ether-based solvents, and ester-based solvents. Specific examples thereof are methanol, ethanol, n-propanol, iso-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene, and toluene. These solvents can be used alone or in combination. Any mixture of two or more solvents may be used as long as the mixture can dissolve the isocyanate compound, the resin, and the electron transporting substance.

The electrophotographic photosensitive member according to an embodiment of the present invention may be a cylindrical electrophotographic photosensitive member that includes a cylindrical support and a photosensitive layer (charge generating layer and charge transporting layer) on the support. Alternatively, the electrophotographic photosensitive member may have a belt shape, a sheet shape, or the like.

The support may have electrical conductivity (conductive support). For example, the support may be composed of a metal such as aluminum, nickel, copper, gold, or iron, or an alloy. Alternatively, a support formed by forming a metal thin film of aluminum, silver, gold, or the like on an insulating support such as a support composed of a polyester resin, a polycarbonate resin, a polyimide resin, or glass, or a support on which a thin film of a conductive material such as indium oxide or tin oxide is formed can also be used as the support.

The surface of the support may be subjected to an electrochemical treatment such as anodizing, a wet horning treatment, a blasting treatment, or a cutting treatment to improve the electrical properties and suppress interference fringes.

A conductive layer may be interposed between the support and the undercoat layer. The conductive layer is obtained by forming a coating film on a support by using a coating solution containing a resin and conductive particles dispersed in the resin and drying the coating film. Examples of the conductive particles include carbon black, acetylene black, metal powders such as aluminum, nickel, iron, nichrome, copper, zinc, and silver powders, and metal oxide powders such as conductive tin oxide and indium tin oxide (ITO).

Examples of the resin include polyester resins, polycarbonate resins, polyvinyl butyral resins, acrylic resins, silicone resins, epoxy resins, melamine resins, urethane resins, phenolic resins, and alkyd resins.

Examples of the solvent used for preparing the coating solution for a conductive layer include ether-based solvents, alcohol-based solvents, ketone-based solvents, and aromatic hydrocarbon solvents. The thickness of the conductive layer is preferably 0.2 μm or more and 40 μm or less, more preferably 1 μm or more and 35 μm or less, and most preferably 5 μm or more and 30 μm or less.

The undercoat layer is interposed between the support and the photosensitive layer or between the conductive layer and the photosensitive layer.

Next, a photosensitive layer is formed on the undercoat layer.

Examples of the charge generating substance include azo pigments, perylene pigments, anthraquinone derivatives, anthanthrone derivative, dibenzpyrenequinone derivatives, pyranthrone derivatives, violanthrone derivatives, isoviolanthrone derivatives, indigo derivatives, thioindigo derivatives, phthalocyanine pigments such as metal phthalocyanine and metal-free phthalocyanine, and bisbenzimidazole derivatives. Among these, azo pigments and phthalocyanine pigments are preferable. Among phthalocyanine pigments, oxytitanium phthalocyanine, chlorogallium phthalocyanine, and hydroxygallium phthalocyanine are preferable.

The photosensitive layer may be a layered photosensitive layer. In such a case, examples of the binder resin used in the charge generating layer include polymers and copolymers of vinyl compounds such as styrenes, vinyl acetate, vinyl chloride, acrylates, methacrylates, vinylidene fluoride, and trifluoroethylene, polyvinyl alcohol resins, polyvinyl acetal resins, polycarbonate resins, polyester resins, polysulfone resins, polyphenylene oxide resins, polyurethane resins, cellulose resins, phenolic resins, melamine resins, silicon resins, and epoxy resins. Among these, polyester resins, polycarbonate resins, and polyvinyl acetal resins are preferred and polyvinyl acetal resins are more preferred.

The ratio of the charge generating substance to the binder resin in the charge generating layer (charge generating substance/binder resin) is preferably in the range of 10/1 to 1/10 and more preferably in the range of 5/1 to 1/5. The thickness of the charge generating layer may be 0.05 μm or more and 5 μm or less. Examples of the solvent used for preparing the coating solution for a charge generating layer include alcohol-based solvents, sulfoxide-based solvents, ketone-based solvents, ether-based solvents, ester-based solvents, and aromatic hydrocarbon solvents.

Examples of the hole transporting substance include polycyclic aromatic compounds, heterocyclic compounds, hydrazone compounds, styryl compounds, benzidine compounds, triarylamine compounds, and triphenylamine compounds; and polymers that have a main chain or side chain containing a group derived from any of these compounds.

In the cases where the photosensitive layer is a layered photosensitive layer, the binder resin used in the charge transporting layer (hole transporting layer) may be a polyester resin, a polycarbonate resin, a polymethacrylate resin, a polyarylate resin, a polysulfone resin, or a polystyrene resin, for example. The binder resin is more preferably a polycarbonate resin or a polyarylate resin. The weight-average molecular weight (Mw) of the resin may be in the range of 10,000 to 300,000.

The ratio of the hole transporting substance to the binder resin in the charge transporting layer (hole transporting substance/binder resin) is preferably in the range of 10/5 to 5/10 and more preferably in the range of 10/8 to 6/10. The thickness of the hole transporting layer may be 5 μm or more and 40 μm or less.

Examples of the solvent used in the coating solution for a charge transporting layer include alcohol-based solvents, sulfoxide-based solvents, ketone-based solvents, ether-based solvents, ester-based solvents, and aromatic hydrocarbon solvents.

A protective layer (surface protecting layer) that contains conductive particles or a hole transporting substance and a binder resin may be provided on the photosensitive layer (charge transporting layer). The protective layer may further contain additives such as a lubricant. Electrical conductivity or a hole transport property may be imparted to the binder resin of the protective layer. In such a case, there is no need to add conductive particles or a hole transporting substance other than the resin to the protective layer. The binder resin in the protective layer may be a thermoplastic resin or a curable resin curable (polymerizable) with heat, light, or radiation (such as an electron beam).

The layers, such as an undercoat layer and a photosensitive layer (a charge generating layer and a charge transporting layer), that constitute the electrophotographic photosensitive member may be formed by dissolving or dispersing materials constituting the respective layers in respective solvents to obtain coating solutions, applying the coating solutions, and drying and curing the applied coating solutions. Examples of the method used for applying the coating solutions include a dip coating method, a spray coating method, a curtain coating method, and a spin coating method. Among these, a dip coating method is preferable from the viewpoints of efficiency and productivity.

Figure 1:
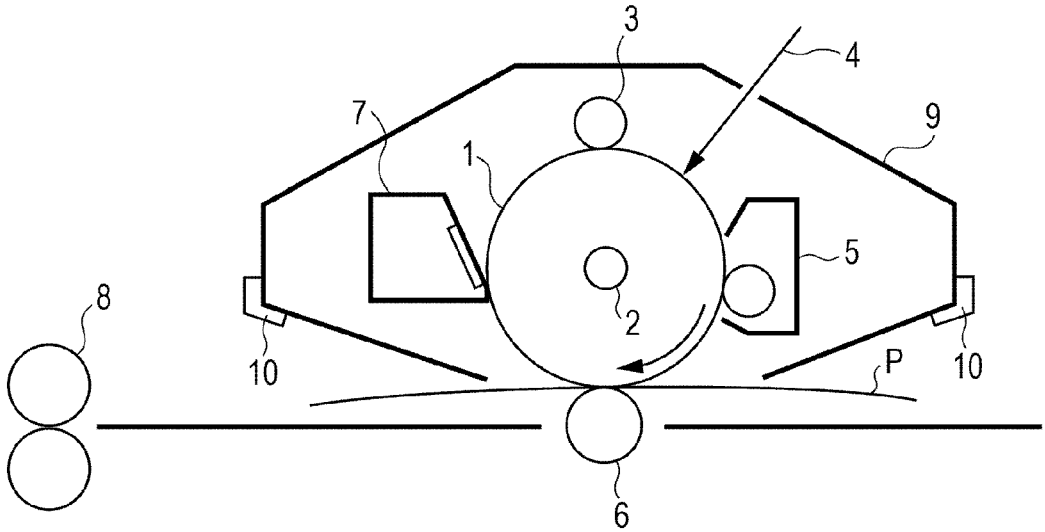
FIG. 1 is a schematic diagram of an electrophotographic apparatus that includes a process cartridge that includes an electrophotographic photosensitive member.

FIG. 1 is a schematic diagram of an electrophotographic apparatus that includes a process cartridge that includes an electrophotographic photosensitive member according to an embodiment of the present invention.

Referring to FIG. 1, an electrophotographic photosensitive member 1 has a cylindrical shape and is rotated about a shaft 2 in the arrow direction at a particular peripheral speed. The surface (peripheral surface) of the electrophotographic photosensitive member 1 rotated is evenly charged to a particular positive or negative potential with a charging device 3 (a primary charging device such as a charging roller). Then the surface is exposed to exposure light (image exposure light) 4 from an exposure device (not shown) through, for example, slit exposure or laser beam scanning exposure. As a result, an electrostatic latent image corresponding to a desired image is formed on the surface of the electrophotographic photosensitive member 1.

The electrostatic latent image formed on the surface of the electrophotographic photosensitive member 1 is developed with a toner contained in a developing gent in a developing device 5 and forms a toner image. The toner image on the surface of the electrophotographic photosensitive member 1 is transferred to a transfer material (such as paper) P due to a transfer bias from a transferring device (such as transfer roller) 6. The transfer material P is picked up from a transfer material feeding unit (not shown in the drawing) and fed to the nip (contact portion) between the electrophotographic photosensitive member 1 and the transferring device 6 in synchronization with the rotation of the electrophotographic photosensitive member 1.

The transfer material P that received the transfer of the toner image is detached from the surface of the electrophotographic photosensitive member 1 and guided to a fixing unit 8 where the image is fixed. An image product (a print or a copy) is output from the apparatus.

The surface of the electrophotographic photosensitive member 1 after the transfer of the toner image is cleaned with a cleaning device (such as a cleaning blade) 7 to remove the developing agent (toner) that remains after the transfer. Then the charge is erased with pre-exposure light (not shown in the drawing) from a pre-exposure device (not shown in the drawing) so that the electrophotographic photosensitive member 1 can be repeatedly used for forming images. When the charging device 3 is of a contact-charging type such as a charging roller as shown in FIG. 1, the pre-exposure is not always necessary.

Two or more selected from the electrophotographic photosensitive member 1, the charging device 3, the developing device 5, the transferring device 6, the cleaning device 7, etc., may be housed in a container so as to form a process cartridge and the process cartridge may be configured to be removably loadable to the main unit of an electrophotographic apparatus such as a copy machine or a laser beam printer. In FIG. 1, the electrophotographic photosensitive member 1, the charging device 3, the developing device 5, and the cleaning device 7 are integrally supported to form a cartridge 9 which is detachably attachable to the main unit of the electrophotographic apparatus through a guiding unit 10 such as a rail of the main body of the electrophotographic apparatus.

EXAMPLES

The present invention will now be described in further detail by way of specific examples. Note that in the description of Examples below, "parts" means "parts by mass".

Example 1

Two electrophotographic photosensitive members were prepared as below. One of them was used for structural analysis of the undercoat layer and the other was used to evaluate positive ghosting.

An aluminum cylinder having a length of 260.5 mm and a diameter of 30 mm (JIS-A3003, aluminum alloy) was used as a support (conductive support).

Next, 50 parts of titanium oxide particles (powder resistivity: 120 Ω·cm, $SnO_2$ coverage (mass ratio): 40%) coated with oxygen-deficient tin oxide, 40 parts of a phenolic resin (PLYOPHEN J-325, produced by DIC Corporation, resin solid content: 60%), and 40 parts of methoxypropanol were placed in a sand mill containing glass beads 1 mm in diameter and dispersed for 3 hours to prepare a coating solution (dispersion) for a conductive layer. The coating solution for a conductive layer was applied to the support by dip coating and the coating film obtained was dried and thermally cured at 145° C. for 30 minutes. As a result, a conductive layer having a thickness of 16 μm was formed.

The average particle size of the titanium oxide particles coated with oxygen-deficient tin oxide in the coating solution for a conductive layer was measured with a particle size analyzer (trade name: CAPA700 produced by Horiba Ltd.) by using tetrahydrofuran as a dispersion medium through a centrifugal sedimentation technique at a speed of rotation of 5000 rpm. The average particle size observed was 0.33 μm.

In a mixed solution containing 50 parts of methyl ethyl ketone and 50 parts of dimethylacetamide, 3.6 parts of Example Compound (E-1-1) serving as an electron transporting substance, 6.2 parts of Example Compound (1-8) serving as an isocyanate compound, and 1.29 parts of a butyral resin (trade name: BM-1, produced by Sekisui Chemical Co., Ltd.) serving as a resin were dissolved. To the resulting solution, 0.031 parts of dioctyltin dilaurate was added as a catalyst to prepare a coating solution for an undercoat layer. The coating solution for an undercoat layer was applied to the conductive layer by dip-coating and the resulting coating film was polymerized (cured) by being heated at 160° C. for 30 minutes. As a result, an undercoat layer having a thickness of 0.5 μm was obtained.

Into a sand mill containing glass beads 1 mm in diameter, 260 parts of cyclohexanone, 5 parts of a butyral resin (trade name: BX-1 produced by Sekisui Chemical Co., Ltd.), and 10 parts of hydroxygallium phthalocyanine crystals (charge generating substance) that have intense peaks at Bragg's angles (2θ±0.2°) of 7.5°, 9.9°, 12.5°, 16.3°, 18.6°, 25.1°, and 28.3° in X-ray diffraction with CuKα radiation were placed and a dispersion treatment was carried out for 1.5 hours. To the resulting mixture, 240 parts of ethyl acetate was added to prepare a coating solution for a charge generating layer. The coating solution for the charge generating layer was applied to the undercoat layer by dip coating and the resulting coating film was dried at 95° C. for 10 minutes to form a charge generating layer having a thickness of 0.18 μm.

In a mixed solvent containing 30 parts of dimethoxymethane and 70 parts of chlorobenzene, 7 parts of an amine compound (hole transporting substance) represented by formula (15) below and 10 parts of a polyarylate resin being constituted by a repeating structural unit represented by formula (16-1) below and a repeating structural unit represented by formula (16-2) below at a 5/5 ratio and having a weight-average molecular weight (Mw) of 100,000 were dissolved to prepare a coating solution for a charge transporting layer. The coating solution for the charge transporting layer was applied to the charge generating layer by dip coating and the resulting coating film was dried at 120° C. for 40 minutes. As a result, a charge transporting layer having a thickness of 18 μm was obtained.

(15)

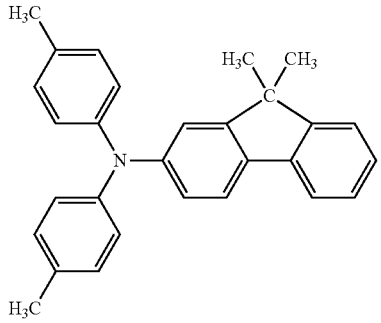

(16-1)

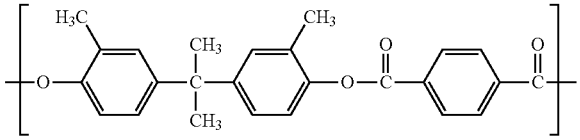

(16-2)

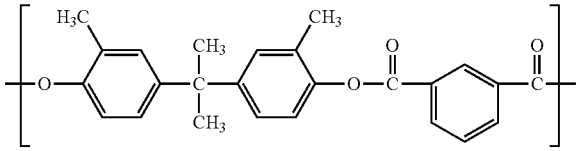

As a result, an electrophotographic photosensitive member that included a conductive layer, an undercoat layer, a charge generating layer, and a charge transporting layer that were stacked in that order on a support was obtained.

The structure of the undercoat layer was analyzed by the following process. The electrophotographic photosensitive member for undercoat layer structural analysis was immersed in a mixed solvent containing 40 parts of dimethoxymethane and 60 parts of chlorobenzene for 5 minutes and ultrasonic waves were applied to the electrophotographic photosensitive member to separate the hole transporting layer. The charge generating layer was polished with a wrapping tape (C2000 produced by Fujifilm Holdings Corporation) and then dried at 100° C. for 10 minutes to prepare an electrophotographic photosensitive member for analyzing the structure of the undercoat layer. A Fourier transform infrared (FTIR)-attenuated total reflectance (ATR) spectrometry was conducted to confirm the absence of the components of the charge transporting layer and the charge generating layer on the surface of the undercoat layer. The photosensitive member was left standing in a 25° C./50% RH environment for 24 hours and a 1 cm square piece was cut out from the center portion (position 130 mm from the end) of the electrophotographic photosensitive member to prepare a sample for analyzing the structure of the undercoat layer. The structure represented by formula (1) and the number of main-chain atoms in the $D^1$ structure were confirmed through the solid-state $^{13}C$-NMR spectroscopy, the mass spectrometry, the pyrolysis-gas chromatography-mass spectrometry, and the infrared absorption spectrometry described above. The structure represented by formula (1) and the number of main-chain atoms in the $D^1$ structure are shown in Tables 15 to 17.

The other electrophotographic photosensitive member was used to conduct the following evaluation. The electrophotographic photosensitive member obtained was loaded in a modified laser beam printer (trade name: LBP-2510 produced by Canon Kabushiki Kaisha) in a 23° C. 50% RH environment. The surface potential was measured, fluctuation (potential fluctuation) of the light potential observed during repeated use of making 5000 printouts was evaluated, and the ghosting observed during repeated use of making 5000 printouts was evaluated. The details are described below.

The electrophotographic photosensitive member obtained was installed in a cyan process cartridge of a laser beam printer modified so as not conduct pre-exposure. The process cartridge was loaded in a cyan process cartridge station of the printer and images were output. First, one sheet with a solid white image, five sheets with images for ghosting evaluation, one sheet with a solid black image, and five sheets with images for ghosting evaluation were continuously output in that order. Then a test chart (characters with a printing ratio of 5%) was output on 5,000 sheets of A4 size regular paper and then one sheet with a solid white image, five sheets with images for ghosting evaluation, one sheet with a solid black image, and five sheets with images for ghosting evaluation were continuously output in that order.

Figure 2:
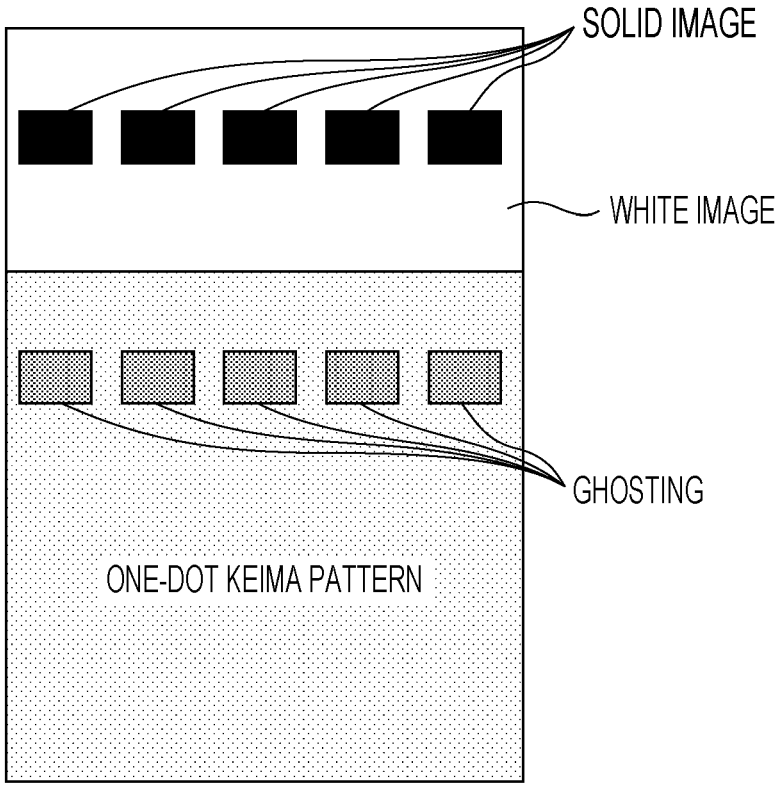
FIG. 2 is a diagram illustrating a print pattern used for evaluating ghost images.
Figure 3:
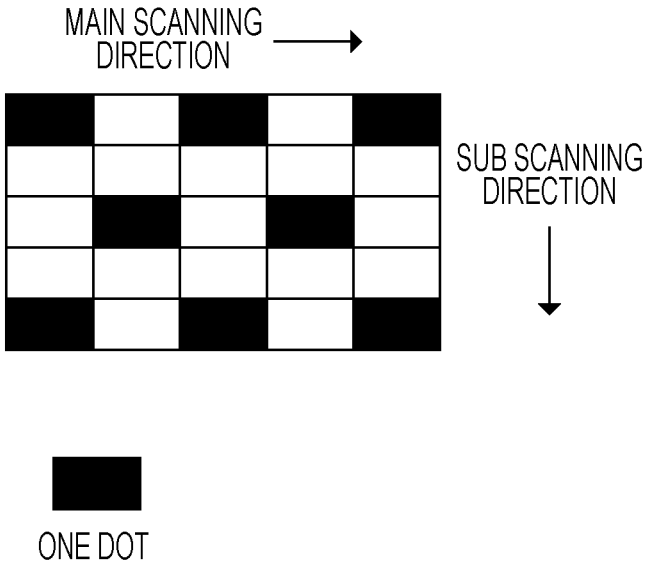
FIG. 3 is a diagram illustrating a spaced checkerboard pattern.

FIG. 2 shows the image for evaluating ghosting. As shown in FIG. 2, the printout includes a white image portion in an upper portion where square solid images were printed and a Keima-pattern portion in a lower portion where a half tone image of a Keima-pattern as shown in FIG. 3 was printed. In FIG. 2, portions where ghosting derived from solid images can occur are marked as "ghosting".

The positive ghosting evaluation was carried out by measuring the difference (Macbeth density difference) between the image density of the spaced checkerboard pattern and the image density at the ghosting portions. The density difference was measured at ten points in one sheet of the image for ghosting evaluation by using a spectro densitometer (trade name: X-Rite 504/508, produced by X-Rite Inc.). This operation was conducted on all of the ten sheets of the images for ghosting evaluation and the results of that total of one hundred points were averaged to evaluate the Macbeth density difference at the initial stage and after repeated use of making 5000 printouts. An image in which the density of the ghosting portion was higher was considered to be a positive ghosting image. The smaller the difference in density, the more suppressed the positive ghosting. The smaller the difference in Macbeth density between the initial stage and after output of 5000 sheets, the larger the effect of suppressing fluctuation of the positive ghosting. The results are shown in Table 15 to 17.

The potential fluctuation (light potential fluctuation) was evaluated by the following process.

The exposure dose (image exposure dose) of a 780 nm laser beam source of an evaluation device was set so that the amount of light at the surface of the electrophotographic photosensitive member was 0.3 $\mu J/cm^2$. The surface potential (dark potential and light potential) at the surface of the electrophotographic photosensitive member was measured by replacing a developing unit of the evaluation device by a jig having a potential measurement probe fixed to be positioned at a position 130 mm from an end of the electrophotographic photosensitive member, and conducting the measurement through the probe at the position where the developing unit had been placed. The applied bias was set so that the dark potential of the non-exposed portion of the electrophotographic photosensitive member was −450 V, and the laser beam was applied to measure the light potential resulting from light decay from the dark potential. Images were continuously output on 5000 sheets of A4-size regular paper and the light potential thereafter (the light potential after repeated use) was measured. The difference between the light potential at the initial stage and the light potential after the repeated use (light potential fluctuation) was then calculated. The test chart used had a printing ratio of 5%. The results are shown in the potential fluctuation columns in Tables 15 to 17.

Examples 2 to 10

Electrophotographic photosensitive members were prepared as in Example 1 except that the electron transporting substance, the isocyanate compound (crosslinking agent), and the resin used in Example 1 were changed as shown in Table 15. Evaluation was conducted as in Example 1. The results are shown in Table 15.

Example 11

An electrophotographic photosensitive member was prepared as in Example 1 except that the electron transporting substance and the isocyanate compound (crosslinking agent) were changed as shown in Table 15, and the resin was changed to 1.29 parts of a butyral resin (trade name: BX-1 produced by Sekisui Chemical Co., Ltd.). Evaluation was conducted as in Example 1. The results are shown in Table 15.

Example 12

An electrophotographic photosensitive member was prepared as in Example 1 except that the electron transporting substance and the isocyanate compound were changed as shown in Table 15 and the resin was changed to 1.29 parts of a polyvinyl alcohol resin (trade name: PVA117 produced by Kuraray Co., Ltd.). Evaluation was conducted as in Example 1. The results are shown in Table 15.

Example 13

An electrophotographic photosensitive member was prepared as in Example 1 except that the electron transporting substance and the isocyanate compound were changed as shown in Table 15 and the resin was changed to 1.29 parts of a partially hydrolyzed vinyl chloride/vinyl acetate resin (trade name: VAGH produced by the Dow Chemical Company). Evaluation was conducted as in Example 1. The results are shown in Table 15.

Example 14

An electrophotographic photosensitive member was prepared as in Example 1 except that the electron transporting substance and the isocyanate compound were changed as shown in Table 15 and 1.29 parts of poly(p-hydroxystyrene) (trade name: MARUKA LYNCUR produced by Maruzen Petrochemical Co., Ltd.) was used as the resin. Evaluation was conducted as in Example 1. The results are shown in Table 15.

Examples 15 to 90

Electrophotographic photosensitive members were prepared as in Example 1 except that the electron transporting substance, the isocyanate compound, and the resin were changed as shown in Tables 15 to 17. Evaluation was conducted as in Example 1. The results are shown in Tables 15 to 17.

Example 91

An electrophotographic photosensitive member was prepared as in Example 1 except that the coating solution for a conductive layer, the coating solution for an undercoat layer, and the coating solution for a charge transporting layer were changed as follows. Evaluation of positive ghosting was conducted as in Example 1. The results are shown in Table 17.

Preparation of the coating solution for a conductive layer was changed as follows. In a sand mill containing 450 parts of glass beads 0.8 mm in diameter, 214 parts of titanium oxide ($TiO_2$) particles coated with oxygen deficient tin oxide ($SnO_2$) serving as metal oxide particles, 132 parts of a phenolic resin (trade name: PLYOPHEN J-325 produced by DIC Corporation, resin solid content: 60%) serving as the binder resin, and 98 parts of 1-methoxy-2-propanol serving as a solvent were placed and a dispersion treatment was conducted at a rotation rate of 2000 rpm, a dispersion treatment time of 4.5 hours, and a cooling water set temperature of 18° C. so as to obtain a dispersion. The glass beads were removed from the dispersion by using a mesh (aperture: 150 μm).

Silicone resin particles (trade name: Tospearl 120 produced by Momentive Performance Materials Inc., average particle diameter: 2 μm) serving as a surface roughness imparter were added to the dispersion after the removal of the glass beads so that the amount of the silicone resin particles was 10 mass % relative to the total mass of the binder resin and the metal oxide particles in the dispersion. A silicone oil (trade name: SH28PA produced by Dow Corning Toray Co., Ltd.) serving as a leveling agent was added to the dispersion so that the amount of the silicone oil was 0.01 mass % relative to the total mass of the metal oxide particles and the binder resin in the dispersion. The resulting mixture was stirred to prepare a coating solution for a conductive layer. The coating solution for a conductive layer was applied to a support by dip coating and the resulting coating film was dried and thermally cured at 150° C. for 30 minutes. As a result, a conductive layer having a thickness of 30 μm was obtained.

Then a coating solution for an undercoat layer was prepared as in Example 1 except that the electron transporting substance and the isocyanate compound were changed as shown in Table 17, an acetal resin (trade name: KS-5 produced by Sekisui Chemical Co., Ltd.) was added as the resin, and 0.031 parts of zinc(II) octylate was added as a catalyst. The coating solution for an undercoat layer was applied to the conductive layer to form a coating film, and the coating film was polymerized (cured) by being heated at 160° C. for 30 minutes. As a result, an undercoat layer having a thickness of 0.5 μm was obtained.

A charge generating layer was prepared as in Example 1.

Preparation of a coating solution for a charge transporting layer was changed as follows. In a mixed solvent containing 30 parts of dimethoxymethane and 50 parts of ortho-xylene, 9 parts of a charge transporting substance having a structure represented by formula (15) above, 1 part of a charge transporting substance having a structure represented by formula (18) below, 3 parts of a polyester resin F (weight-average molecular weight: 90,000) constituted by a repeating structural unit represented by (24) below, a repeating structural unit represented by formula (26) below, and a repeating structural unit represented by formula (25) below, with a (26)/(25) ratio being 7/3, and 7 parts of a polyester resin H (weight-average molecular weight: 120,000) constituted by a repeating structural unit represented by formula (27) below and a repeating structural unit represented by formula (28) below at a 5/5 ratio were dissolved to prepare a coating solution for a charge transporting layer. In the polyester resin F, the content of the repeating structural unit represented by formula (24) was 10 mass % and the content of the repeating structural units represented by formulae (25) and (26) below was 90 mass %.

The coating solution for a charge transporting layer was applied to the charge generating layer by dip coating and dried at 120° C. for 1 hour to form a charge transporting layer having a thickness of 16 μm. The charge transporting layer obtained was confirmed to contain a domain structure containing the polyester resin F in the matrix that contains the polyester resin H and the charge transporting substance.

(18)

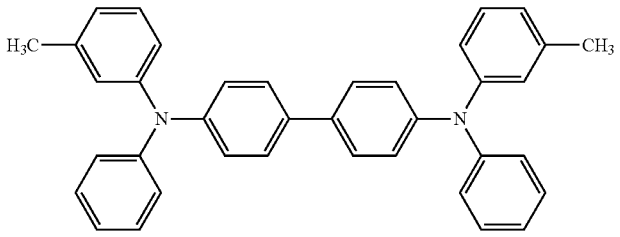

(24)

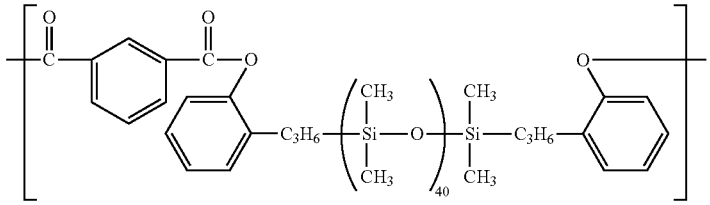

-continued (25)

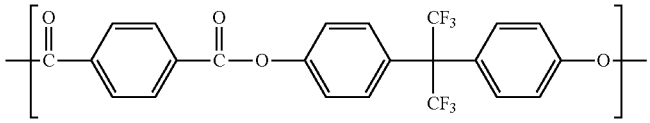

(26)

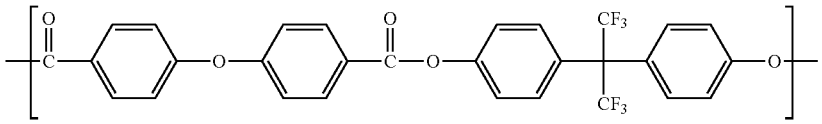

(27)

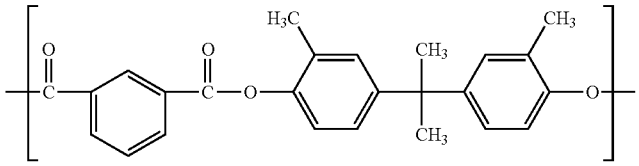

(28)

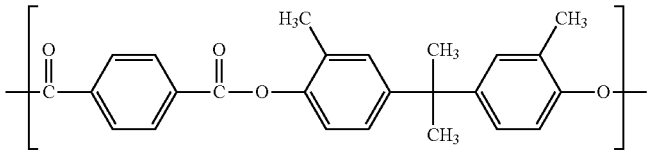

Examples 92 to 111

Electrophotographic photosensitive members were prepared as in Example 91 except that the electron transporting substance, the isocyanate compound, and the resin were changed as shown in Table 17. Evaluation was conducted as in Example 91. The results are shown in Table 16.

Example 112

An electrophotographic photosensitive member was prepared as in Example 93 except that preparation of the coating solution for a charge transporting layer was changed as follows. Evaluation was conducted as in Example 93. The results are shown in Table 17.

Preparation of the coating solution for a charge transporting layer was changed as follows. In a mixed solvent containing 30 parts of dimethoxymethane and 50 parts of orthoxylene, 9 parts of a charge transporting substance having a structure represented by formula (15) above, 1 part of a charge-transporting substance having a structure represented by formula (18) above, 10 parts of a polycarbonate resin I (weight-average molecular weight: 70,000) constituted by a repeating structural unit represented by formula (29) below, and 0.3 parts of a polycarbonate resin J (weight-average molecular weight: 40,000) having a repeating structure represented by formula (29) below and a repeating structure represented by formula (30) below and having a structure represented by formula (31) below in at least one of the termini were dissolved to prepare a coating solution for a charge transporting layer. The total mass of the structures represented by formulae (30) and (31) in the polycarbonate resin J was 30 mass %.

The coating solution for a charge transporting layer was applied to the charge generating layer by dip coating and dried at 120° C. for 1 hour to obtain a charge transporting layer having a thickness of 16 μm.

(29)

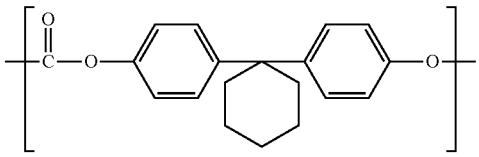

(30)

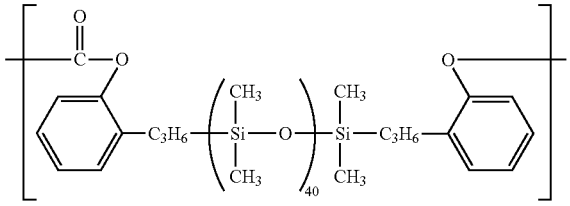

(31)

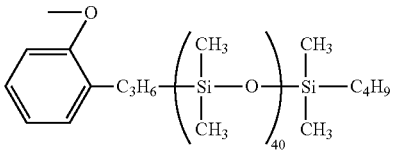

Example 113

An electrophotographic photosensitive member was prepared as in Example 112 except that, in preparing a coating solution for a charge transporting layer, 10 parts of a polyester resin H (weight-average molecular weight: 120,000) was used instead of 10 parts of the polycarbonate resin I (weight-average molecular weight: 70,000). Evaluation was conducted as in Example 112. The results are shown in Table 17.

Example 114

An electrophotographic photosensitive member was prepared as in Example 93 except that preparation of the coating solution for a conductive layer was changed as follows. Evaluation was conducted as in Example 93. The results are shown in Table 17.

Preparation of the coating solution for a conductive layer was changed as follows. In a sand mill containing 450 parts of glass beads 0.8 mm in diameter, 207 parts of titanium oxide ($TiO_2$) particles coated with phosphorus (P)-doped tin oxide ($SnO_2$) serving as metal oxide particles, 144 parts of a phenolic resin (trade name: PLYOPHEN J-325) serving as the binder resin, and 98 parts of 1-methoxy-2-propanol serving as a solvent were placed and a dispersion treatment was conducted at a rotation rate of 2000 rpm, a dispersion treatment time of 4.5 hours, and a cooling water set temperature of 18° C. so as to obtain a dispersion. The glass beads were removed from the dispersion by using a mesh (aperture: 150 μm).

Silicone resin particles (trade name: Tospearl 120) serving as a surface roughness imparter were added to the dispersion after the removal of the glass beads so that the amount of the silicone resin particles was 15 mass % relative to the total mass of the binder resin and the metal oxide particles in the dispersion. A silicone oil (trade name: SH28PA) serving as a leveling agent was added to the dispersion so that the amount of the silicone oil was 0.01 mass % relative to the total mass of the metal oxide particles and the binder resin in the dispersion. The resulting mixture was stirred to prepare a coating solution for a conductive layer. The coating solution for a conductive layer was applied to a support by dip coating and the resulting coating film was dried and thermally cured at 150° C. for 30 minutes. As a result, a conductive layer having a thickness of 30 μm was obtained.

Example 115

An electrophotographic photosensitive member was prepared as in Example 112 except that preparation of the coating solution for a conductive layer was changed as follows. Evaluation was conducted as in Example 112. The results are shown in Table 17.

Preparation of the coating solution for a conductive layer was changed as follows. In a sand mill containing 450 parts of glass beads 0.8 mm in diameter, 207 parts of titanium oxide ($TiO_2$) particles coated with phosphorus (P)-doped tin oxide ($SnO_2$) serving as metal oxide particles, 144 parts of a phenolic resin (monomer/oligomer of a phenolic resin) (trade name: PLYOPHEN J-325 produced by DIC Corporation, resin solid content: 60%)) serving as the binder resin, and 98 parts of 1-methoxy-2-propanol serving as a solvent were placed and a dispersion treatment was conducted at a rotation rate of 2000 rpm, a dispersion treatment time of 4.5 hours, and a cooling water set temperature of 18° C. so as to obtain a dispersion.

The glass beads were removed from the dispersion by using a mesh (aperture: 150 μm).

Silicone resin particles (trade name: Tospearl 120 produced by Momentive Performance Materials Inc., average particle diameter: 2 μm) serving as a surface roughness imparter were added to the dispersion after the removal of the glass beads so that the amount of the silicone resin particles was 15 mass % relative to the total mass of the binder resin and the metal oxide particles in the dispersion. A silicone oil (trade name: SH28PA produced by Dow Corning Toray Co., Ltd.) serving as a leveling agent was added to the dispersion so that the amount of the silicone oil was 0.01 mass % relative to the total mass of the metal oxide particles and the binder resin in the dispersion. The resulting mixture was stirred to prepare a coating solution for a conductive layer. The coating solution for a conductive layer was applied to a support by dip coating and the resulting coating film was dried and thermally cured at 150° C. for 30 minutes. As a result, a conductive layer having a thickness of 30 μm was obtained.

Example 116

An electrophotographic photosensitive member was prepared as in Example 113 except that preparation of the coating solution for a conductive layer was changed as follows. Evaluation was conducted as in Example 113. The results are shown in Table 17.

Preparation of the coating solution for a conductive layer was changed as follows. In a sand mill containing 450 parts of glass beads 0.8 mm in diameter, 207 parts of titanium oxide ($TiO_2$) particles coated with phosphorus (P)-doped tin oxide ($SnO_2$) serving as metal oxide particles, 144 parts of a phenolic resin (trade name: PLYOPHEN J-325) serving as the binder resin, and 98 parts of 1-methoxy-2-propanol serving as a solvent were placed and a dispersion treatment was conducted at a rotation rate of 2000 rpm, a dispersion treatment time of 4.5 hours, and a cooling water set temperature of 18° C. so as to obtain a dispersion. The glass beads were removed from the dispersion by using a mesh (aperture: 150 μm).

Silicone resin particles (trade name: Tospearl 120) serving as a surface roughness imparter were added to the dispersion after the removal of the glass beads so that the amount of the silicone resin particles was 15 mass % relative to the total mass of the phenolic resin and the metal oxide particles in the dispersion. A silicone oil (trade name: SH28PA) serving as a leveling agent was added to the dispersion so that the amount of the silicone oil was 0.01 mass % relative to the total mass of the metal oxide particles and the phenolic resin in the dispersion. The resulting mixture was stirred to prepare a coating solution for a conductive layer. The coating solution for a conductive layer was applied to a support by dip coating and the resulting coating film was dried and thermally cured at 150° C. for 30 minutes. As a result, a conductive layer having a thickness of 30 μm was obtained.

Comparative Example 1

An electrophotographic photosensitive member was prepared as in Example 1 except that a compound represented by formula (C-1) below was used as the electron transporting substance and a compound represented by (1-1) was used as the isocyanate compound (crosslinking agent). Evaluation was conducted as in Example 1. The results are shown in Table 18. The number of main-chain atoms of the structure corresponding to $D^1$ in the structure represented by formula (1) was 4.

(C-1)

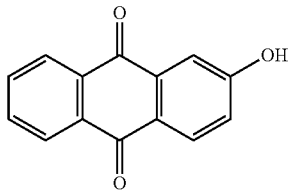

Comparative Example 2

An electrophotographic photosensitive member was prepared as in Example 1 except that a compound represented by formula (C-2) below was used as the electron transporting substance and a compound represented by (1-1) was used as the isocyanate compound (crosslinking agent). Evaluation was conducted as in Example 1. The results are shown in Table 18. The number of main-chain atoms of the structure corresponding to $D^1$ in the structure represented by formula (1) was 4.

(C-2)

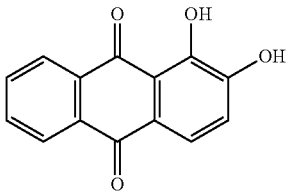

Comparative Example 3

An electrophotographic photosensitive member was prepared as in Example 1 except that a block copolymer having a structure represented by formula below disclosed in PCT Japanese Translation Patent Publication No. 2009-505156 was used as an electron transporting substance to form an undercoat layer:

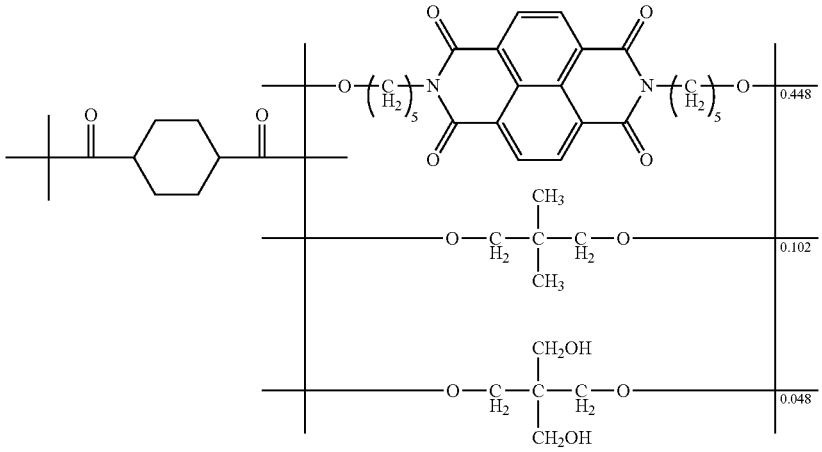

Evaluation was conducted as in Example 1. The results are shown in Table 18. The number of main-chain atoms of the structure corresponding to $D^1$ in the structure represented by formula (1) was 25.

Comparative Example 4

An electrophotographic photosensitive member was prepared as in Example 1 except that hexamethylene diisocyanate and a compound (11) below were used to form an undercoat layer (configuration of Example 1 disclosed in Japanese Patent Laid-Open No. 2007-148293):

(11)

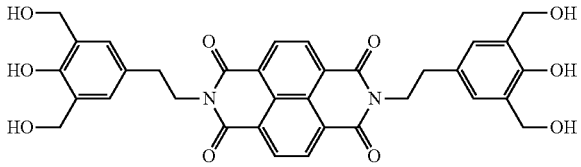

Evaluation was conducted as in Example 1. The results are shown in Table 18.

Dissolution Test

The coating solutions for an undercoat layer prepared in Examples 1 to 116 were each evenly applied in an amount of 0.5 g to an aluminum sheet by a wire bar technique to form a coating film. The coating film was polymerized (cured) by being heated at 160° C. for 30 minutes to prepare a sample. A 100 mm×50 mm specimen was taken from the center portion of the sample and immersed in an anone/ethyl acetate mixture (weight ratio=1:1) at a temperature of 20° C. for 10 minutes. The initial weight of the specimen before immersion and the weight after immersion were measured. A coating film formed on the sample was scraped off and the weight of the aluminum sheet was measured. The percentage decrease (dissolved amount, %) in weight after immersion was determined by the following equation:

Percentage decrease in weight after immersion (%)= (initial weight−weight after immersion)/initial weight−weight of aluminum sheet))×100

The samples were evaluated as having sparingly dissolvable undercoat layers when the percentage decrease in weight after immersion was 5% or less. As a result, the undercoat layers formed in Examples 1 to 116 all exhibited a percentage decrease in weight after immersion of 5% or less and were sparingly dissolvable.

TABLE 15

| Example | Example structure | Electron transporting substance | Isocyanate compound | Electron transporting substance content (parts by mass) | Isocyanate compound content (parts by mass) | Resin (parts by mass) | Macbeth density difference Initial | Macbeth density difference After 5000 printouts | Potential fluctuation | Number of main-chain atoms in $D^1$ |
|---|---|---|---|---|---|---|---|---|---|---|
| 1 | 101 | E-1-1 | I-8 | 3.27 | 6.20 | 1.29 | 0.025 | 0.028 | 12 | 11 |
| 2 | 101 | E-1-1 | I-8 | 2.44 | 6.43 | 2.02 | 0.031 | 0.038 | 16 | 11 |
| 3 | 101 | E-1-1 | I-8 | 4.14 | 6.05 | 0.56 | 0.022 | 0.028 | 5 | 11 |
| 4 | 101 | E-1-1 | I-8 | 5.38 | 4.21 | 1.11 | 0.020 | 0.031 | 5 | 11 |
| 5 | 101 | E-1-1 | I-8 | 3.48 | 4.52 | 2.78 | 0.026 | 0.039 | 6 | 11 |
| 6 | 101 | E-1-1 | I-8 | 3.35 | 5.52 | 1.9 | 0.027 | 0.042 | 5 | 11 |
| 7 | 101 | E-1-1 | I-8 | 3.23 | 6.74 | 0.85 | 0.028 | 0.039 | 5 | 11 |
| 8 | 101 | E-1-1 | I-9 | 3.27 | 7.98 | 1.29 | 0.039 | 0.049 | 5 | 11 |
| 9 | 101 | E-1-1 | I-10 | 3.27 | 6.42 | 1.29 | 0.030 | 0.044 | 11 | 11 |
| 10 | 101 | E-1-1 | I-11 | 3.27 | 5.77 | 1.29 | 0.035 | 0.043 | 9 | 11 |
| 11 | 101 | E-1-1 | I-8 | 3.27 | 6.20 | 1.29 | 0.038 | 0.049 | 14 | 11 |
| 12 | 101 | E-1-1 | I-8 | 3.27 | 6.20 | 1.29 | 0.039 | 0.043 | 19 | 11 |
| 13 | 101 | E-1-1 | I-8 | 3.27 | 6.20 | 1.29 | 0.031 | 0.042 | 18 | 11 |
| 14 | 119 | E-1-17 | I-8 | 3.98 | 6.20 | 1.29 | 0.042 | 0.048 | 21 | 14 |
| 15 | 105 | E-1-8 | I-8 | 3.60 | 6.20 | 1.29 | 0.028 | 0.035 | 11 | 11 |
| 16 | 115 | E-1-8 | I-1 | 3.60 | 2.38 | 1.29 | 0.044 | 0.044 | 11 | 6 |
| 17 | 105 | E-1-8 | I-2 | 3.60 | 4.09 | 1.29 | 0.027 | 0.030 | 12 | 11 |
| 18 | 105 | E-1-8 | I-7 | 3.60 | 6.84 | 1.29 | 0.038 | 0.038 | 9 | 11 |
| 19 | 105 | E-1-8 | I-9 | 3.60 | 7.98 | 1.29 | 0.026 | 0.026 | 9 | 11 |
| 20 | 105 | E-1-8 | I-10 | 3.60 | 6.42 | 1.29 | 0.041 | 0.053 | 13 | 11 |
| 21 | 105 | E-1-8 | I-11 | 3.60 | 5.77 | 1.29 | 0.029 | 0.036 | 13 | 11 |
| 22 | 105 | E-1-8 | I-12 | 3.60 | 6.54 | 1.29 | 0.034 | 0.046 | 6 | 11 |
| 23 | 106 | E-1-13 | I-8 | 3.74 | 6.20 | 1.29 | 0.032 | 0.040 | 8 | 11 |
| 24 | 106 | E-1-13 | I-8 | 2.79 | 6.43 | 2.02 | 0.035 | 0.050 | 17 | 11 |
| 25 | 106 | E-1-13 | I-8 | 4.73 | 6.05 | 0.56 | 0.030 | 0.038 | 5 | 11 |
| 26 | 106 | E-1-13 | I-8 | 6.15 | 4.21 | 1.11 | 0.028 | 0.031 | 5 | 11 |
| 27 | 106 | E-1-13 | I-8 | 3.97 | 4.52 | 2.78 | 0.035 | 0.049 | 14 | 11 |
| 28 | 106 | E-1-13 | I-8 | 3.83 | 5.52 | 1.9 | 0.035 | 0.042 | 11 | 11 |
| 29 | 106 | E-1-13 | I-8 | 3.69 | 6.74 | 0.85 | 0.035 | 0.036 | 5 | 11 |
| 30 | 116 | E-1-20 | I-8 | 3.27 | 6.20 | 1.29 | 0.038 | 0.047 | 15 | 5 |
| 31 | 117 | E-1-17 | I-8 | 3.98 | 6.20 | 1.29 | 0.040 | 0.049 | 6 | 14 |
| 32 | 113 | E-1-15 | I-8 | 3.99 | 6.20 | 1.29 | 0.031 | 0.038 | 5 | 15 |
| 33 | 121 | E-1-21 | I-8 | 3.23 | 7.66 | 0.028 | 0.045 | 0.055 | 9 | 11 |
| 34 | 122 | E-1-22 | I-8 | 3.08 | 7.66 | 0.028 | 0.044 | 0.054 | 7 | 11 |
| 35 | 205 | E-2-4 | I-8 | 3.43 | 6.20 | 1.29 | 0.030 | 0.043 | 6 | 15 |
| 36 | 205 | E-2-4 | I-8 | 2.56 | 6.43 | 2.02 | 0.035 | 0.043 | 19 | 15 |
| 37 | 205 | E-2-4 | I-8 | 4.34 | 6.05 | 0.56 | 0.028 | 0.032 | 5 | 15 |
| 38 | 205 | E-2-4 | I-8 | 5.64 | 4.21 | 1.11 | 0.027 | 0.042 | 5 | 15 |
| 39 | 205 | E-2-4 | I-8 | 3.65 | 4.52 | 2.78 | 0.036 | 0.046 | 8 | 15 |
| 40 | 205 | E-2-4 | I-8 | 3.52 | 5.52 | 1.9 | 0.034 | 0.042 | 13 | 15 |
| 41 | 205 | E-2-4 | I-8 | 3.39 | 6.74 | 0.85 | 0.034 | 0.047 | 10 | 15 |
| 42 | 207 | E-2-6 | I-8 | 3.31 | 6.20 | 1.29 | 0.036 | 0.047 | 12 | 15 |
| 43 | 301 | E-3-1 | I-8 | 1.48 | 6.43 | 2.02 | 0.027 | 0.030 | 15 | 13 |
| 44 | 401 | E-4-1 | I-8 | 3.42 | 6.05 | 0.56 | 0.041 | 0.054 | 6 | 13 |
| 45 | 501 | E-5-1 | I-8 | 4.45 | 4.21 | 1.11 | 0.032 | 0.036 | 7 | 13 |
| 46 | 601 | E-6-1 | I-8 | 2.87 | 4.52 | 2.78 | 0.040 | 0.047 | 11 | 13 |
| 47 | 703 | E-7-5 | I-8 | 2.76 | 7.66 | 0.028 | 0.032 | 0.037 | 12 | 13 |
| 48 | 801 | E-8-2 | I-8 | 1.97 | 6.74 | 0.85 | 0.045 | 0.050 | 8 | 11 |
| 49 | 901 | E-9-1 | I-8 | 2.22 | 7.66 | 0.028 | 0.034 | 0.034 | 14 | 11 |
| 50 | 902 | E-9-3 | I-8 | 2.94 | 7.66 | 0.028 | 0.030 | 0.042 | 7 | 14 |

TABLE 16

| Example | Example structure | Electron transporting substance | Isocyanate compound | Electron transporting substance content (parts by mass) | Isocyanate compound content (parts by mass) | Resin (parts by mass) | Macbeth density difference Initial | Macbeth density difference After 5000 printouts | Potential fluctuation | Number of main-chain atoms in $D^1$ |
|---|---|---|---|---|---|---|---|---|---|---|
| 51 | 1001 | E-10-1 | I-8 | 2.22 | 7.66 | 0.028 | 0.034 | 0.042 | 5 | 11 |
| 52 | 1002 | E-10-3 | I-8 | 2.94 | 7.66 | 0.028 | 0.043 | 0.056 | 13 | 14 |
| 53 | 1101 | E-11-1 | I-8 | 1.88 | 6.20 | 1.29 | 0.038 | 0.043 | 12 | 10 |
| 54 | 1101 | E-11-1 | I-8 | 1.40 | 6.43 | 2.02 | 0.040 | 0.049 | 15 | 10 |
| 55 | 1101 | E-11-1 | I-8 | 2.38 | 6.05 | 0.56 | 0.036 | 0.043 | 8 | 10 |
| 56 | 1101 | E-11-1 | I-8 | 3.09 | 4.21 | 1.11 | 0.034 | 0.036 | 14 | 10 |
| 57 | 1101 | E-11-1 | I-8 | 2.00 | 4.52 | 2.78 | 0.039 | 0.049 | 5 | 10 |
| 58 | 1101 | E-11-1 | I-8 | 1.93 | 5.52 | 1.9 | 0.040 | 0.051 | 6 | 10 |
| 59 | 1101 | E-11-1 | I-8 | 1.86 | 6.74 | 0.85 | 0.040 | 0.053 | 7 | 10 |
| 60 | 1102 | E-11-1 | I-1 | 1.88 | 2.38 | 1.29 | 0.030 | 0.040 | 14 | 5 |

TABLE 16-continued

| Example | Example structure | Electron transporting substance | Isocyanate compound | Electron transporting substance content (parts by mass) | Isocyanate compound content (parts by mass) | Resin (parts by mass) | Macbeth density difference Initial | Macbeth density difference After 5000 printouts | Potential fluctuation | Number of main-chain atoms in $D^1$ |
|---|---|---|---|---|---|---|---|---|---|---|
| 61 | 1102 | E-11-1 | I-1 | 1.40 | 2.47 | 2.02 | 0.035 | 0.042 | 12 | 5 |
| 62 | 1102 | E-11-1 | I-1 | 2.38 | 2.32 | 0.56 | 0.028 | 0.038 | 14 | 5 |
| 63 | 1102 | E-11-1 | I-1 | 3.09 | 1.62 | 1.11 | 0.025 | 0.038 | 10 | 5 |
| 64 | 1102 | E-11-1 | I-1 | 2.00 | 1.73 | 2.78 | 0.032 | 0.034 | 15 | 5 |
| 65 | 1102 | E-11-1 | I-1 | 1.93 | 2.12 | 1.9 | 0.033 | 0.037 | 10 | 5 |
| 66 | 1102 | E-11-1 | I-1 | 1.86 | 2.59 | 0.85 | 0.032 | 0.046 | 9 | 5 |
| 67 | 1103 | E-11-1 | I-3 | 1.88 | 3.89 | 1.29 | 0.035 | 0.039 | 12 | 8 |
| 68 | 1103 | E-11-1 | I-3 | 1.40 | 4.03 | 2.02 | 0.040 | 0.048 | 5 | 8 |
| 69 | 1103 | E-11-1 | I-3 | 2.38 | 3.79 | 0.56 | 0.032 | 0.042 | 12 | 8 |
| 70 | 1103 | E-11-1 | I-3 | 3.09 | 2.64 | 1.11 | 0.030 | 0.032 | 15 | 8 |
| 71 | 1103 | E-11-1 | I-3 | 2.00 | 2.83 | 2.78 | 0.041 | 0.049 | 10 | 8 |
| 72 | 1103 | E-11-1 | I-3 | 1.93 | 3.46 | 1.9 | 0.040 | 0.055 | 12 | 8 |
| 73 | 1103 | E-11-1 | I-3 | 1.86 | 4.22 | 0.85 | 0.040 | 0.045 | 9 | 8 |
| 74 | 1107 | E-11-6 | I-8 | 3.05 | 6.20 | 1.29 | 0.040 | 0.046 | 8 | 13 |
| 75 | 1108 | E-11-7 | I-8 | 2.37 | 6.20 | 1.29 | 0.040 | 0.053 | 12 | 14 |
| 76 | 1109 | E-11-8 | I-8 | 2.48 | 6.20 | 1.29 | 0.036 | 0.041 | 12 | 13 |
| 77 | 1110 | E-11-9 | I-8 | 2.36 | 6.20 | 1.29 | 0.043 | 0.053 | 13 | 13 |
| 78 | 1201 | E-12-1 | I-8 | 2.22 | 7.66 | 0.028 | 0.045 | 0.050 | 9 | 11 |
| 79 | 1301 | E-13-1 | I-8 | 2.22 | 7.66 | 0.028 | 0.043 | 0.044 | 12 | 11 |
| 80 | 1401 | E-14-1 | I-8 | 2.37 | 6.20 | 1.29 | 0.034 | 0.038 | 13 | 13 |
| 81 | 1501 | E-15-1 | I-8 | 2.37 | 6.20 | 1.29 | 0.043 | 0.048 | 9 | 13 |
| 82 | 1503 | E-15-6 | I-8 | 3.30 | 7.66 | 0.028 | 0.035 | 0.039 | 6 | 13 |
| 83 | 1601 | E-16-1 | I-8 | 2.39 | 6.20 | 1.29 | 0.034 | 0.045 | 12 | 13 |
| 84 | 1701 | E-17-1 | I-8 | 2.39 | 6.20 | 1.29 | 0.035 | 0.047 | 11 | 13 |
| 85 | 1703 | E-18-6 | I-8 | 3.32 | 7.66 | 0.028 | 0.035 | 0.048 | 9 | 13 |
| 86 | 132 | E-1-28 | I-8 | 3.71 | 6.20 | 1.29 | 0.045 | 0.048 | 9 | 14 |
| 87 | 133 | E-1-34 | I-8 | 4.23 | 6.20 | 1.29 | 0.035 | 0.039 | 6 | 11 |
| 88 | 211 | E-2-16 | I-8 | 2.65 | 6.20 | 1.29 | 0.034 | 0.045 | 12 | 14 |
| 89 | 212 | E-2-31 | I-8 | 3.31 | 6.20 | 1.29 | 0.035 | 0.047 | 11 | 13 |
| 90 | 1901 | E-19-5 | I-8 | 2.64 | 6.20 | 1.29 | 0.035 | 0.048 | 10 | 13 |

TABLE 17

| Example | Example structure | Electron transporting substance | Isocyanate compound | Electron transporting substance content (parts by mass) | Isocyanate compound content (parts by mass) | Resin (parts by mass) | Macbeth density difference Initial | Macbeth density difference After 5000 printouts | Potential fluctuation | Number of main-chain atoms in $D^1$ |
|---|---|---|---|---|---|---|---|---|---|---|
| 91 | 2001 | E-1-35 | I-10 | 2.86 | 4.28 | 1.55 | 0.025 | 0.028 | 10 | 11 |
| 92 | 2001 | E-1-35 | I-10 | 2.17 | 4.10 | 2.43 | 0.030 | 0.038 | 10 | 11 |
| 93 | 2001 | E-1-35 | I-10 | 3.54 | 4.47 | 0.68 | 0.022 | 0.025 | 8 | 11 |
| 94 | 2001 | E-1-35 | I-10 | 3.88 | 4.56 | 0.26 | 0.020 | 0.025 | 5 | 11 |
| 95 | 2001 | E-1-35 | I-10 | 3.64 | 3.96 | 1.15 | 0.022 | 0.025 | 8 | 11 |
| 96 | 2001 | E-1-35 | I-10 | 3.46 | 4.94 | 0.30 | 0.022 | 0.025 | 8 | 11 |
| 97 | 2001 | E-1-35 | I-10 | 3.42 | 5.14 | 0.13 | 0.022 | 0.025 | 8 | 11 |
| 98 | 2002 | E-1-36 | I-10 | 2.86 | 4.27 | 1.56 | 0.024 | 0.027 | 12 | 14 |
| 99 | 2002 | E-1-36 | I-10 | 2.17 | 4.08 | 2.44 | 0.031 | 0.038 | 12 | 14 |
| 100 | 2002 | E-1-36 | I-10 | 3.55 | 4.45 | 0.7 | 0.020 | 0.023 | 8 | 14 |
| 101 | 2002 | E-1-36 | I-10 | 3.88 | 4.54 | 0.27 | 0.018 | 0.023 | 5 | 14 |
| 102 | 2002 | E-1-36 | I-10 | 3.65 | 3.90 | 1.15 | 0.020 | 0.025 | 8 | 14 |
| 103 | 2002 | E-1-36 | I-10 | 3.46 | 4.92 | 0.32 | 0.020 | 0.025 | 8 | 14 |
| 104 | 2002 | E-1-36 | I-10 | 3.43 | 5.12 | 0.15 | 0.020 | 0.025 | 8 | 14 |
| 105 | 2003 | E-1-37 | I-10 | 2.85 | 4.34 | 1.5 | 0.024 | 0.027 | 12 | 14 |
| 106 | 2003 | E-1-37 | I-10 | 2.16 | 4.14 | 2.4 | 0.031 | 0.038 | 12 | 14 |
| 107 | 2003 | E-1-37 | I-10 | 3.53 | 4.53 | 0.63 | 0.020 | 0.023 | 10 | 14 |
| 108 | 2003 | E-1-37 | I-10 | 3.87 | 4.63 | 0.2 | 0.018 | 0.022 | 8 | 14 |
| 109 | 2003 | E-1-37 | I-10 | 3.63 | 3.97 | 1.09 | 0.020 | 0.026 | 10 | 14 |
| 110 | 2003 | E-1-37 | I-10 | 3.45 | 5.01 | 0.24 | 0.020 | 0.026 | 10 | 14 |
| 111 | 2003 | E-1-37 | I-10 | 3.41 | 5.22 | 0.07 | 0.020 | 0.027 | 10 | 14 |
| 112 | 2001 | E-1-35 | I-10 | 3.54 | 4.47 | 0.68 | 0.022 | 0.025 | 8 | 11 |
| 113 | 2001 | E-1-35 | I-10 | 3.54 | 4.47 | 0.68 | 0.022 | 0.025 | 8 | 11 |
| 114 | 2001 | E-1-35 | I-10 | 3.54 | 4.47 | 0.68 | 0.022 | 0.025 | 8 | 11 |
| 115 | 2001 | E-1-35 | I-10 | 3.54 | 4.47 | 0.68 | 0.022 | 0.025 | 8 | 11 |
| 116 | 2001 | E-1-35 | I-10 | 3.54 | 4.47 | 0.68 | 0.022 | 0.025 | 8 | 11 |

In Tables 15, 16, and 17, "Electron transporting substance content" means the content of the electron transporting substance in the coating solution for an undercoat layer, "Isocyanate compound content" means the content of the isocyanate compound in the coating solution for an undercoat layer, and "Resin (parts by mass)" means the content (parts by mass) of the resin in the coating solution for an undercoat layer.

TABLE 18

| Comparative Example | Macbeth density difference Initial | Macbeth density difference After 5000 printouts | Potential fluctuation |
|---|---|---|---|
| 1 | 0.039 | 0.078 | 38 |
| 2 | 0.045 | 0.077 | 35 |
| 3 | 0.058 | 0.088 | 40 |
| 4 | 0.048 | 0.079 | 38 |

Example 60 and Comparative Examples 1 and 2 show that when the number of main-chain atoms in D1 in the structure represented by formula (1) is less than 5, the effect of suppressing positive ghosting fluctuation cannot be sufficiently obtained. This is apparent from the fact that the change in Macbeth density between the initial stage and after the repeated use of making 5000 printouts in the evaluation method employed here is larger in Comparative Examples than in Example. The reason for this is presumably as follows. When the number of main-chain atoms in $D^1$ is less than 5, the bonding distance between the urethane bond and the electron transporting structure is small and thus hydrolysis occurred by repeated use and the number of charge traps is increased.

Example 13 and Comparative Example 3 show that when the number of main-chain atoms in $D^1$ in the structure represented by formula (1) is greater than 15, the effect of suppressing positive ghosting fluctuation cannot be sufficiently obtained. This is apparent from the fact that the change in Macbeth density between the initial stage and after repeated use of making 5000 printouts was larger in Comparative Example than in Example. This is presumably due to the following reason. When the number of main-chain atoms in $D^1$ is greater than 15, the interaction between the isocyanurate structure portion and the naphthalene carboxylic anhydride structure serving as an electron transporting structure in Comparative Example 3 does not easily occur and the conduction level becomes inhomogeneous, resulting in deterioration of the electron transporting structure and the increase in number of charge traps.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-147155 filed Jun. 29, 2012, No. 2013-118068 filed Jun. 4, 2013, and No. 2013-093091 filed Apr. 25, 2013, which are hereby incorporated by reference herein in their entirety.

What is claimed is:

1. An electrophotographic photosensitive member, comprising:

a support;

an undercoat layer formed on the support; and a photosensitive layer formed on the undercoat layer;

wherein the undercoat layer comprises a cured product having a structure represented by formula (1) below (1)

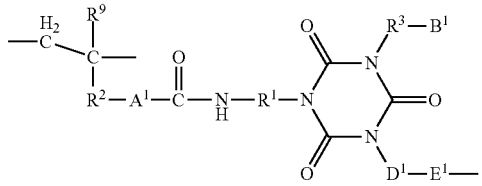

where, in formula (1), $R^1$ and $R^3$ each independently represent a substituted or unsubstituted alkylene group having 1 to 10 main-chain atoms or a substituted or unsubstituted phenylene group, $R^2$ represents a single bond, a substituted or unsubstituted alkylene group having 1 to 10 main-chain atoms, or a substituted or unsubstituted phenylene group, a substituent of the substituted alkylene group is an alkyl group, an aryl group, a hydroxy group, or a halogen atom, a substituent of the substituted phenylene group is a halogen atom, a nitro group, a cyano group, a hydroxy group, an alkyl group, or a halogenated alkyl group, $R^9$ represents a hydrogen atom or an alkyl group, $A^1$ represents a group represented by any one of formulae (A-1) to (A-6) below, $B^1$ represents a group represented by any one of formulae (B-1) to (B-3) below, $D^1$ represents a group having 5 to 15 main-chain atoms and being represented by formula (D) below, and $E^1$ represents a divalent group represented by any one of formulae (E-1) to (E-8) below:

(A-1)

(A-2)

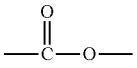

(A-3)

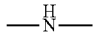

(A-4)

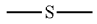

(A-5)

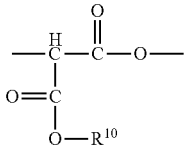

(A-6)

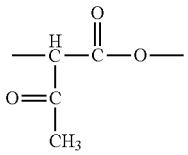

where, in formula (A-5), $R^{10}$ represents a hydrogen atom or an alkyl group;

(B-1)

(B-2)

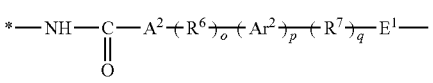

-continued (B-3)

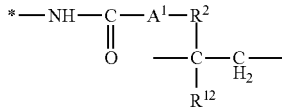

where, in formulae (B-1) to (B-3), $R^2$ represents a single bond, a substituted or unsubstituted alkylene group having 1 to 10 main-chain atoms or a substituted or unsubstituted phenylene group, $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group, one of the carbon atoms in the main chain of the alkylene group may be replaced with O, S, NH, or $NR^{15}$, $R^{15}$ representing an alkyl group, $Ar^2$ represents a substituted or unsubstituted phenylene group, a substituent of the substituted phenylene group is a halogen atom, a nitro group, a hydroxy group, a cyano group, an alkyl group, or a halogenated alkyl group, $R^{12}$ represents a hydrogen atom or an alkyl group, $A^1$ and $A^2$ each represent a group represented by any one of formulae (A-1) to (A-6) above, o, p and q each independently represent 0 or 1 and a sum of o, p and q is 1 to 3, and

* represents a side in which $R^3$ of formula (1) is bonded;

(D)

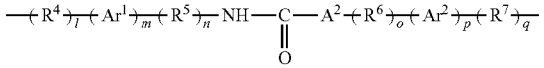

where, in formula (D), $R^4$, $R^5$, $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group, one of the carbon atoms in the main chain of the alkylene group may be replaced with O, S, NH, or $NR^{15}$, $R^{15}$ representing an alkyl group, $Ar^1$ and $Ar^2$ each independently represent a substituted or unsubstituted phenylene group, a substituent of the substituted phenylene group is a halogen atom, a nitro group, a hydroxy group, a cyano group, an alkyl group, or a halogenated alkyl group, $A^2$ represents a group represented by any one of formulae (A-1) to (A-6) above, and l, m, n, o, p and q each independently represent 0 or 1, a sum of l, m and n is 1 to 3, and a sum of o, p and q is 1 to 3; and (E-1)

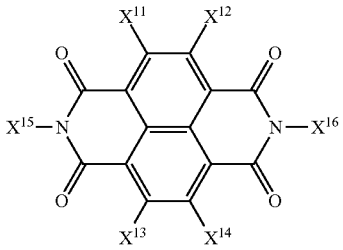

(E-2)

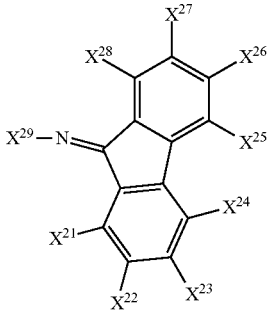

(E-3)

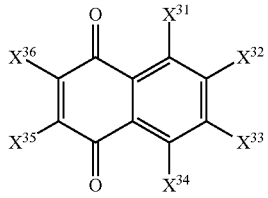

(E-4)

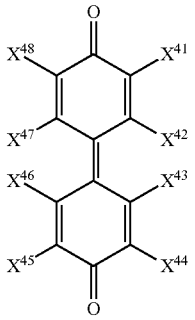

(E-5)

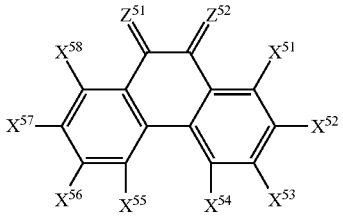

(E-6)

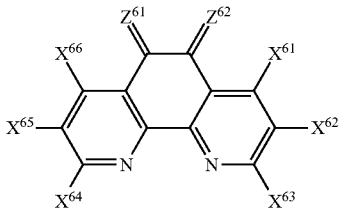

-continued (E-7)

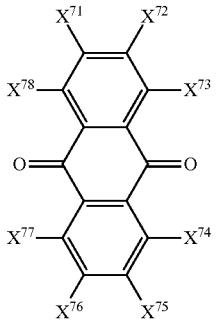

(E-8)

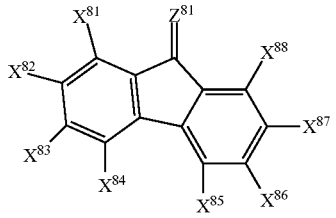

where, in formulae (E-1) to (E-8), two selected from $X^{11}$ to $X^{16}$, two selected from $X^{21}$ to $X^{29}$, two selected from $X^{31}$ to $X^{36}$, two selected from $X^{41}$ to $X^{48}$, two selected from $X^{51}$ to $X^{58}$, two selected from $X^{61}$ to $X^{66}$, two selected from $X^{71}$ to $X^{78}$, and two selected from $X^{81}$ to $X^{88}$ each represent a single bond, the rest of $X^{11}$ to $X^{16}$, $X^{21}$ to $X^{29}$, $X^{31}$ to $X^{36}$, $X^{41}$ to $X^{48}$, $X^{51}$ to $X^{58}$, $X^{61}$ to $X^{66}$, $X^{71}$ to $X^{78}$, and $X^{81}$ to $X^{88}$ each independently represent a hydrogen atom, a halogen atom, an alkoxycarbonyl group, a carboxyl group, a cyano group, a dialkylamino group, a hydroxy group, a heterocyclic group, a nitro group, a substituted or unsubstituted alkoxy group, or a substituted or unsubstituted alkyl group, and $Z^{51}$, $Z^{52}$, $Z^{61}$, $Z^{62}$, and $Z^{81}$ each independently represent an oxygen atom, a $C(CN)_2$ group, or $N—R^{11}$, with $R^{11}$ representing a substituted or unsubstituted aryl group or a substituted or unsubstituted alkyl group.

2. The electrophotographic photosensitive member according to claim 1, wherein the cured product further has a structure represented by formula (2) below, (2)

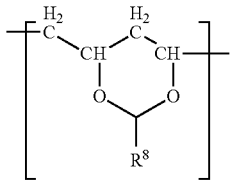

where, in formula (2), $R^8$ represents a substituted or unsubstituted alkyl group having 1 to 5 carbon atoms, and a substituent of the substituted alkyl group is an alkyl group, an aryl group, or a halogen atom.

3. The electrophotographic photosensitive member according to claim 1, wherein $D^1$ represents a group having 10 to 15 main-chain atoms and being represented by the formula (D).

4. The electrophotographic photosensitive member according to claim 1, wherein, in formula (D), $R^4$, $R^5$, $R^6$, and $R^7$ each independently represent an alkylene group having 1 to 5 main-chain atoms and being substituted with a methyl group, an alkylene group having 1 to 5 main-chain atoms and being substituted with an ethyl group, or an alkylene group having 1 to 5 main-chain atoms.

5. The electrophotographic photosensitive member according to claim 1, wherein, in formula (D), $Ar^1$ and $Ar^2$ each represent a phenylene group.

6. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

7. An electrophotographic apparatus comprising:

the electrophotographic photosensitive member according to claim 1;

a charging device;

an exposure device;

a developing device; and a transferring device.

8. An electrophotographic photosensitive member (1), comprising:

a support;

an undercoat layer formed on the support; and a photosensitive layer formed on the undercoat layer;

wherein the undercoat layer comprises a cured product having a structure represented by formula (1) below (1)

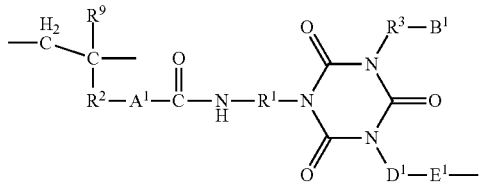

where, in formula (1), $R^1$ and $R^3$ each independently represent a substituted or unsubstituted alkylene group having 1 to 10 main-chain atoms or a substituted or unsubstituted phenylene group, $R^2$ represents a single bond, a substituted or unsubstituted alkylene group having 1 to 10 main-chain atoms, or a substituted or unsubstituted phenylene group, a substituent of the substituted alkylene group is an alkyl group, an aryl group, a hydroxy group, or a halogen atom, a substituent of the substituted phenylene group is a halogen atom, a nitro group, a cyano group, a hydroxy group, an alkyl group, or a halogenated alkyl group, $R^9$ represents a hydrogen atom or an alkyl group, $A^1$ represents a group represented by any one of formulae (A-1) to (A-6) below, $B^1$ represents a group represented by any one of formulae (B-1) to (B-3) below, $D^a$ represents a group having 5 to 15 main-chain atoms and being represented by formula (D) below, and $E^1$ represents a group represented by any one of formulae (E-1) to (E-8) below:

(A-1)

(A-2)

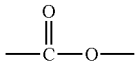

(A-3)

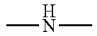

(A-4)

(A-5)

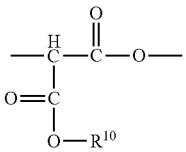

(A-6)

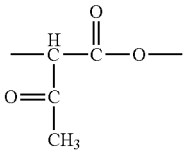

where, in formula (A-5), $R^{10}$ represents a hydrogen atom or an alkyl group;

(B-1)

(B-2)

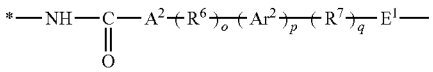

(B-3)

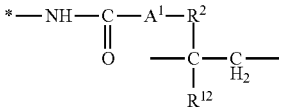

where, in formulae (B-1) to (B-3), $R^2$ represents a single bond, a substituted or unsubstituted alkylene group having 1 to 10 main-chain atoms or a substituted or unsubstituted phenylene group, $R^6$ and $R^7$ each independently represent an alkylene group having 1 to 5main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group, one of the carbon atoms in the main chain of the alkylene group may be replaced with O, S, NH, or $NR^{15}$, $R^{15}$ representing an alkyl group, $Ar^2$ represents a substituted or unsubstituted phenylene group, a substituent of the substituted phenylene group is a halogen atom, a nitro group, a hydroxy group, a cyano group, an alkyl group, or a halogenated alkyl group, $R^{12}$ represents a hydrogen atom or an alkyl group, $A^l$ and $A^2$ each represent a group represented by any one of formulae (A-1) to (A-6) above, o, p and q each independently represent 0 or 1 and a sum of o, p and q is 1 to 3, and represents a side in which $R^3$ of formula (1) is bonded;

(D)

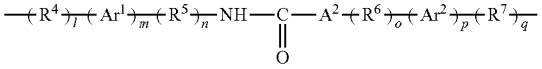

where, in formula (D), $R^4$, $R^5$, $R^6$ and $R^7$ each independently represent an alkylene group having 1 to 5 main-chain atoms, an alkylene group having 1 to 5 main-chain atoms and being substituted with an alkyl group having 1 to 5 carbon atoms, an alkylene group having 1 to 5 main-chain atoms and being substituted with a benzyl group, an alkylene group having 1 to 5 main-chain atoms and being substituted with an alkoxycarbonyl group, or an alkylene group having 1 to 5 main-chain atoms and being substituted with a phenyl group, one of the carbon atoms in the main chain of the alkylene group may be replaced with 0, S, NH, or $NR^{15}$, $R^{15}$ representing an alkyl group, $Ar^1$ and $Ar^2$ each independently represent a substituted or unsubstituted phenylene group, a substituent of the substituted phenylene group is a halogen atom, a nitro group, a hydroxy group, a cyano group, an alkyl group, or a halogenated alkyl group, $A^2$ represents a group represented by any one of formulae (A-1) to (A-6) above, and I, m, n, o, p and q each independently represent 0 or 1, a sum of I, m and n is 1 to 3, and a sum of o, p and q is 1 to 3; and (E-1)

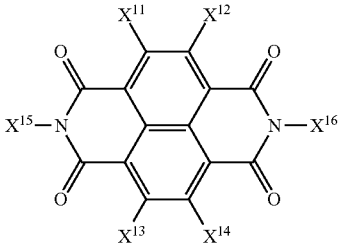

(E-2)

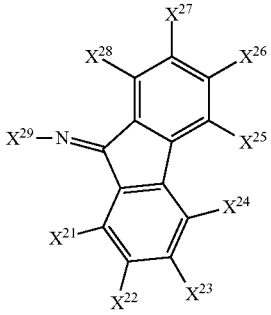

-continued (E-3)

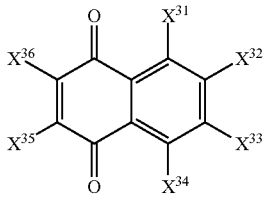

(E-4)

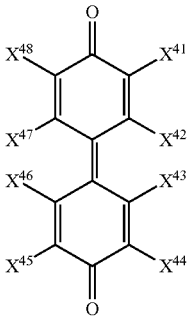

(E-5)

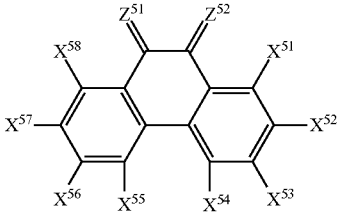

(E-6)

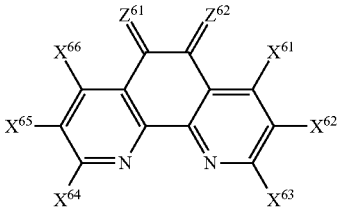

-continued (E-7)

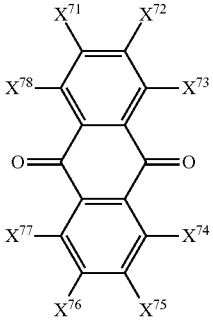

(E-8)

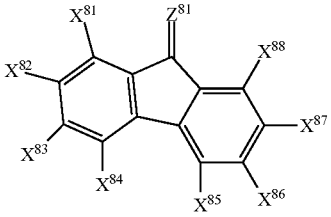

where, in formulae (E-1) to (E-8), one selected from $X^{11}$ to $X^{16}$, one selected from $X^{21}$ to $X^{29}$, one selected from $X^{31}$ to $X^{36}$, one selected from $X^{41}$ to $X^{48}$, one selected from $X^{51}$ to $X^{58}$, one selected from $X^{61}$ to $X^{66}$, one selected from $X^{71}$ to $X^{78}$, and one selected from $X^{81}$ to $X^{88}$ each represent a single bond, the rest of $X^{11}$ to $X^{16}$, $X^{21}$ to $X^{29}$, $X^{31}$ to $X^{36}$, $X^{41}$ to $X^{48}$, $X^{51}$ to $X^{58}$, $X^{61}$ to $X^{66}$, $X^{71}$ to $X^{78}$, and $X^{81}$ to $X^{88}$ each independently represent a hydrogen atom, a halogen atom, an alkoxycarbonyl group, a carboxyl group, a cyano group, a dialkylamino group, a hydroxy group, a heterocyclic group, a nitro group, a substituted or unsubstituted alkoxy group, or a substituted or unsubstituted alkyl group, and $Z^{51}$, $Z^{52}$, $Z^{61}$, $Z^{62}$, and $Z^{81}$ each independently represent an oxygen atom, a $C(CN)_2$ group, or $N\text{-}R^{11}$representing a substituted or unsubstituted aryl group or a substituted or unsubstituted alkyl group.

* * * * *